US012584368B1

(12) United States Patent
Soares et al.

(10) Patent No.: US 12,584,368 B1
(45) Date of Patent: Mar. 24, 2026

(54) STACKED IRIS NEXT GENERATION ANNULAR PACKING UNIT

(71) Applicant: Hydril USA Distribution LLC, Houston, TX (US)

(72) Inventors: Paulo Soares, Houston, TX (US); Joseph Incavo, Houston, TX (US); Greg Myers, Houston, TX (US); Elliot Yendell, Houston, TX (US); Connor Cook, Houston, TX (US); Justin Fenske, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 19/042,800

(22) Filed: Jan. 31, 2025

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/085
See application file for complete search history.

(56) References Cited

U.S. PATENT DOCUMENTS 4,099,699 A * 7/1978 Allen ..... E21B 33/06 277/327
4,458,876 A * 7/1984 Schaeper ..... E21B 33/06 251/1.2
4,508,311 A * 4/1985 Just ..... E21B 33/06 277/327
4,602,794 A * 7/1986 Schaeper ..... E21B 33/06 251/1.2
10,167,694 B2 * 1/2019 Le ..... E21B 33/06
12,146,377 B1 * 11/2024 Boulanger ..... E21B 33/062
12,152,459 B1 * 11/2024 Kroesen ..... E21B 33/06
2012/0227987 A1 * 9/2012 Castriotta ..... E21B 33/062 166/85.4
2013/0341538 A1 * 12/2013 Huang ..... E21B 33/06 251/1.1
2018/0258728 A1 * 9/2018 Zonoz ..... E21B 33/06
2020/0157908 A1 * 5/2020 Nault ..... E21B 33/062
2023/0265732 A1 * 8/2023 Arteaga ..... E21B 33/06 166/373

* cited by examiner

*Primary Examiner* — Kipp C Wallace
(74) *Attorney, Agent, or Firm* — Osha Bergman Watanabe & Burton LLP

(57) ABSTRACT

Blowout preventer (BOP) systems and methods for operating a BOP. The BOP systems include an apparatus configured to isolate wellbore fluids and a BOP housing radially surrounding the apparatus. The apparatus includes a packing unit and a piston located downhole of the packing unit. The packing unit includes an elastomeric packer having first metal inserts and second metal inserts disposed axially through the elastomeric packer. The first metal inserts and the second metal inserts have an elongated portion coupled to a first end having a first prong and a second end having a second prong. Methods for operating a BOP system include providing the BOP system to a wellhead, the BOP system including an apparatus configured to isolate wellbore fluids, applying a pressure to the apparatus in a series of stages, and sealing a central circumference of the apparatus when a closing pressure is applied to the apparatus.

16 Claims, 30 Drawing Sheets

STACKED IRIS NEXT GENERATION ANNULAR PACKING UNIT

BACKGROUND

Well control is an important aspect of oil and gas exploration. When drilling a well, for example, in oil and gas exploration applications, safety devices must be put in place to prevent injury to personnel and damage to equipment resulting from unexpected events associated with the drilling activities.

Drilling wells in oil and gas exploration involves penetrating a variety of subsurface geologic structures, or "layers." Occasionally, a wellbore will penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" may result in catastrophic destruction of the drilling equipment (including, for example, the drilling rig) and substantial injury or death of rig personnel.

Because of the risk of blowouts, blowout preventers ("BOPs") are typically installed at the surface or on the sea floor in deep water drilling arrangements to effectively seal a wellbore until active measures can be taken to control the kick. BOPs may be activated so that kicks are adequately controlled and "circulated out" of the system. There are several types of BOPs, including an annular BOP.

Annular BOPs typically comprise annular, elastomeric "packing units" that may be activated to encapsulate drill pipe and well tools to completely seal about a wellbore. In situations where no drill pipe or well tools are within the bore of the packing unit, the packing unit can be compressed to such an extent that the bore is essentially closed, acting as a valve on the wellbore. Typically, packing units are used to seal around a drill pipe, by being quickly compressed, either manually or by machine, to affect a seal about the pipe to prevent a well from blowing out.

Thus, a critical parameter for annular packing units is how much pressure the seal can handle because the pressure handling capacity determines the type of wellbore environment in which the packing unit may be safely implemented. While the pressure handling capacity of packing units depends on a number of parameters and conditions, the principle limiting factor is the "extrusion gap." Factors which affect extrusion gap (and therefore pressure handling capacity of the packing unit) are seal design, seal type, and material.

In terms of sealing systems, the extrusion gap is defined as the clearance between one or more hardware components. For example, the radial clearance in the hardware that needs be sealed is referred to as the extrusion gap. A seal extruding through the extrusion gap is a common failure mode for high-pressure systems. In an application where the extrusion gap is too large for the system pressure, the seal will begin to deform, and the material will begin to cold-flow into the gap, giving the appearance of the seal "extruding." If enough extrusion of the seal takes place, the integrity of the seal will be compromised eventually leading to failure. The extrusion resistance of any seal may depend largely on the backup ring design. In general, the smaller the extrusion gap, the higher the pressure the seal can handle. Accordingly, there exists a need for improved annular BOP systems to minimize the extrusion gap.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a blowout preventer (BOP) system including an apparatus configured to isolate wellbore fluids having a packing unit and a piston, where the piston is located downhole of and proximate to the packing unit, and where the packing unit includes an elastomeric packer having a plurality of first metal inserts disposed axially through a plurality of first insert portions in the elastomeric packer and a plurality of second metal inserts disposed axially through a plurality of second insert portions in the elastomeric packer. The plurality of first metal inserts each have a first insert elongated portion coupled to a first insert first end having a first insert first prong and a first insert second end having a first insert second prong. The plurality of second metal inserts each have a second insert elongated portion coupled to a second insert first end having a second insert first prong and a second insert second end having a second insert second prong. The system also includes a BOP housing radially surrounding the apparatus, where the piston and the packing unit are axially stacked within the BOP housing.

In another aspect, embodiments disclosed herein also relate to a method for operating a blowout prevention (BOP) system, the method including providing the BOP system to a wellhead, the BOP system having an apparatus configured to isolate wellbore fluids comprising a packing unit and a piston, where the piston is located downhole of and proximate to the packing unit, where the packing unit includes an elastomeric packer having a plurality of first metal inserts disposed axially through a plurality of first insert portions in the elastomeric packer and a plurality of second metal inserts disposed axially through a plurality of second insert portions in the elastomeric packer. The plurality of first metal inserts each have a first insert elongated portion coupled to a first insert first end having a first insert first prong and a first insert second end having a first insert second prong. The plurality of second metal inserts each have a second insert elongated portion coupled to a second insert first end having a second insert first prong and a second insert second end having a second insert second prong. Methods also include providing a BOP housing radially surrounding the apparatus, where the piston and the packing unit are axially stacked within the BOP housing, applying a pressure to the apparatus in a series of stages, where the applied pressure comprises an opening pressure and a closing pressure, where the opening pressure moves the piston in a downhole direction and the closing pressure moves the piston in an uphole direction. The method also includes sealing a central circumference of the apparatus when the closing pressure is applied by compressing the packing unit with the piston when the piston is moved uphole, where, upon compressing, the packing unit moves the plurality of first metal inserts and the plurality of second metal inserts radially inward to form a seal and unsealing the central circumference of the apparatus when the opening pressure is applied by decompressing the packing unit when the piston is moved downhole, where, upon decompressing, the packing unit moves the plurality of first metal inserts and the plurality of second metal inserts radially outward to release the seal.

Other aspects and advantages of the claimed subject matter will be apparent from the following description and the appended claims.

DETAILED DESCRIPTION

Figure 1A:
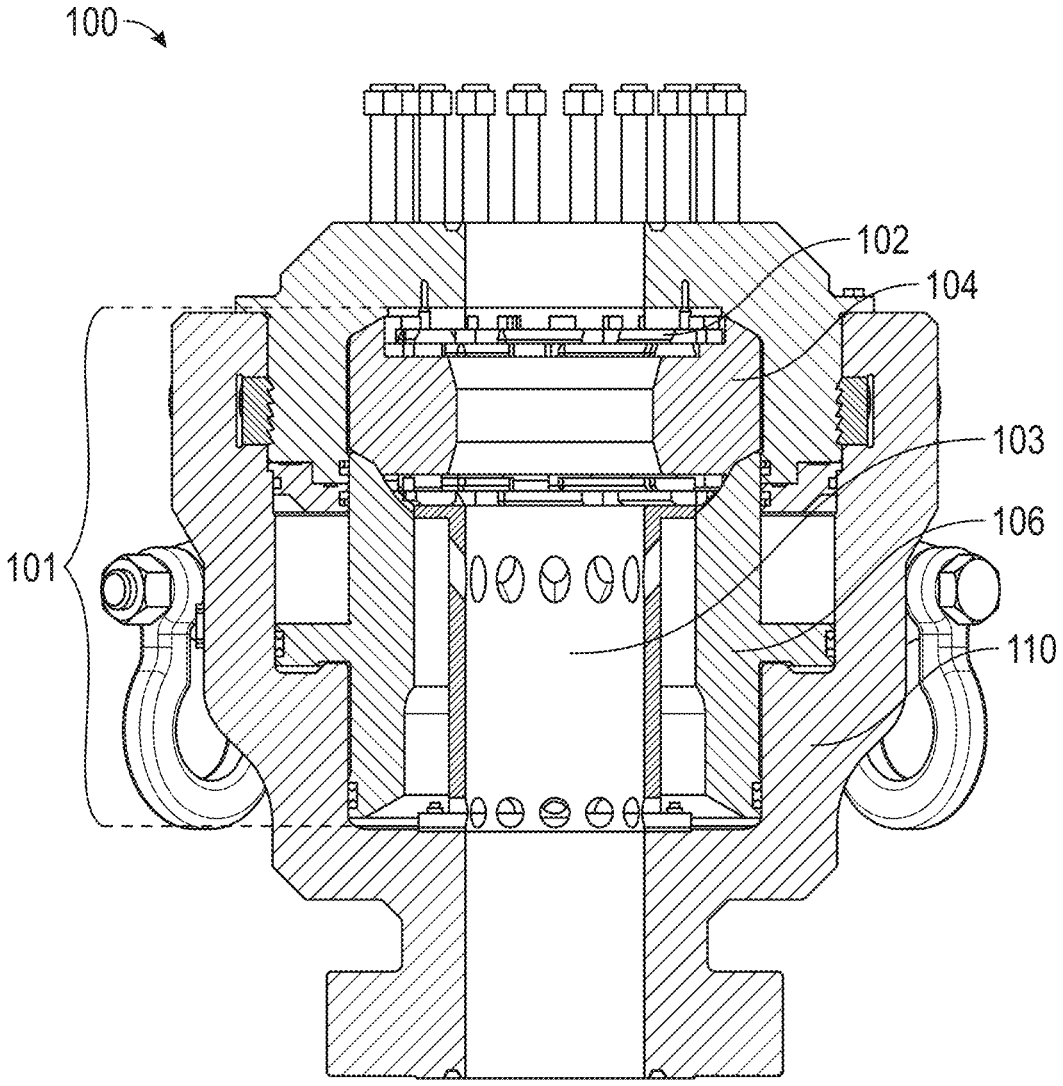
FIG. 1A illustrates an example BOP system according to one or more embodiments.

Throughout the application, ordinal numbers (for example, first, second, third) may be used as an adjective for an element (that is, any noun in the application). The use of ordinal numbers does not imply or create a particular ordering of the elements or limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a horizontal beam" includes reference to one or more of such beams.

Terms such as "approximately" or "substantially" mean that the recited characteristic, parameter, or value need not be achieved exactly, but that deviations or variations, including, for example, tolerances, measurement error, measurement accuracy limitations, and other factors known to those of skill in the art, may occur in amounts that do not preclude the effect the characteristic was intended to provide.

It is to be understood that one or more of the steps shown in the flowcharts may be omitted, repeated, or performed in a different order than shown. Accordingly, the scope disclosed should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

Embodiments disclosed herein generally relate to an apparatus for isolating wellbore fluids. Embodiments disclosed herein also relate to blowout preventer (BOP) systems including the apparatus for isolating wellbore fluids and methods for isolating a wellbore fluid using the BOP system 100 disclosed herein.

As described above, the sealing capacity of a BOP seal is greatly improved as the extrusion gap decreases. An extrusion gap is defined herein as any free volume that material from the packer is able to flow into, particularly upon BOP activation (i.e., application of pressure). In some embodiments, the extrusion gap includes a distance between two or more elements in an apparatus for sealing when the seal has been created. Specifically, according to embodiments disclosed herein, an "extrusion gap" may refer to a radial distance between a central circumference of the packing unit and a mandrel around which the BOP system 100 is configured seal around. In addition, an "extrusion gap" according to one or more embodiments may refer to a radial diameter of a space within the central circumference of the packing unit when the BOP system 100 is configured to seal around the packing unit itself (e.g., when a seal is created in the absence of a mandrel being inserted into the central circumference of the apparatus). Sealing around the packing unit itself may also be referred to as "complete shut-off" in the industry.

In general, an extrusion gap may be expressed in terms of radial or diametral clearance, which can lead to some confusion. Embodiments disclosed herein refer to an extrusion gas as a radial clearance. The radial clearance is equal to the diametral clearance divided by two.

A seal's ability to withstand extrusion depends on numerous factors. The physical size of the seal plays an obvious and important role-a seal with a larger cross-section will handle higher pressures for a given extrusion gap. For example, a seal with a 1/16" cross-section can potentially hold the same amount of pressure as a seal with a 1/4" cross-section, but the extrusion gap must be much smaller. The seal material also plays a critical role in resisting extrusion. Specifically, the modulus (i.e., stiffness) of the seal material is the main determining factor for extrusion resistance of a seal. Additives, such as fillers (which generally increase a material's modulus) contained in the elastomer seal, may also affect the pressure handling capacity. Operating temperature of the system can also significantly affect a seal material's pressure handling or extrusion requirements. Elevated temperatures make most materials softer (e.g., lower the material's modulus) and more compliant and therefore easier to extrude. Likewise, pressure ratings will be higher at cryogenic temperatures because the material is stiffer (e.g., having a higher modulus) and more difficult to cold-flow.

It is important to note that the extrusion gap also varies with the size of hardware that the packing unit is sealing against. For example, a packing unit may seal against a tubular member. A tubular member according to one or more embodiments may be any tubular member known in the art, including but not limited to a mandrel, drill pipe, drill collars, pup joints, casing, production tubing, coiled tubing, and the like. The term "mandrel" will be used herein as the tubular member. A common mandrel size is a 5 inch mandrel. Accordingly, the BOP system 100 of one or more embodiments may have an optimized (e.g., lowest) extrusion gap size when sealing around a 5 inch mandrel. For example, sealing around a 5 inch diameter mandrel within the annular flow path of a BOP system 100 mandrel may lead to a smaller extrusion gap then sealing around mandrel having a diameter of other than 5 inches. Additionally, as hardware diameters increase, manufacturing tolerances also increase, making it impractical or cost-prohibitive to require extremely tight tolerances in large diameter hardware; thus, extrusion gaps may be inherently larger when sealing around larger diameter hardware.

Turning now to the Figures, FIG. 1A shows a BOP system 100 according to one or more embodiments. The BOP system 100 of FIG. 1A includes an isolation apparatus 101 which includes an assembly of components that may be axially stacked within a BOP housing 110. Each component of the assembly of components within the apparatus may contain a generally central hole such that, when stacked, an inner flow path is formed axially through the assembly of components. The BOP system 100 may also include a BOP housing 110 radially surrounding the isolation apparatus 101, where the piston 106 and the elastomeric packer 104 are axially stacked within the BOP housing 110. Although not explicitly shown in the Figures, it would be understood by one of ordinary skill in the art that the BOP system 100 disclosed herein may include other components not depicted which are necessary for operation of the BOP system 100. For example, other components of the BOP system 100 not shown may include, but are not limited to, flow lines fluidly connected to the BOP system 100 (such as choke and/or kill lines), an accumulator, a drilling spool, and the like.

The isolation apparatus 101 shown in FIG. 1A may include a wear plate 102, a sleeve 103, an elastomeric packer 104, and a piston 106. As shown in FIG. 1A, a wear plate 102 may be stacked on an uphole side of the elastomeric packer 104. A sleeve 103 may be located radially within the piston 106. Accordingly, the sleeve 103 and piston 106 are located on a downhole side of the elastomeric packer 104. The piston 106 is located downhole of the elastomeric packer 104. An example apparatus will be shown in FIGS. 7A-C, as follows.

The term "piston 106" as used herein generally refers to a component of the blowout preventer which moves within a BOP housing and is driven by a hydraulic thrust or pressure. Conventionally, hydraulic pressure on the piston 106 provides a seal while the BOP is operating. In addition, a wellbore pressure differential may also apply a closing force on the piston 106 when using wellbore assist. The piston 106 according to one or more embodiments will be described in more detail in FIGS. 2A-B.

A packing unit, often called a "packer" is defined herein as a surface or subsea tool with one or more elastic sealing elements used to seal an annular space between various sizes of tubing string and a wellbore (or between tubing strings) for well control. Packing units (e.g., elastomeric packer 104) according to one or more embodiments will be described in more detail in FIGS. 5A-D.

In general, a wear plate 102 may be a device used to prevent damage to main portions of machinery due to abrasion or impact and to increase the life of the machine. Wear plates may also be known as "liners" in the industry. Wear plate 102 according to one or more embodiments will be described in more detail in FIGS. 6A-D.

Returning to FIG. 1A, in one or more embodiments, a mandrel (shown below in FIG. 8A-8F as element number 108)) may extend through a central circumference (e.g., the central hole as described above) of the elastomeric packer 104, the piston 106, and the sleeve 103, for example during drilling or production of a well. The tubular member 108 may refer to any suitable oilfield pipe, including but not limited to a drill pipe, drill collars, pup joints, casing, production tubing, coiled tubing, and the like.

As will be described in further detail below, the BOP system 100 may be configured to dynamically adjust such that a seal is formed around a mandrel 108. In some embodiments, the isolation apparatus 101 may seal around itself (e.g., in the absence of a mandrel 108).

Figure 1B:
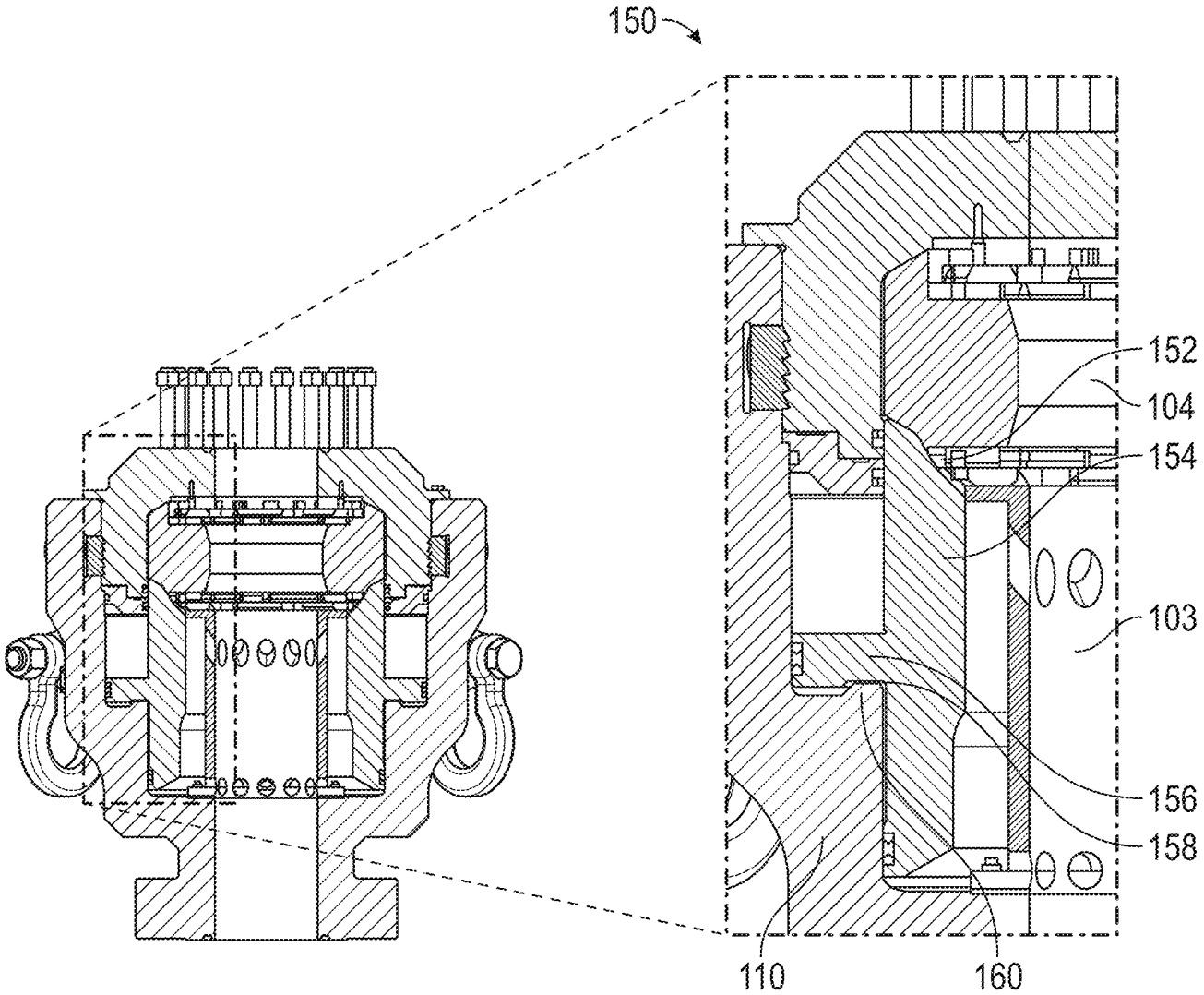
FIG. 1B shows a zoomed in portion of an example BOP system according to one or more embodiments.

FIG. 1B shows a zoomed in portion 150 of the BOP system 100 of FIG. 1A. FIG. 1B illustrates how the components of the isolation apparatus 101 fit together and within a BOP system 100. The piston 106 may include a piston first tubular body 154 and a piston second tubular body 156. The piston second tubular body 156 may be located circumferentially around an outer surface of the piston first tubular body 154, where the piston second tubular body 156 protrudes a radial distance from the piston first tubular body 154 such that the piston second tubular body 156 has a larger outer diameter than the piston first tubular body 154. While the piston 106 may be described herein as a having a piston first tubular body 154 and a piston second tubular body 156, the piston 106 according to one or more embodiments is a single piece. The distinction between the piston first tubular body 154 and piston second tubular body 156 is merely for convenience in describing different portions of the piston 106. The larger outer diameter of the piston second tubular body 156 may be inserted into a portion of the BOP housing 110, as shown in FIG. 1B. Additionally, the piston second tubular body 156 may include a second body notched portion 158 configured to abut a BOP housing shoulder 160 when the components of the BOP system 100 are assembled together.

Additionally, the piston first tubular body 154 may include a piston sloped profile 152 at an uphole location of the piston 106, proximate the elastomeric packer 104. The piston sloped profile 152 is sloped such that various components of the elastomeric packer 104 and/or one or more metal inserts (as will be described in FIGS. 3A-F and 4A-F) may sit within the piston sloped profile 152. As will be described in more detail in the methods section, upon activation of the piston 106, the piston sloped profile 152 may advantageously stroke different portions of the elastomeric packer 104 and/or one or more metal inserts to provide a sealing function around the mandrel 108 or provide sealing of the isolation apparatus 101 to itself.

Figure 2A:
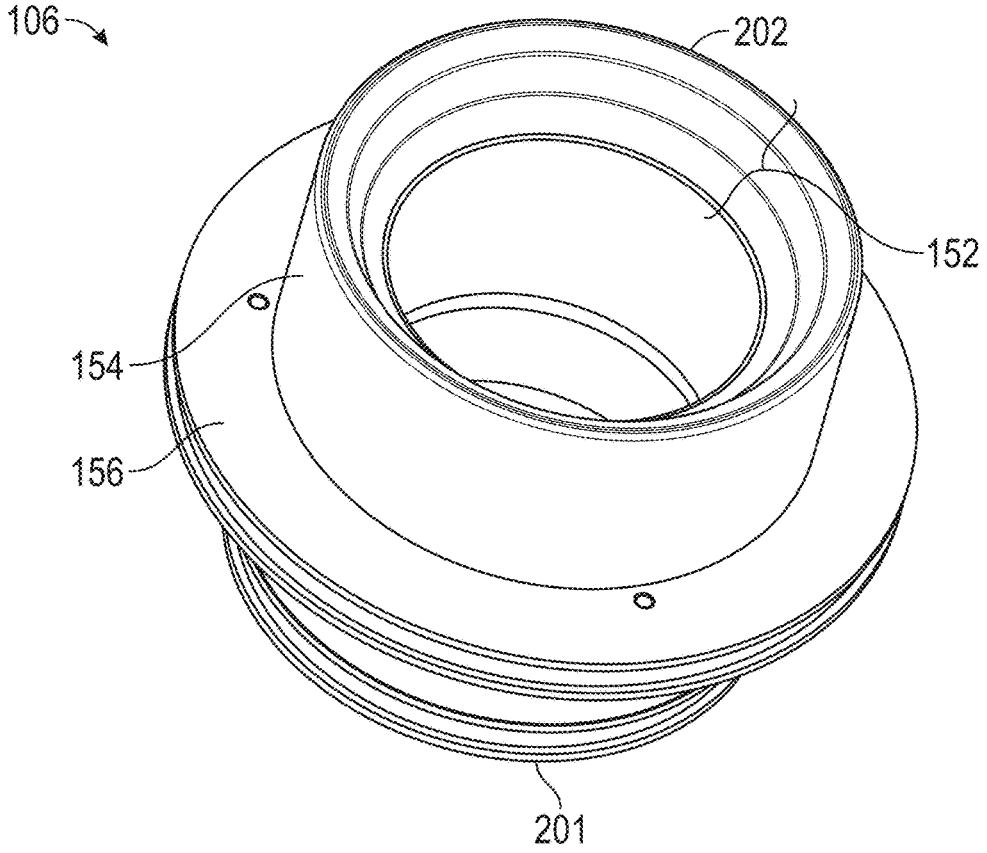
FIG. 2A shows a perspective view of a piston according to one or more embodiments.

Turning to FIG. 2A, a perspective view of a piston 106 according to one or more embodiments disclosed herein is shown. As described above, the piston 106 may include the piston first tubular body 154 and the piston second tubular body 156. The piston first tubular body 154 includes a first body first end 202 and a first body second end 201, where the first body first end 202 may be located uphole and proximate the elastomeric packer 104. The first body second end 201 is located opposite the first body first end 202. An inner diameter of the first body first end 202 of the piston first tubular body 154 may have the piston sloped profile 152 configured to abut against a portion of the elastomeric packer 104 and/or a first metal insert and a second metal insert.

Figure 2B:
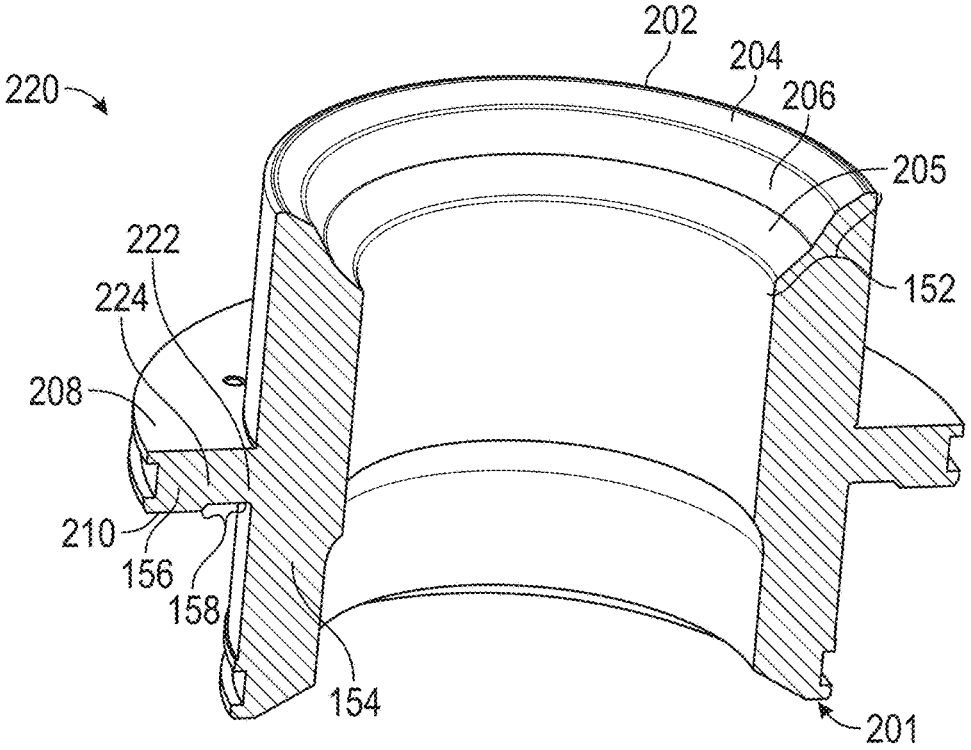
FIG. 2B shows a cutaway view of a piston according to one or more embodiments.

FIG. 2B is a piston cutaway view 220 of the piston 106 according to one or more embodiments. As best shown in FIG. 2B, the piston sloped profile 152 may further include a piston first sloped portion 204, a piston second sloped portion 206, and a piston third sloped portion 205. Also shown in FIG. 2B, the piston second tubular body 156 includes a second body first end 208 and a second body second end 210, where the second body first end 208 may be located uphole of the second body second end 210. The second body second end 210 of the piston second tubular body 156 may have the second body notched portion 158 configured to abut a BOP housing shoulder (e.g., 160 shown in FIG. 1B). The second body notched portion 158 of the piston second tubular body 156 may extend circumferentially around a portion of the piston second tubular body 156 from a piston second tubular body inner diameter 222 towards a piston second tubular body second diameter 224.

In one or more embodiments, the piston first sloped portion 204 may have an angle in a range of about 30° to 60°. In one or more embodiments, the piston second sloped portion 206 may have an angle in a range of about 30° to 60°. In one or more embodiments, the piston third sloped portion 205 may have an angle in a range of about 30° to 60°. In one or more embodiments, the angle of the piston first sloped portion 204 is larger than the angle of the piston second sloped portion 206.

Figure 3B:
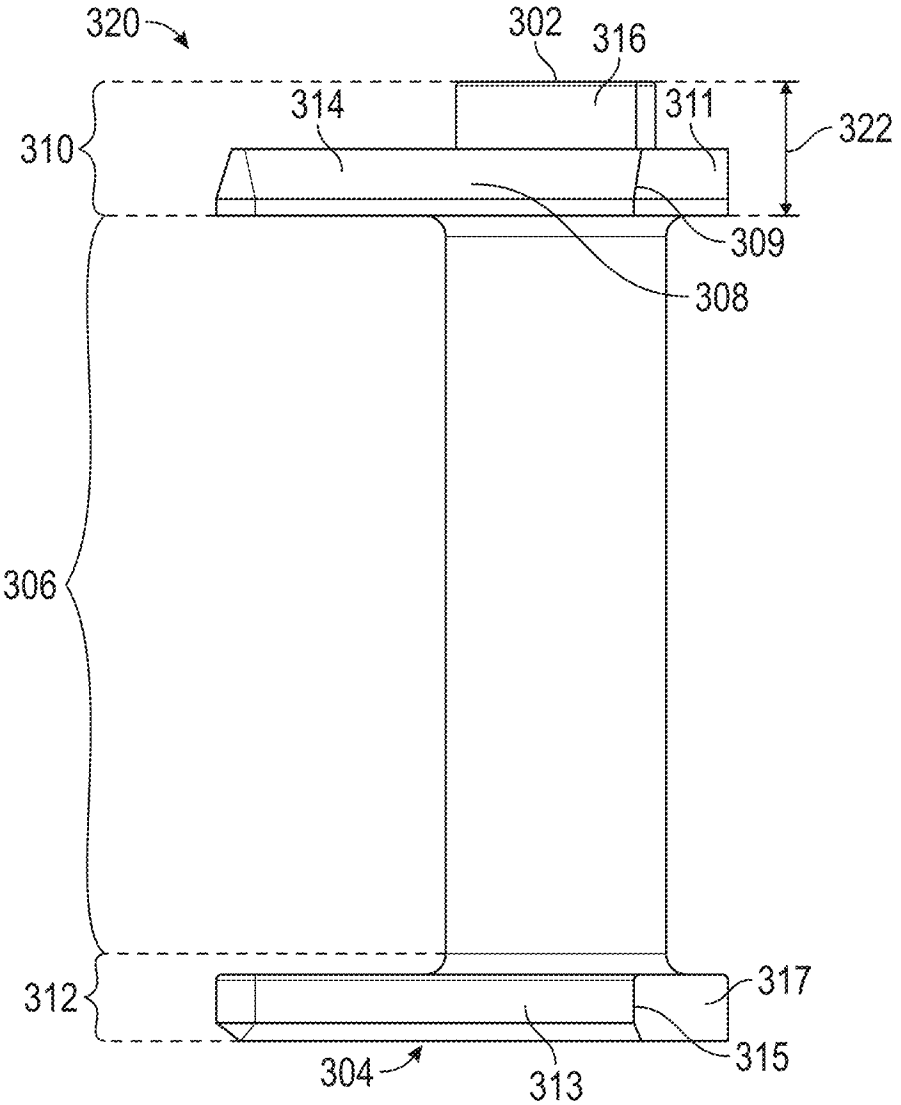
FIG. 3B shows a first-side side view of a first metal insert according to one or more embodiments.
Figure 3A:
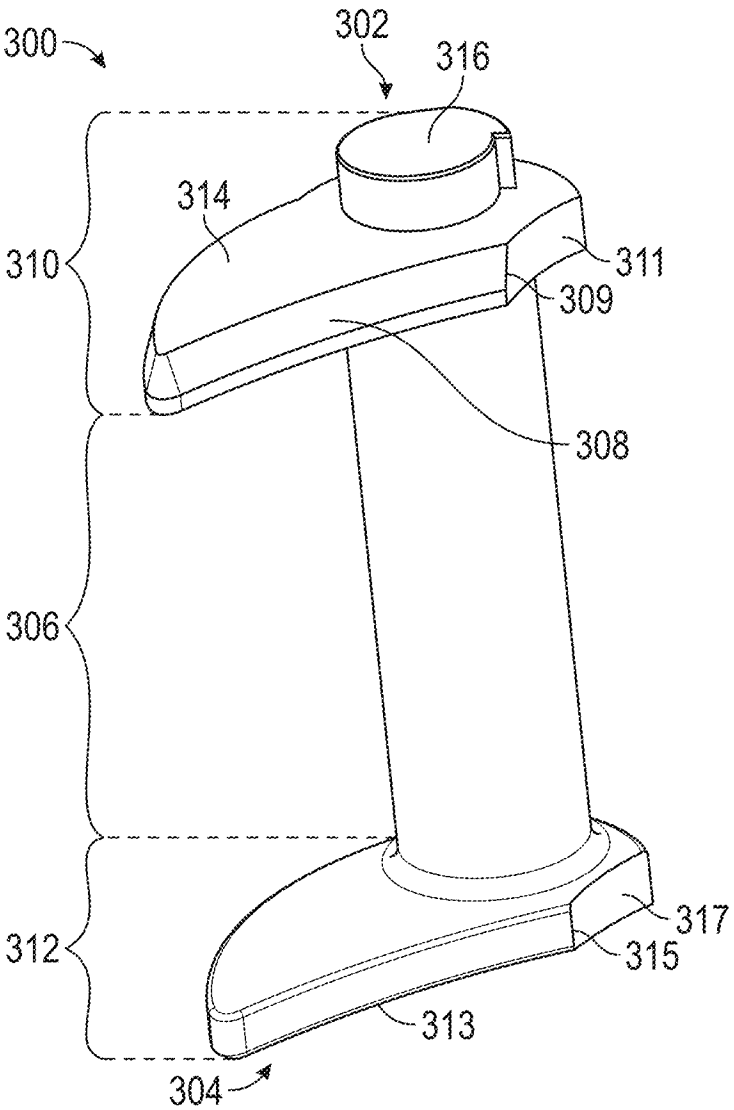
FIG. 3A shows a first-side perspective view of a first metal insert according to one or more embodiments.

FIG. 3A shows a first-side perspective view of a first metal insert 300 according to one or more embodiments. The first metal insert 300 may include a first insert elongated portion 306 coupled to a first insert first end 302 and a first insert second end 304, located opposite the first insert first end 302. The first insert first end 302 may include a first insert first prong 310 and the first insert second end 304 may include a first insert second prong 312.

The first insert first prong 310 may include a first insert first prong base portion 314 and a first insert first prong protrusion portion 316. The first insert first prong protrusion portion 316 may be axially stacked on top of and coupled to the first insert first prong base portion 314. The first insert first prong base portion 314 may include a first insert first step 309 defining a first insert first curve 308 on a first step first side of the first insert first step 309 and a first insert second curve 311 on a first step second side of the first insert first step 309. The first insert second prong 312 may have a first insert second step 315 defining a first insert third curve 313 and a first insert fourth curve 317.

FIG. 3B shows a first-side side view 320 of a first metal insert 300 according to one or more embodiments. As shown in FIG. 3B, in some embodiments, the first insert first curve 308 of the first insert first prong 310 has an arc length which may be the same as an arc length of the first insert third curve 313 of the first insert second prong 312. In one or more embodiments, the first insert second curve 311 of the first insert first prong 310 has an arc length which may be the same as an arc length of the first insert fourth curve 317 of the first insert second prong 312. As would be understood by one of ordinary skill in the art, arc lengths may vary depending on specific elements within the BOP system 100. Figures presented herein represent only an example apparatus and are not intended to be limiting.

Figure 3D:
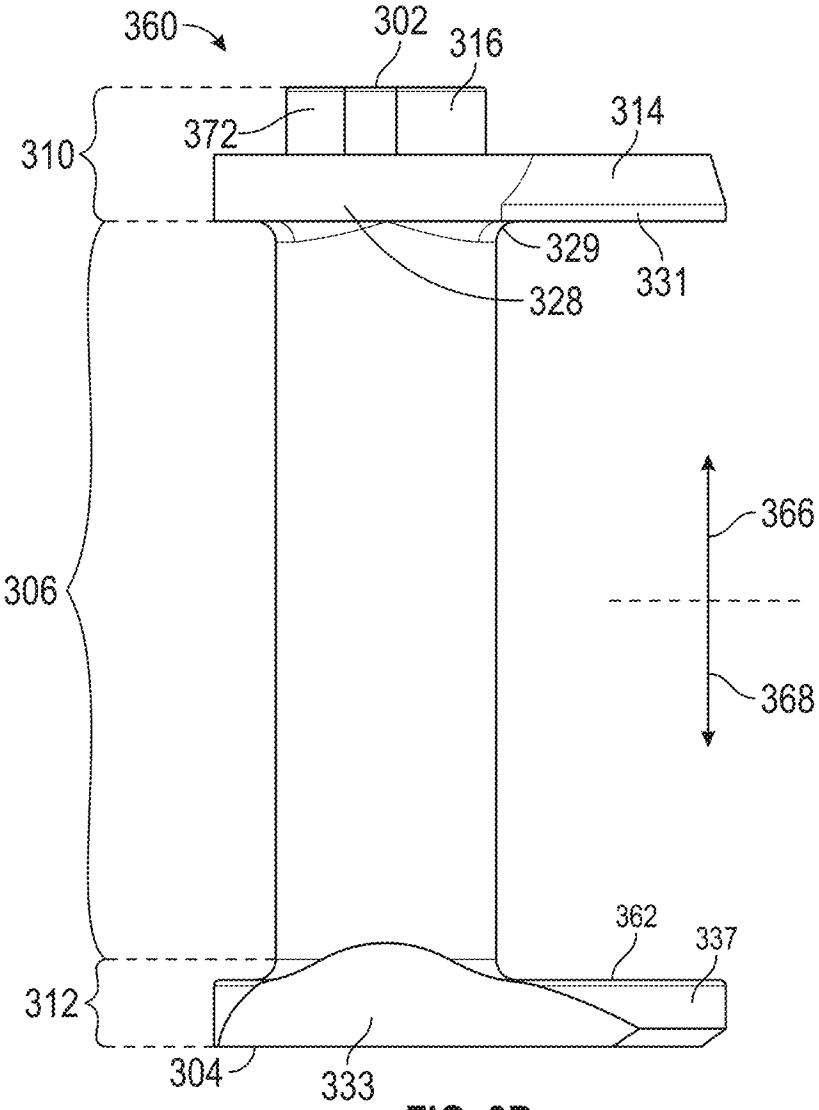
FIG. 3D shows a second-side side view of a first metal insert according to one or embodiments.
Figure 3C:
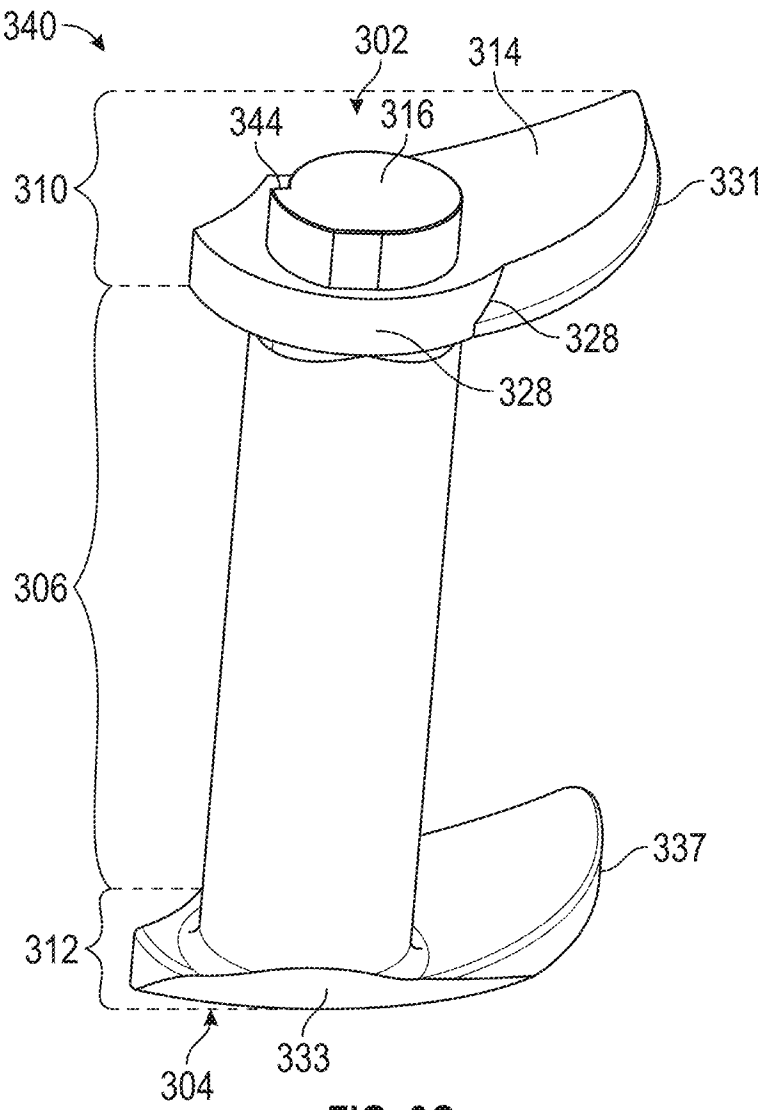
FIG. 3C shows a second-side perspective view of a first metal insert according to one or more embodiments.

FIG. 3C shows a second-side perspective view 340 of a first metal insert 300 according to one or more embodiments. As shown in FIG. 3C, the first insert first prong base portion 314 may have a first insert third step 329 defining a first insert fifth curve 328 on a third step first side of the first insert third step 329 and a first insert sixth curve 331 on a third step second side of the first insert third step 329. The first insert fifth curve 328 and the first insert sixth curve 331 may be located on an opposite side (e.g., the second-side shown in FIGS. 3C-D) of the first metal insert 300 from the first insert first curve 308 and the first insert second curve 311 on the first insert first prong 310 (e.g., the first-side shown in FIGS. 3A-B).

The first insert second prong 312 may also include a first insert seventh curve 337 located on an opposite side (e.g., the second-side shown in FIGS. 3C-D) of the first metal insert 300 from the first insert third curve 313 and the first insert fourth curve 317 (e.g., the first-side shown in FIGS. 3A-B). The first insert second prong 312 may further include a first insert lip 333. The first insert lip 333 may be located proximate the first insert seventh curve 337, axially opposite from the first insert fifth curve 328 on the first insert first prong 310.

FIG. 3D shows a second-side side view 360 of a first metal insert 300 according to one or more embodiments. As shown in FIG. 3D, in some embodiments, the first insert sixth curve 331 has an arc length which may be the same as an arc length of the first insert seventh curve 337. As would be understood by one of ordinary skill in the art, arc lengths may vary depending on specific elements within the BOP system 100. Figures presented herein represent only an example isolation apparatus 101 and are not intended to be limiting.

The first insert lip 333 may be generally described as a portion of the first insert second prong 312 which extends at about a 45° angle from the first insert second prong 312, axially uphole 366 toward the first insert first end 302. In one or more embodiments, the first insert lip 333 may extend axially uphole 366 past a first insert second prong upper surface 362. The first insert lip 333 may advantageously abut one or more portions of the piston 200 in the method for operating a BOP system 100 to isolate wellbore fluids according to one or more embodiments, which will be discussed in more detail below.

Figure 3E:
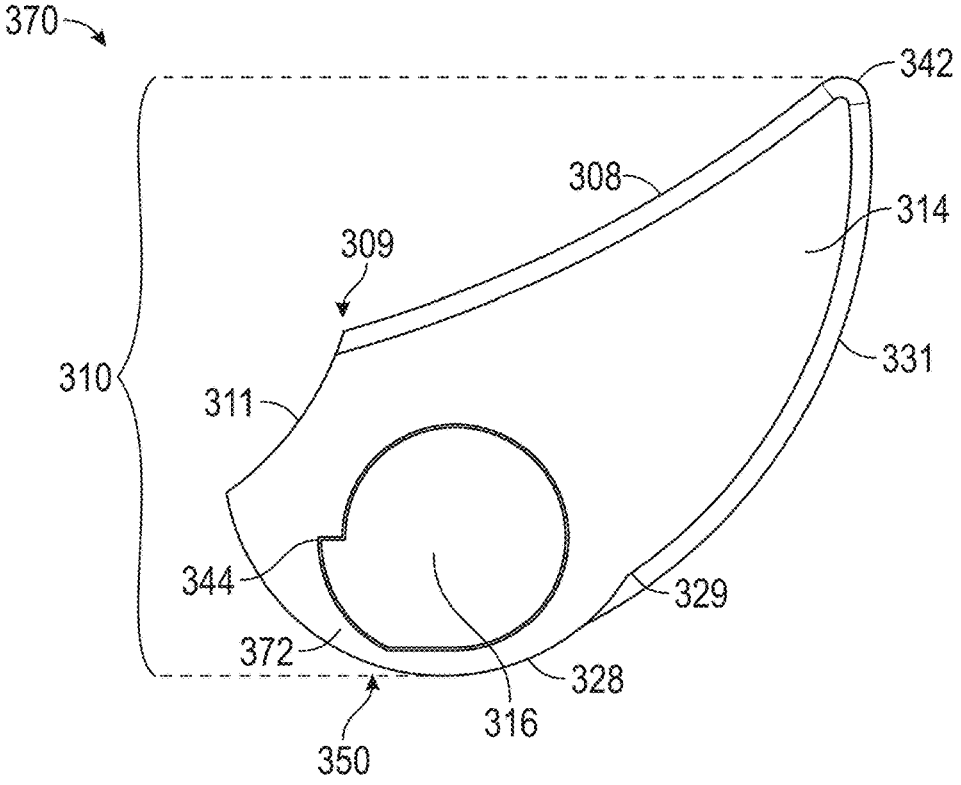
FIG. 3E shows a first metal insert top down view according to one or embodiments.

FIG. 3E shows a first metal insert top down view 370, further illustrating the features of the first insert first prong 310. In some embodiments, the first insert first prong 310 may include a first insert first prong base portion 314 and a first insert first prong protrusion portion 316 coupled to the first insert first prong base portion 314. The first insert first prong base portion 314 may be a three dimensional body comprising a generally wing shaped profile, where the wing shaped profile may include a first insert first prong tip side 342 and a first insert first prong base side 350, the first insert first prong tip side 342 being opposite the first insert first prong base side 350 and the first insert first prong protrusion portion 316.

The first insert first prong protrusion portion 316 may be coupled to an outer surface of the first insert first prong base portion 314. In one or more embodiments, the first insert first prong protrusion portion 316 may have a generally circular shaped profile when viewed from above. The first insert first prong protrusion portion 316 may further include a first insert tooth 344. The first insert tooth 344 may radially protrude from a portion of the first insert first prong protrusion portion 316, defining a first insert eight curve 372. The first insert tooth 344 may be located proximate the first insert fifth curve 328 on the first insert first prong base side 350. The first insert tooth 344 may advantageously abut a portion of a wear plate 102, as will be discussed in more detail below.

Figure 3F:
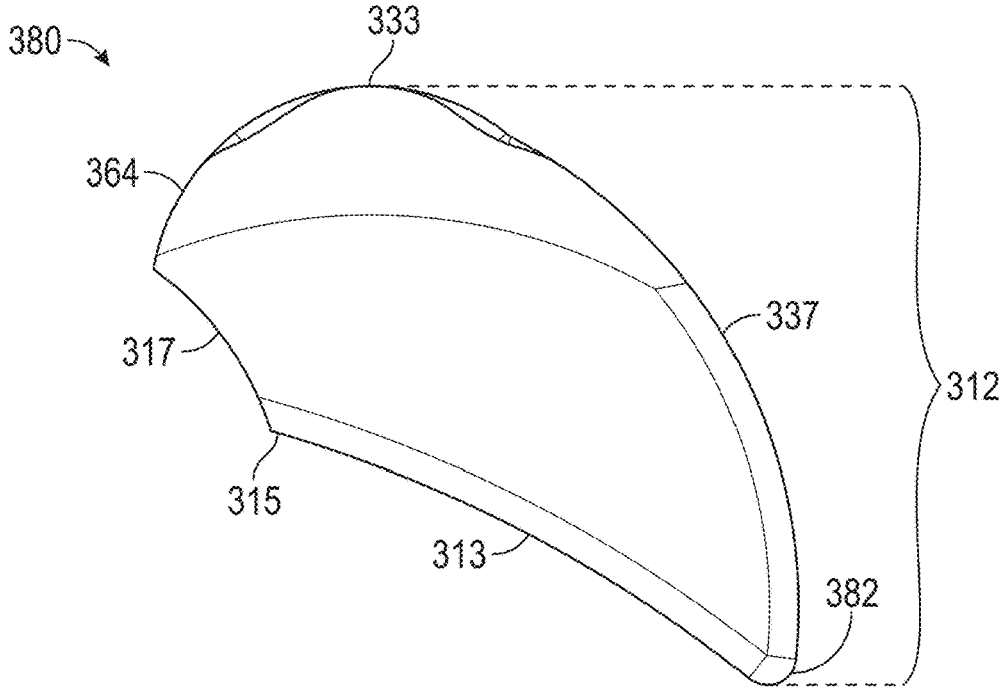
FIG. 3F shows a first metal insert bottom up view according to one or embodiments.

FIG. 3F shows a first metal insert bottom up view 380, illustrating the features of the first insert second prong 312. In one or more embodiments, the first insert second prong 312 may be a three dimensional body having a generally wing shaped profile, where the wing shaped profile includes a first insert second prong base side 364 and a first insert second prong tip side 382, the first insert second prong tip side 382 being opposite the first insert second prong base side 364.

As would be understood by one of ordinary skill in the art, the dimensions of the first insert first prong 310 and the first insert second prong 312 may vary depending on the overall design of the apparatus for isolating wellbore fluids disclosed herein.

Figure 4B:
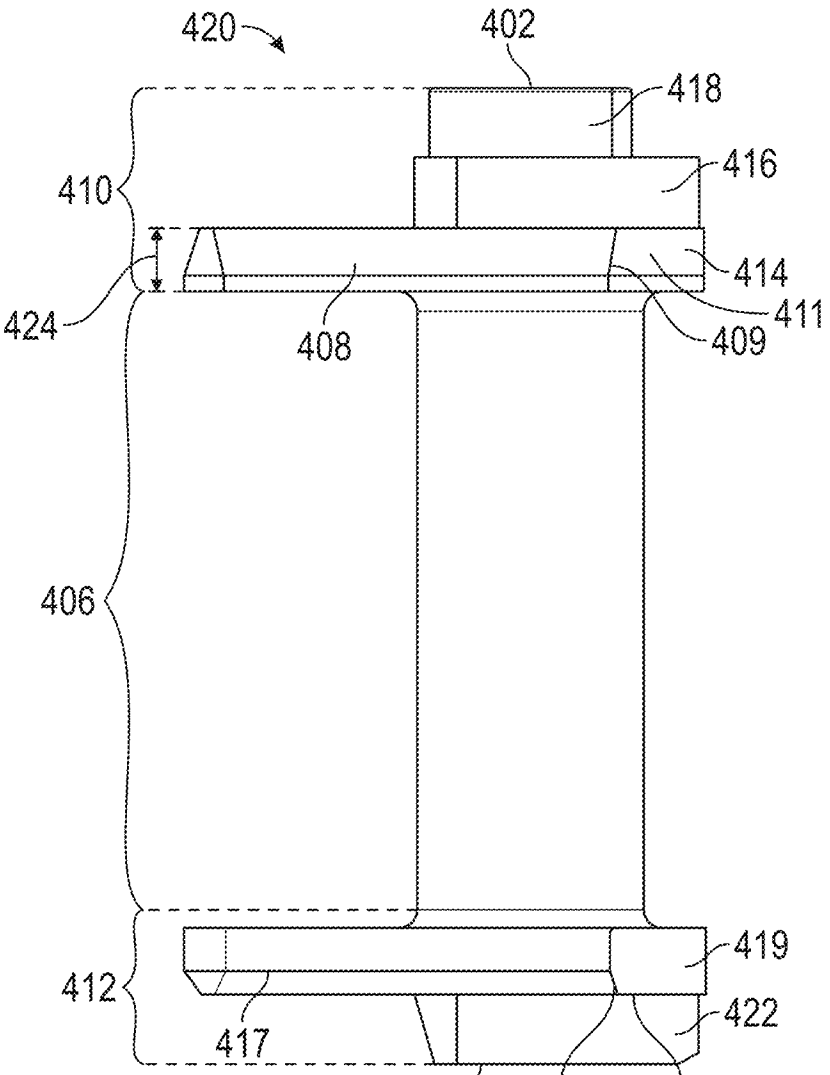
FIG. 4B shows a first-side side view of a second metal insert according to one or more embodiments.
Figure 4A:
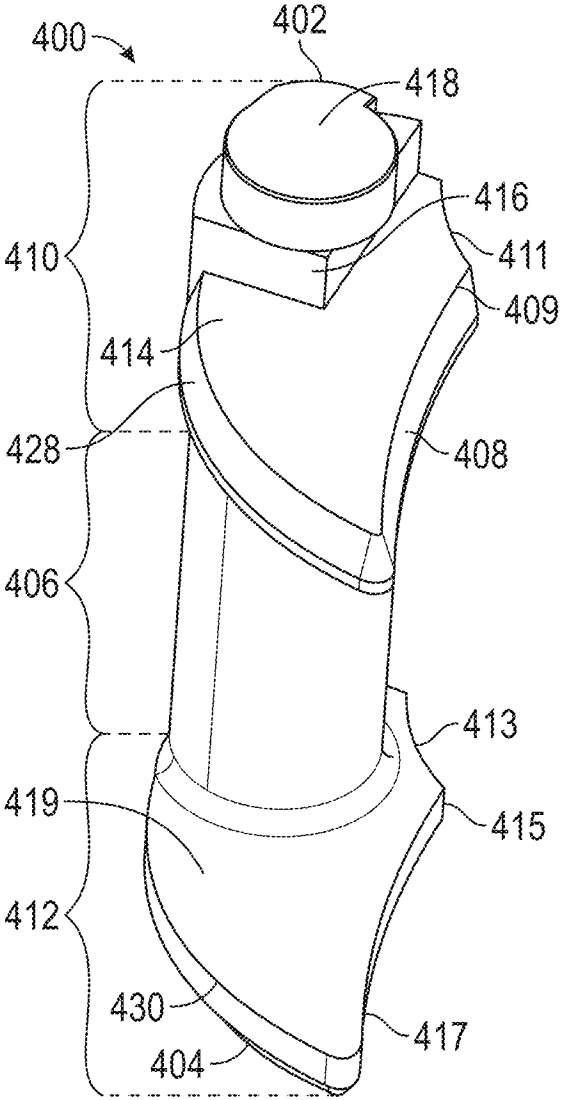
FIG. 4A shows a first-side perspective view of a second metal insert according to one or more embodiments.

FIG. 4A shows a first-side perspective view of a second metal insert 400 according to one or more embodiments. The second metal insert 400 may include a second insert elongated portion 406 coupled to a second insert first end 402 and a second insert second end 404, opposite the second insert first end 402. The second insert first end 402 may include a second insert first prong 410 and the second insert second end 404 may include a second insert second prong 412.

The second insert first prong 410 may include a second insert first prong base portion 414, a second insert first prong first protrusion portion 416, and a second insert first prong second protrusion portion 418. The second insert first prong first protrusion portion 416 may be axially stacked on top of and coupled to the second insert first prong base portion 414. Similarly, the second insert first prong second protrusion portion 418 may be axially stacked on top of and coupled to the second insert first prong first protrusion portion 416.

The second insert first prong base portion 414 may include a second insert first step 409 defining a second insert first curve 408 on a first side of the second insert first step 409 and a second insert second curve 411 on a second side of the second insert first step 409. The second insert second prong base portion 419 may have a second insert second step 415 defining a second insert third curve 413 on a second step first side of the second insert second step 415 and a second insert fourth curve 417 on a second step second side of the second insert second step 415.

The second insert first prong base portion 414 may have second insert fifth curve 428 on an opposite side of the second insert first prong base portion 414 from the second insert first curve 408. Similarly, the second insert second prong base portion 419 may have a second insert sixth curve 430 on an opposite side of the second insert second prong base portion 419 from the second insert fourth curve 417. In one or more embodiments, the second insert fifth curve 428 of the second insert first prong base portion 414 has an arc length which may be the same as an arc length of the second insert sixth curve 430 of the second insert second prong base portion 419. The curved portions may advantageously abut a portion of the elastomeric packer 104 when the isolation apparatus 101 is activated according to methods disclosed herein. As would be understood by one of ordinary skill in the art, arc lengths may vary depending on specific elements within the BOP system 100. Figures presented herein represent only an example apparatus and are not intended to be limiting.

FIG. 4B shows a first-side side view 420 of a second metal insert 400 according to one or more embodiments. As shown in FIG. 4B, in one or more embodiments, the second insert first curve 408 of the second insert first prong base portion 414 has an arc length which may be the same as an arc length of the second insert fourth curve 417 of the second insert second prong base portion 419. In one or more embodiments, the second insert second curve 411 of the second insert first prong base portion 414 has an arc length which may be the same as an arc length of the second insert third curve 413 of the second insert second prong base portion 419. As would be understood by one of ordinary skill in the art, arc lengths may vary depending on specific elements within the BOP system 100. Figures presented herein represent only an example isolation apparatus 101 and are not intended to be limiting.

Figure 4D:
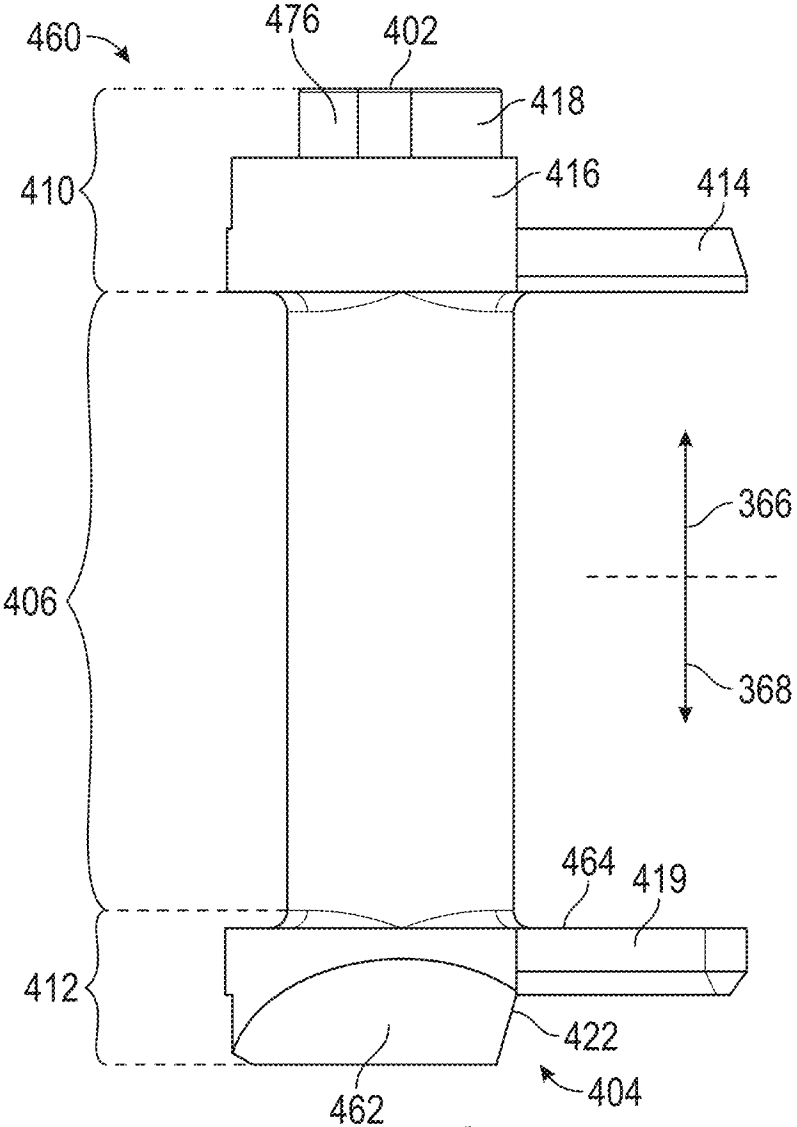
FIG. 4D shows a second-side side view of a second metal insert according to one or more embodiments.
Figure 4C:
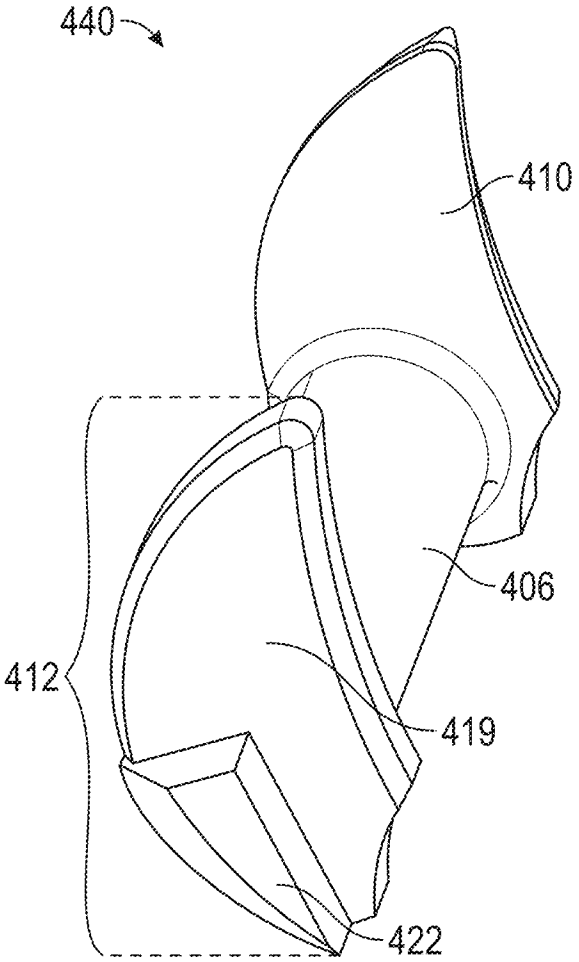
FIG. 4C shows a second perspective view of a second metal insert according to one or more embodiments.

FIG. 4C shows a perspective view 440 of the second insert second prong 412 according to one or more embodiments. As shown in FIG. 4C, the second insert second prong 412 may have a second insert second prong protrusion portion 422 which may be axially stacked on top of and coupled to the second insert second prong base portion 419.

FIG. 4D shows a second-side side view 460 of a second metal insert 400 according to one or more embodiments. The second insert second prong 412 may have a second insert lip 462. The second insert lip 462 may be generally described as a portion of the second insert second prong 412 which extends from the second insert second prong protrusion portion 422 at an angle of about 45° from the second insert second prong 412, axially uphole 366 toward a second insert second prong base portion upper surface 464. The second insert lip 462 may advantageously abut one or more portions of the piston 200 in the method for operating a BOP system 100 to isolate wellbore fluids according to one or more embodiments, which will be discussed in more detail below.

Figure 4E:
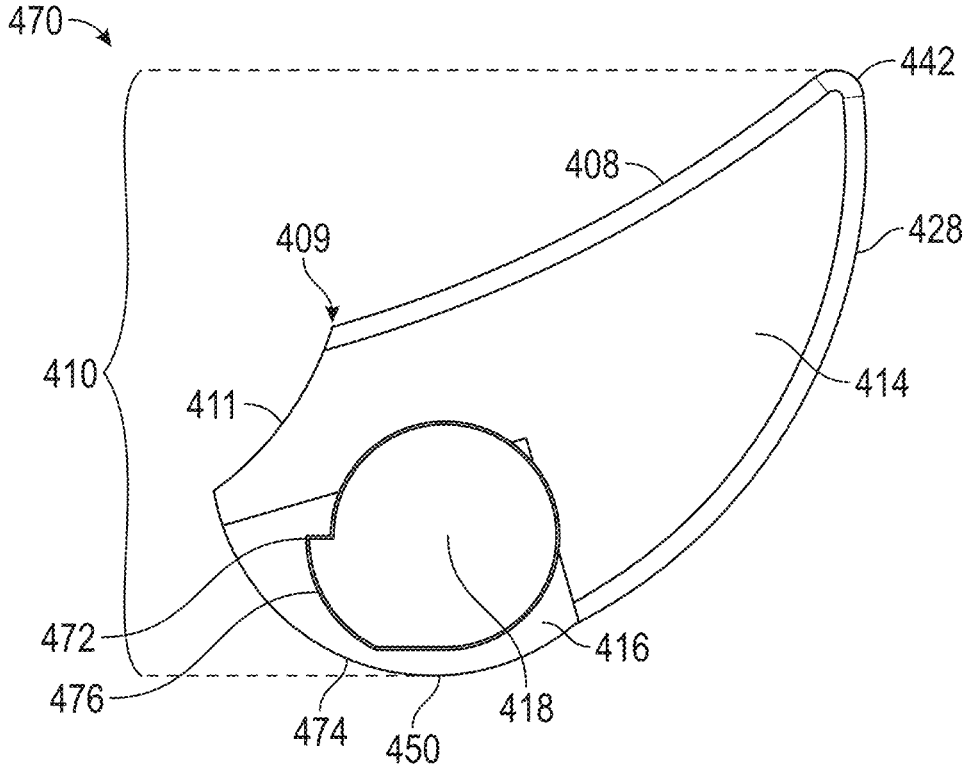
FIG. 4E shows a second metal insert top down view according to one or more embodiments.

FIG. 4E shows a second metal insert top down view 470, further illustrating the features of the second insert first prong 410. In one or more embodiments, the second insert first prong 410 may include a second insert first prong base portion 414 and a second insert first prong first protrusion portion 416 coupled to the second insert first prong base portion 414. The second insert first prong base portion 414 may be a three dimensional body comprising a generally wing shaped profile, where the wing shaped profile may include a second insert first prong tip side 442 and a second insert first prong base side 450, the second insert first prong tip side 442 opposite the second insert first prong base side 450.

The second insert first prong first protrusion portion 416 may be coupled to an outer surface of the second insert first prong base portion 414. In one or more embodiments, the second insert first prong first protrusion portion 416 may include a generally rectangular shape when viewed from above. The rectangular shape of the second insert first prong first protrusion portion 416 may have a curved edge defined as a second insert seventh curve 474 proximate the second insert first prong base side 450. In one or more embodiments, the second insert seventh curve 474 may have an arc length which is the same as an arc length of the second insert first prong base side 450.

The second insert first prong second protrusion portion 418 may be coupled to an outer surface of the second insert first prong first protrusion portion 416. In one or more embodiments, the second insert first prong second protrusion portion 418 may have a generally circular shaped profile when viewed from above. The second insert first prong second protrusion portion 418 may further include a second insert tooth 472. The second insert tooth 472 may radially protrude from a portion of the second insert first prong second protrusion portion 418 proximate the second insert first prong base side 450. Furthermore, the second insert tooth 472 may have a second insert eighth curve 476 on an outer side of the second insert tooth 472 proximate the second insert first prong base side 450. The second insert tooth 472 may advantageously abut a portion of a wear plate 102, as will be discussed in more detail below.

Figure 4F:
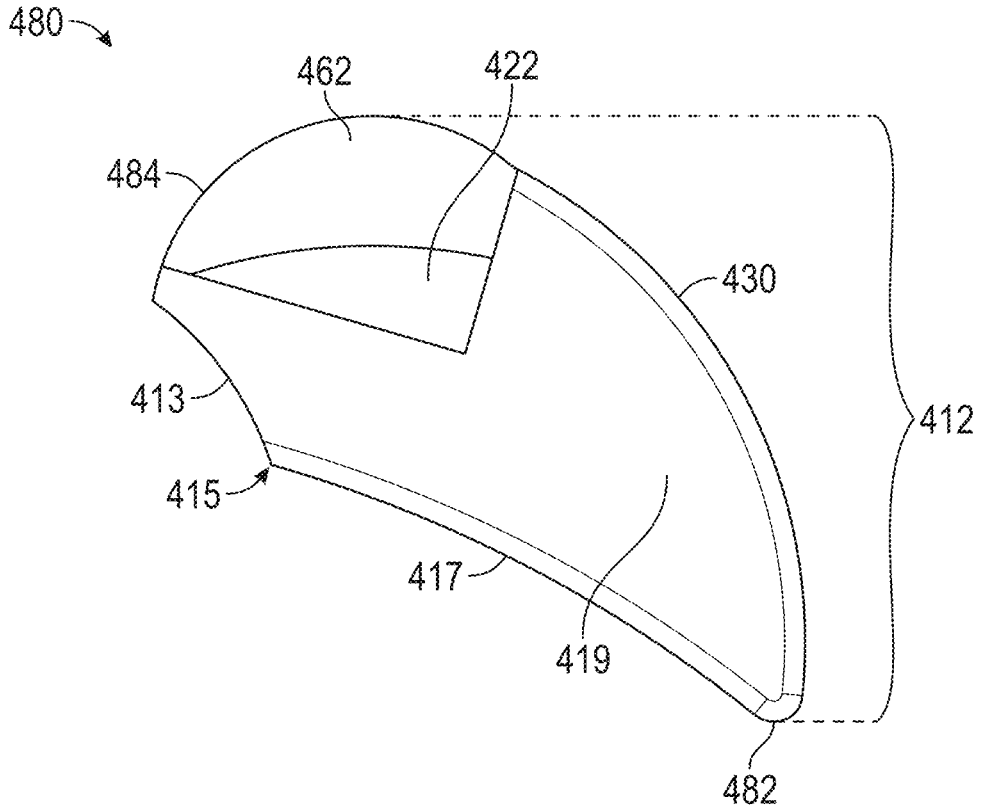
FIG. 4F shows a second metal insert bottom up view according to one or more embodiments.

FIG. 4F shows a second metal insert bottom up view 480, illustrating the features of the second insert second prong 412. In one or more embodiments, the second insert second prong base portion 419 may be a three dimensional body having a generally wing shaped profile, where the wing shaped profile includes a second insert second prong tip side 482 and a second insert second prong base side 484, the second insert second prong tip side 482 being opposite the second insert second prong base side 484. As shown in FIG. 4F, the second insert second prong protrusion portion 422 is coupled to an outer surface of the second insert second prong base portion 419 proximate the second insert second prong base side 484. The second insert lip 462 extends from the second insert second prong base side 484.

As would be understood by one of ordinary skill in the art, the dimensions of the second insert first prong 410 and the second insert second prong 412 may vary depending on the overall design of the isolation apparatus 101 disclosed herein.

Figure 5A:
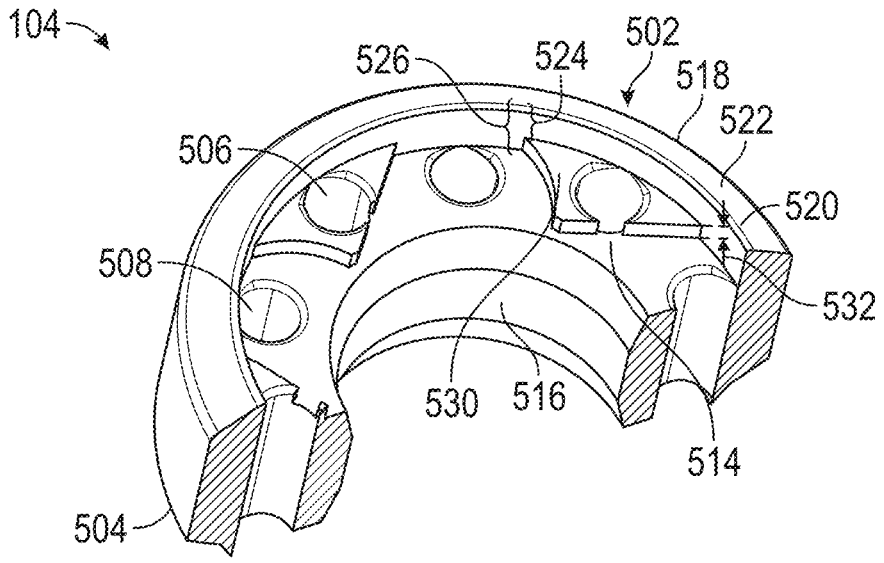
FIG. 5A shows a perspective cutaway view of an elastomeric packer according to one or more embodiments.
Figure 5B:
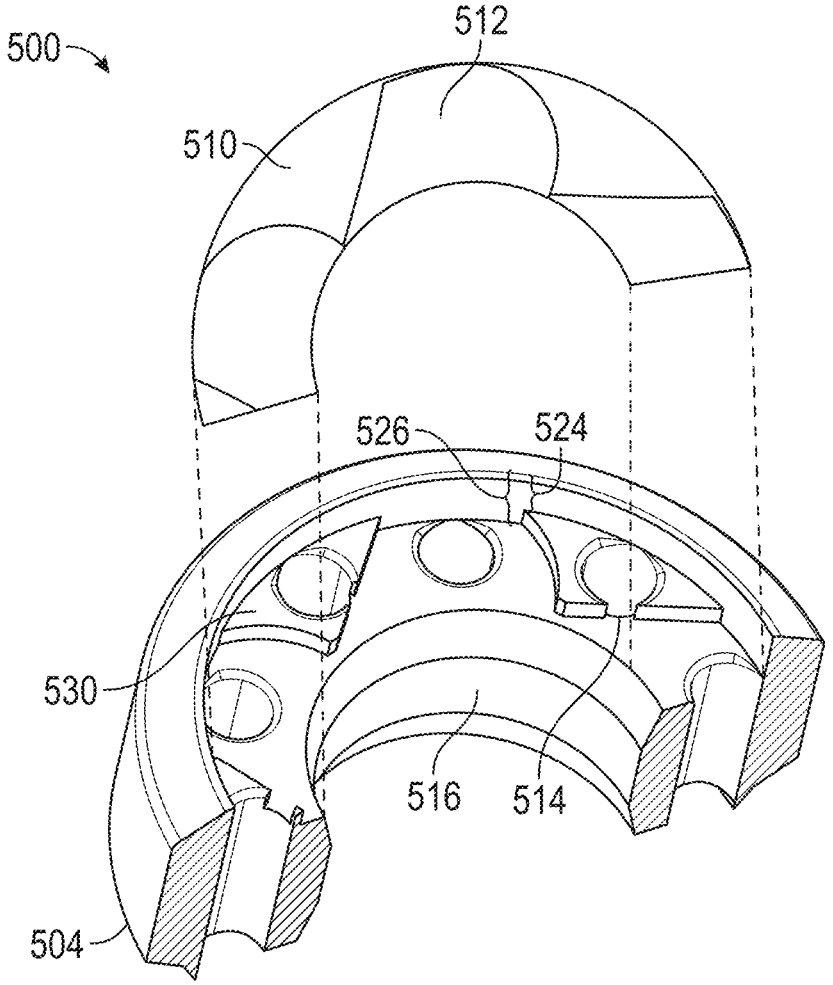
FIG. 5B shows an alternative perspective cutaway view of an elastomeric packer according to one or more embodiments.

FIG. 5A shows a perspective cutaway view of an elastomeric packer 104 according to one or more embodiments. The elastomeric packer 104 may be part of a packing unit (e.g., packing unit 701 shown in FIG. 7A). The elastomeric packer 104 of FIG. 5A includes a packer first side 502 located at an uphole location compared to a packer second side 504, opposite the packer first side 502. The elastomeric packer 104 may include a plurality of packer first insert portions 506 and a plurality of packer second insert portions 508. The plurality of packer first insert portions 506 and the plurality of packer second insert portions 508 may extend axially through a body of the elastomeric packer 104. In one or more embodiments, the plurality of packer first insert portions 506 may be configured to hold a plurality of first metal inserts 300 (shown in FIGS. 3A-E) in place. In one or more embodiments, the plurality of packer second insert portions 508 may be configured to hold a plurality of second metal inserts (shown in FIGS. 4A-E) in place.

The elastomeric packer 104 has a packer central circumference 516, defining a generally central, circular hole within the elastomeric packer 104. The packer first side 502 may have a first side raised edge 522 having a first side outer circumference 518 and a first side inner circumference 520. The first side raised edge 522 may have a height defined by at least one cutout portion (e.g., a first side first cutout portion 510 and or a first side second cutout portion 512), as will be described in more detail below.

The elastomeric packer 104 may also include a first side first cutout portion 510 and a first side second cutout portion 512, where material is removed from the elastomeric packer 104 through a portion of the body of the elastomeric packer 104. The exact dimensions and shape of the first side first cutout portion 510 and the first side second cutout portion 512 may vary depending on the specific size of the elastomeric packer 104 and the size and number of metal inserts. An alternative visualization 500 of the first side first cutout portion 510 and a first side second cutout portion 512 is presented in FIG. 5B.

The first side first cutout portion 510 may be defined as a removed portion of the elastomeric packer 104 extending radially from the first side inner circumference 520 of the first side raised edge 522 to the packer central circumference 516. In one or more embodiments, the first side first cutout portion 510 includes removal of the entire elastomeric packer 104 material from the first side inner circumference 520 to the packer central circumference 516, in an annular shape to a first side first cutout portion depth 524. The first side first cutout portion depth 524 may advantageously be the same as a first insert first prong thickness 322 of the first insert first prong 310 (shown in FIG. 3B).

The first side second cutout portion 512 may be defined as a portion of the elastomeric packer 104 where additional material is removed from a portion (not shown) of elastomeric packer 104 material that remains after the first side first cutout portion 510 is removed to a second cutout portion depth 526. Upon removing the first side second cutout portion 512, a packer remaining portion 530 remains on the elastomeric packer 104. The shape of the packer remaining portion 530 is generally triangular and will be described in more detail in FIG. 5D below. The packer remaining portion 530 may have a packer remaining portion thickness 532 which may advantageously be the same as a first prong first protrusion base portion thickness 424 of the second insert first prong 410 (shown in FIG. 4B).

The packer remaining portion 530 may further include a first side third cutout portion 514. The first side third cutout portion 514 may be defined as a small portion of material removed from a remaining portion second edge 564 (shown in FIG. 5D). The first side third cutout portion 514 may extend through a remaining portion second edge 564 (shown in FIG. 5D) of the packer remaining portion thickness 532 and into the packer first insert portion 506. The first side third cutout portion 514 may have a size and shape which is advantageously configured to fit the second insert fifth curve 428 of the second metal insert 400.

In one or more embodiments, the first side first cutout portion 510 and the first side second cutout portion 512 may advantageously allow for the plurality of metal inserts to move radially inward within the elastomeric packer 104 when the isolation apparatus 101 is activated according to methods disclosed herein. Methods will be described in more detail in the following sections.

In one or more embodiments, when the first metal insert 300 is inserted into the packer first insert portion 506 of the elastomeric packer 104, the first insert first prong protrusion portion 316 of the first insert first prong 310 (shown in FIGS. 3A-E) may extend axially outward from the elastomeric packer 104 to a point axially uphole 366 of the first side raised edge 522. In one or more embodiments, the first insert first prong protrusion portion 316 of the first insert first prong 310 (shown in FIGS. 3A-E) may extend axially outward axially uphole 366 of the first side raised edge 522 in order to advantageously abut a portion of a wear plate 102 (shown in FIGS. 6A-E).

In one or more embodiments, when the second metal insert 400 is inserted into the packer second insert portion 508 of the elastomeric packer 104, the second insert first prong second protrusion portion 418 of the second insert first prong 410 (shown in FIGS. 4A-E) may extend axially outward from the elastomeric packer 104 to a point axially uphole 366 of the first side raised edge 522. In one or more embodiments, the second insert first prong second protrusion portion 418 of the second insert first prong 410 (shown in FIGS. 4A-E) may extend axially outward and axially uphole 366 of the first side raised edge 522 in order to advantageously abut a portion of a wear plate 102 (shown in FIGS. 6A-E).

Figure 5C:
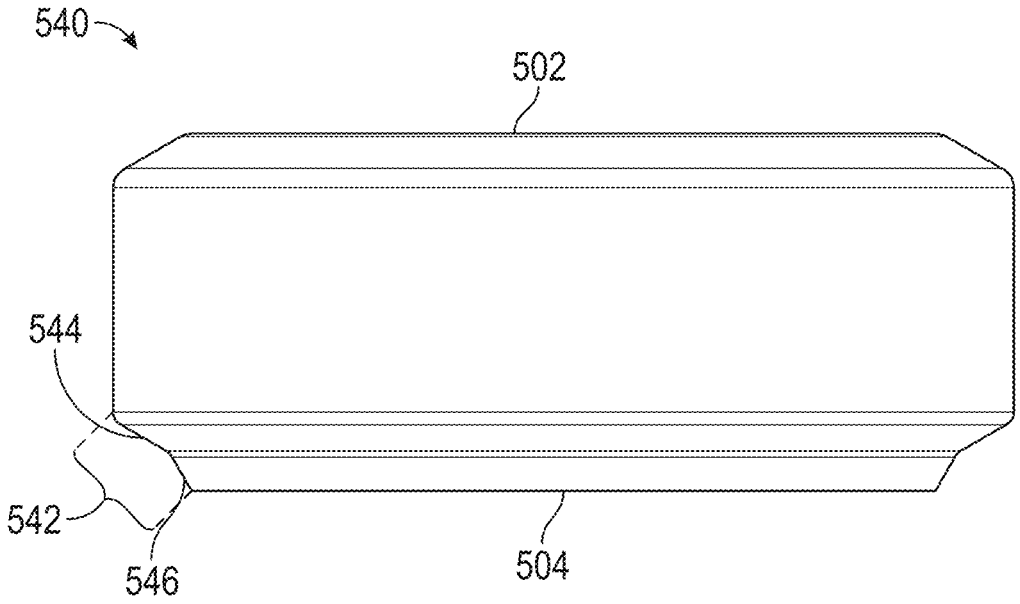
FIG. 5C shows a side view of an elastomeric packer according to one or more embodiments.

FIG. 5C shows a side view 540 of an elastomeric packer 104, including a packer first side 502 and a packer second side 504. In some embodiments, the packer first side 502 and the packer second side 504 are substantially flat when viewed from the side, as shown in FIG. 5C.

The packer second side 504 may have a sloped edge 542, where the sloped edge 542 further includes a sloped edge first slope 544 and a sloped edge second slope 546. The sloped edge first slope 544 and the sloped edge second slope 546 may be sloped at an angle of between 30° and 60°. In one or more embodiments, the sloped edge first slope 544 of the packer second side 504 may advantageously have a slope angle which is the same as the piston first sloped portion 204 of the piston sloped profile 152 of the piston 106 (shown in FIGS. 2A-B). Similarly, in one or more embodiments, the sloped edge second slope 546 of the elastomeric packer second side 504 may advantageously have a slope angle which is the same as the piston second sloped portion 206 of the piston sloped profile 152 of the piston 106 (shown in FIGS. 2A-B).

Furthermore, in one or more embodiments, the sloped edge first slope 544 of the elastomeric packer second side 504 may advantageously abut the piston first sloped portion 204 of the piston sloped profile 152 (shown in FIGS. 2A-B) when the isolation apparatus 101 is activated according to methods disclosed herein. Similarly, in one or more embodiments, the sloped edge second slope 546 of the elastomeric packer second side 504 may advantageously abut the piston second sloped portion 206 of the piston sloped profile 152 (shown in FIGS. 2A-B) when the isolation apparatus 101 is activated according to methods disclosed herein. Methods will be described in more detail in the following sections.

Figure 5D:
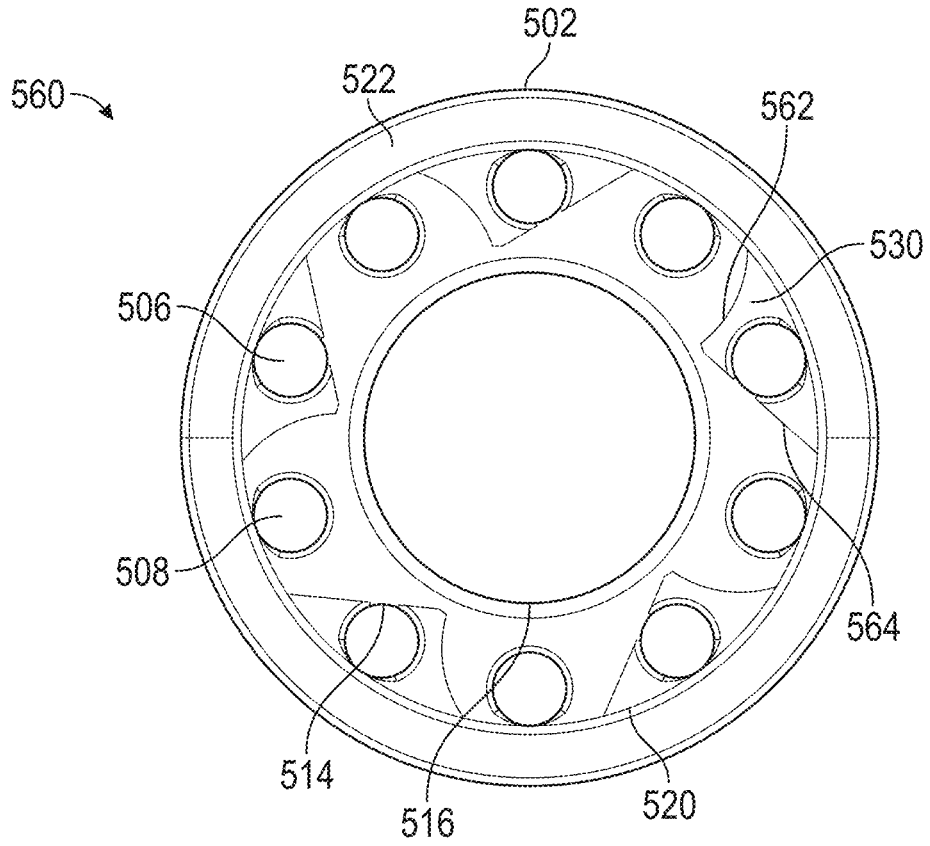
FIG. 5D shows a first side top down view of an elastomeric packer according to one or more embodiments.
Figure 5E:
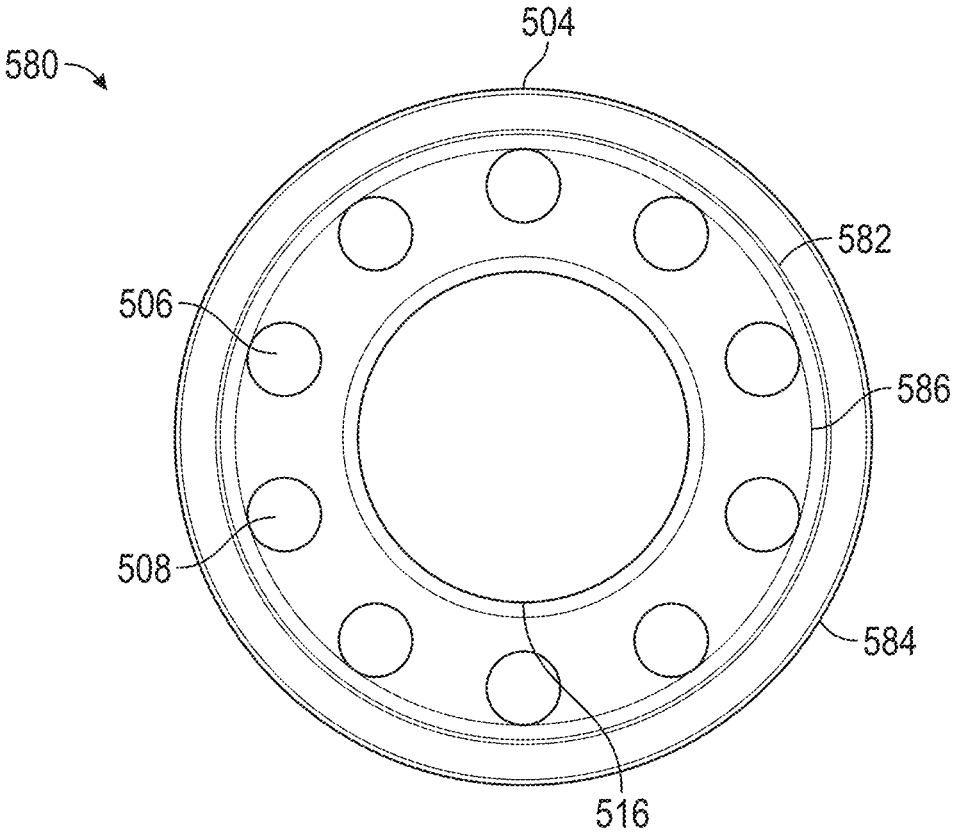
FIG. 5E shows a second side bottom up view of an elastomeric packer according to one or more embodiments.

FIGS. 5D and 5E show a first-side top down view 560 of the packer first side 502 and a second-side bottom up view 580 of the packer second side 504, respectively. The packer first insert portions 506 and packer second insert portions 508 can be seen spaced periodically around a circumference of the packer first side 502 and the packer second side 504. First side first cutout portions 510 and first side second cutout portions 512 may also be seen spaced periodically around a circumference of the packer first side 502. In one or more embodiments, the packer first insert portion 506 may be configured to fit a first metal insert 300 (shown in FIGS. 3A-3E) and the packer second insert portion 508 may be configured to fit a second metal insert 400 (shown in FIGS. 4A-4E).

As best shown in FIG. 5D, the shape of the packer remaining portion 530 is generally triangular when viewed from above. The shape of the packer remaining portion 530 is defined by a remaining portion first edge 562, a remaining portion second edge 564, and a third edge having an arc length equal to a small sector of the first side inner circumference 520. In one or more embodiments, the remaining portion first edge 562 may advantageously abut at least a portion of the second insert second curve 411 of the second insert first prong base portion 414 of the second metal insert 400 (shown in FIGS. 4A-F) when the isolation apparatus 101 is activated according to methods disclosed herein. In one or more embodiments, the remaining portion second edge 564 may advantageously abut the second insert fifth curve 428 of the second insert first prong base portion 414 of the second metal insert 400 (shown in FIGS. 4A-F) when the isolation apparatus 101 is activated according to methods disclosed herein.

As shown in FIG. 5E, the packer second side 504 has a second side outer circumference 584 and a second side inner circumference 586. The packer second side 504 may also include a second side raised edge 582 extending radially around a circumference of the packer second side 504. The second side raised edge 582 may have a height defined by a second side cutout portion 588, where material is removed through a portion of the body of the elastomeric packer 104 on the packer second side 504. The exact dimensions and shape of the second side cutout portion 588 may vary depending on the specific size of the elastomeric packer 104 and the size and number of metal inserts.

The second side cutout portion 588 may be defined as a removed portion of the elastomeric packer 104 extending radially from the second side inner circumference 586 of the second side raised edge 582 to the packer central circumference 516. In one or more embodiments, the second side cutout portion 588 includes removal of the entire elastomeric packer 104 material from the second side inner circumference 586 to the packer central circumference 516, in an annular shape to a second side cutout portion depth 590.

Figure 5F:
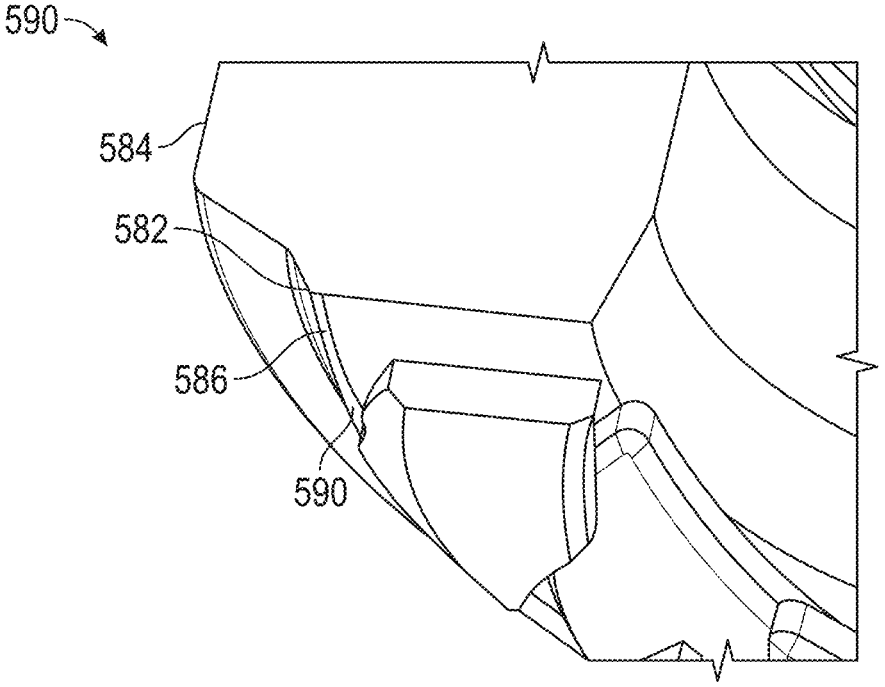
FIG. 5F shows a perspective view of a bottom portion of an elastomeric packer according to one or more embodiments.

FIG. 5F shows a perspective view of a portion of the packer second side 504. As described above, the packer second side has a second side outer circumference 584 and a second side inner circumference 586. The second side raised edge 582 can be seen proximate the second side inner circumference 586 in FIG. 5F. Additionally, the second side cutout portion depth 590 may be best visualized in FIG. 5F.

The elastomeric packer may be constructed of any suitable material known in the art. Examples of elastomeric packer material include but are not limited to elastomers including rubbers such as natural rubber, nitrile rubbers (nitrile butadiene rubber or nitrile rubber NBR, hydrogenated nitrile butadiene rubber HNBR, etc.) and the like.

Figure 6A:
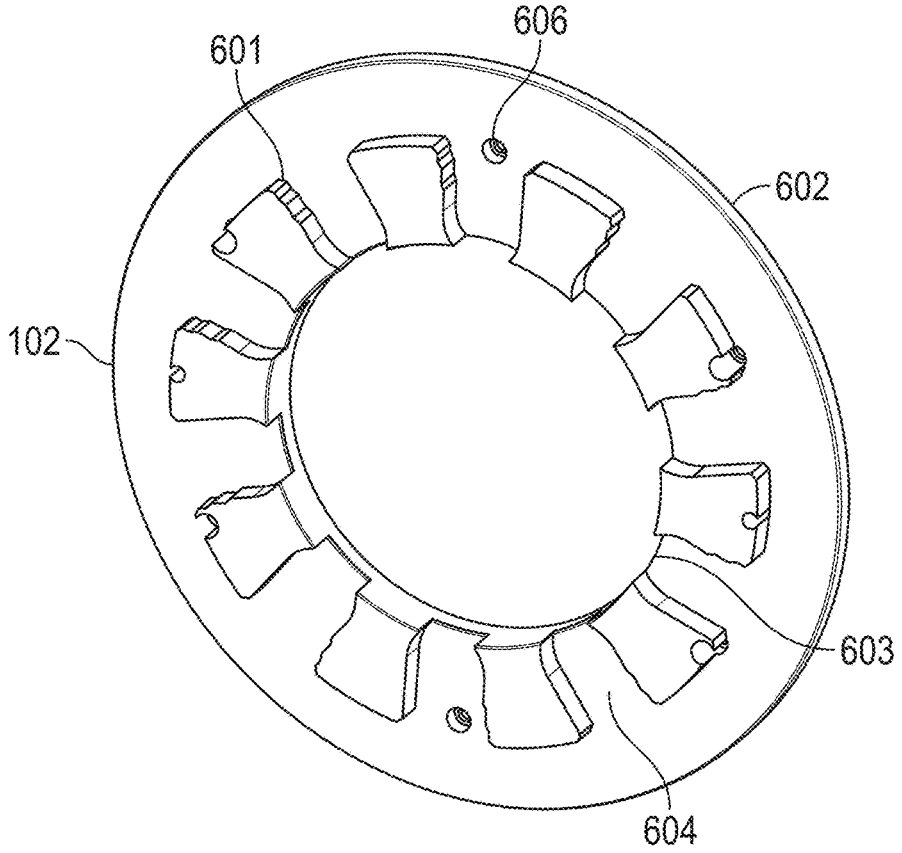
FIG. 6A shows a perspective view of a wear plate according to one or more embodiments.
Figure 6B:
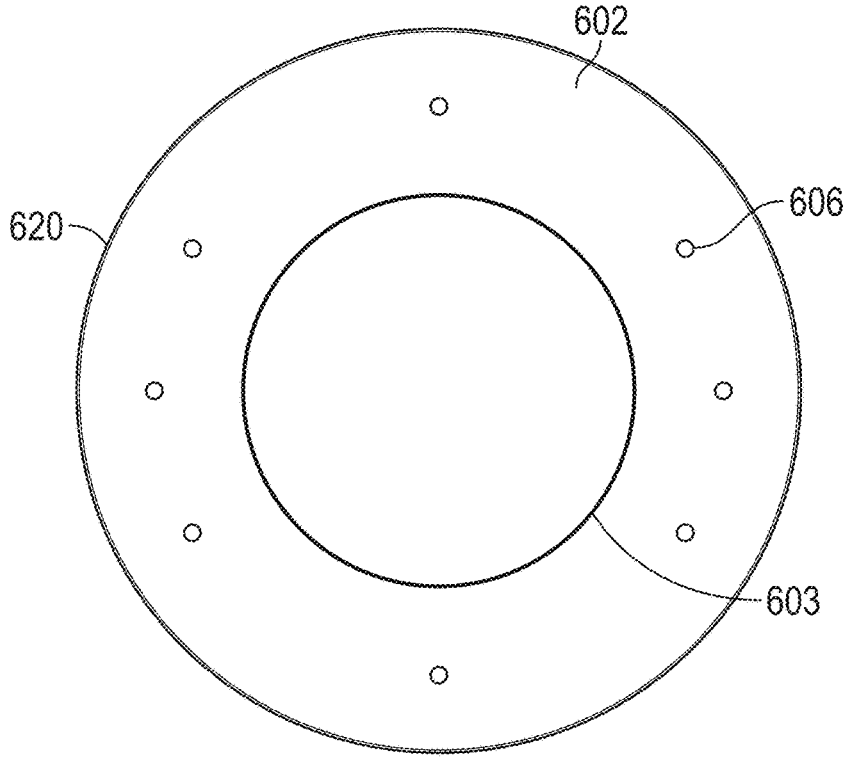
FIG. 6B shows a second side bottom up view of a wear plate according to one or more embodiments.

Returning to the figures, FIG. 6A shows a perspective view of a wear plate 102 according to one or more embodiments. The wear plate 102 includes a wear plate first side 601 and a wear plate second side 602, opposite the wear plate first side 601. The wear plate 102 may have a wear plate central circumference 603 defining a generally central, circular hole within the wear plate 102. The wear plate 102 may include a plurality of holes 606 configured to bolt the wear plate to one or more other components of the BOP system 100. The wear plate first side 601 may include a plurality of wear plate cutout portions 604. The wear plate cutout portions 604 may be sized to fit, radially align with, and guide one or more prongs on a first metal insert 300 and/or a second metal insert 400 according to embodiments disclosed herein. As shown in FIG. 6B, which is a wear plate second side top down view 620 of the wear plate second side 602, the wear plate second side 602 may be substantially flat.

Figure 6C:
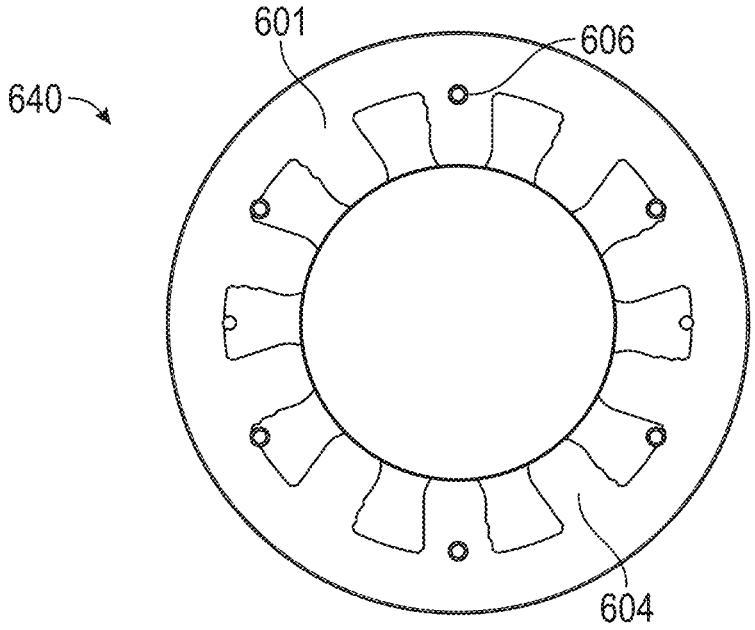
FIG. 6C shows a first side top down view of a wear plate according to one or more embodiments.
Figure 6D:
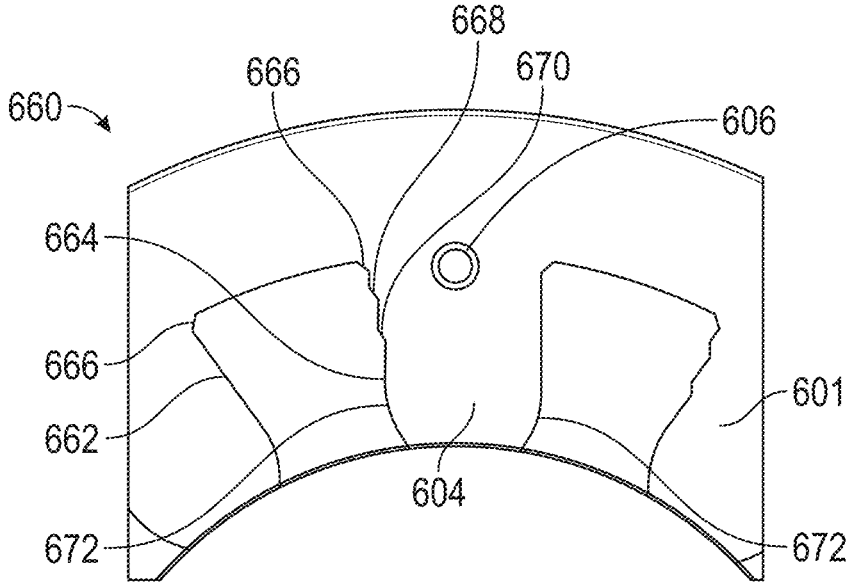
FIG. 6D a first side zoomed in view of a wear plate according to one or more embodiments.

FIG. 6C shows a wear plate first side bottom up view 640 of the wear plate first side 601. As described above, the wear plate first side 601 includes a plurality of wear plate cutout portions 604. As best shown in FIG. 6D, which is wear plate first side zoomed in view 660, the plurality of wear plate cutout portions 604 have a curved rectangular shape when viewed from above. The shape of the wear plate cutout portion 604 may be defined by cutout portion first side 662 and a cutout portion second side 664. The cutout portion first side 662 may consist of a substantially smooth curve. The cutout portion first side 662 may include a lead-in chamfer 666 configured to advantageously abut and guide the first insert first prong protrusion portion 316 (shown in FIGS. 3A-E) and/or the second insert first prong second protrusion portion 418 (shown in FIGS. 4A-E) into the wear plate cutout portion 604 when the isolation apparatus 101 is activated according to methods disclosed herein.

Keeping with FIG. 6D, the cutout portion second side 664 may consist of a stepped curve shape. The stepped curve shape of the cutout portion second side 664 may include one or more of a lead-in chamfer 666, a second side first step 668 and a second side second step 670. The second side lead-in chamfer 666 may advantageously abut and guide the first insert first prong protrusion portion 316 (shown in FIGS. 3A-E) and/or the second insert first prong second protrusion portion 418 (shown in FIGS. 4A-E) into the wear plate cutout portion 604 when the isolation apparatus 101 is activated according to methods disclosed herein. Additionally, the second side first step 668 and the second side second step 670 may advantageously abut and guide the first insert tooth 344 on the first metal insert 300 (shown in FIGS. 3A-E) and/or the second insert tooth 472 on the second metal insert 400 (shown in FIGS. 4A-E) when the isolation apparatus 101 is activated according to methods disclosed herein.

The cutout portion first side 662 and the cutout portion second side 664 may also include a cutout portion curve 672 on a radially opposite side from the lead-in chamfer 666. The cutout portion curve 672 may have an arc length configured to advantageously prevent the first metal insert 300 and/or the second metal insert 400 from further radial movement towards the wear plate central circumference 603. Specifically, the cutout portion curve 672 may provide a "hard stop" for the first insert first prong protrusion portion 316 (shown in FIGS. 3A-E) and/or the second insert first prong second protrusion portion 418 (shown in FIGS. 4A-E) into the wear plate cutout portion 604 when the isolation apparatus 101 is activated according to methods disclosed herein.

Figure 6E:
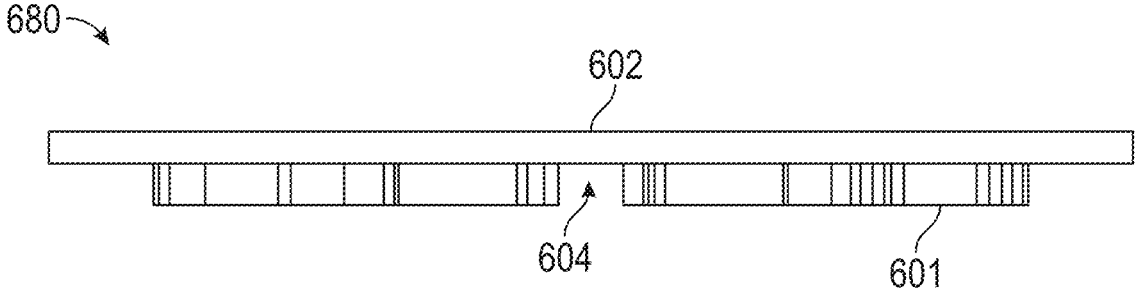
FIG. 6E shows a side view of a wear plate according to one or more embodiments.

FIG. 6E shows a wear plate side view 680 of the wear plate 102 according to one or more embodiments, where the wear plate first side 601 is opposite the wear plate second side 602. The wear plate first side 601 includes a plurality of wear plate cutout portions 604 extending axially through a portion of the wear plate 102.

Figure 7A:
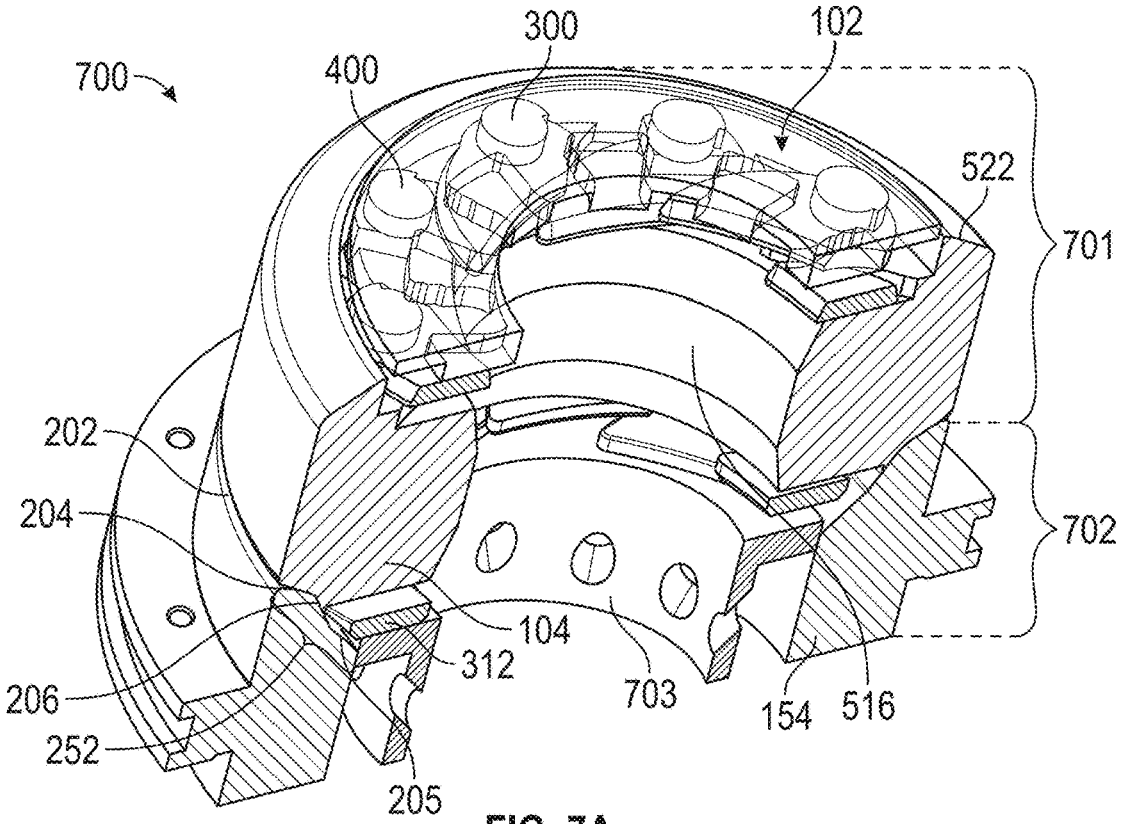
FIG. 7A shows a perspective cutaway view of an apparatus for isolating wellbore fluids according to one or more embodiments.

FIG. 7A shows a perspective cutaway view of an example apparatus 700 for isolating wellbore fluids according to one or more embodiments. In the apparatus 700, a packing unit 701 may be axially stacked uphole of a piston (such as the piston 106 described in FIGS. 2A-B). The packing unit 701 may include an elastomeric packer 104 having a plurality of packer insert portions and packer cutout portions (not shown). A plurality of metal inserts may be inserted into the insert portion, for example, a first metal insert 300 and a second metal insert 400. The first metal insert 300 and the second metal insert 400 may be coupled to the elastomeric packer 104 as part of the packing unit 701.

In some embodiments, the first metal insert 300 and the second metal insert 400 are arranged in an alternating pattern in the elastomeric packer 104. While the first metal insert 300 and the second metal insert 400 are shown in an alternating pattern, the arrangement depicted in FIG. 7A is merely an example and is not intended to be limiting. As would be understood by one of ordinary skill in the art, the metal insert type and arrangement may vary depending on the specific design of the system, wellbore conditions, and the like. For simplicity, only a cutaway view of an upper piston portion 702 (e.g., an upper portion of the piston first tubular body 154 of the piston 106 shown in FIG. 2A) is depicted in FIG. 7A.

As shown in FIG. 7A, a first body first end 202 of the upper piston portion 702 may be proximate the packing unit 701. The first body first end 202 of the upper piston portion 702 may include a piston sloped profile 152, including a piston first sloped portion 204 and a piston second sloped portion 206. In one or more embodiments, the sloped edge first slope 544 of the packer second side 504 may advantageously have a slope angle which is the same as the piston first sloped portion 204 of the piston sloped profile 152. Similarly, in one or more embodiments, the sloped edge second slope 546 of the elastomeric packer second side 504 may advantageously have a slope angle which is the same as the piston second sloped portion 206 of the piston sloped profile 152.

The apparatus 700 may also include a wear plate 102 and a sleeve portion 703. As shown in FIG. 7A, the wear plate 102 may be located on an uphole side of the apparatus 700, axially stacked on the packing unit 701. The wear plate 102 may be positioned within a region of the packing unit extending from the first side raised edge 522 to the packer central circumference 516. As described in FIGS. 6A-E, the wear plate 102 may include a plurality of wear plate cutout portions 604, which may be sized to fit, radially align with, and guide one or more portions on a first metal insert 300 or a second metal insert 400 according to embodiments disclosed herein.

In one or more embodiments, the apparatus 700 may also include a sleeve portion 703. The sleeve portion 703 may be located on a downhole side of the apparatus 700, proximate the piston first tubular body 154 of the upper piston portion 702. In one or more embodiments, the sleeve portion 703 may contact a downhole side of the packing unit 701. The inclusion of a wear plate 102 and/or a sleeve portion 703 in apparatus 700 may advantageously prevent tipping of the first metal insert 300 and the second metal insert 400 during activation of the apparatus 700.

"Tipping" is defined herein as a lateral movement of one or more metal inserts within the isolation apparatus 101 disclosed herein. Specifically, tipping refers an angular deviation of a central longitudinal axis of the elongated portion of the metal inserts disclosed herein from the main the central longitudinal axis of the isolation apparatus 101, specifically during activation of the apparatus. Embodiments disclosed herein may advantageously reduce or eliminate tipping of the one or more metal inserts using systems and methods according to one or more embodiments.

Figure 7B:
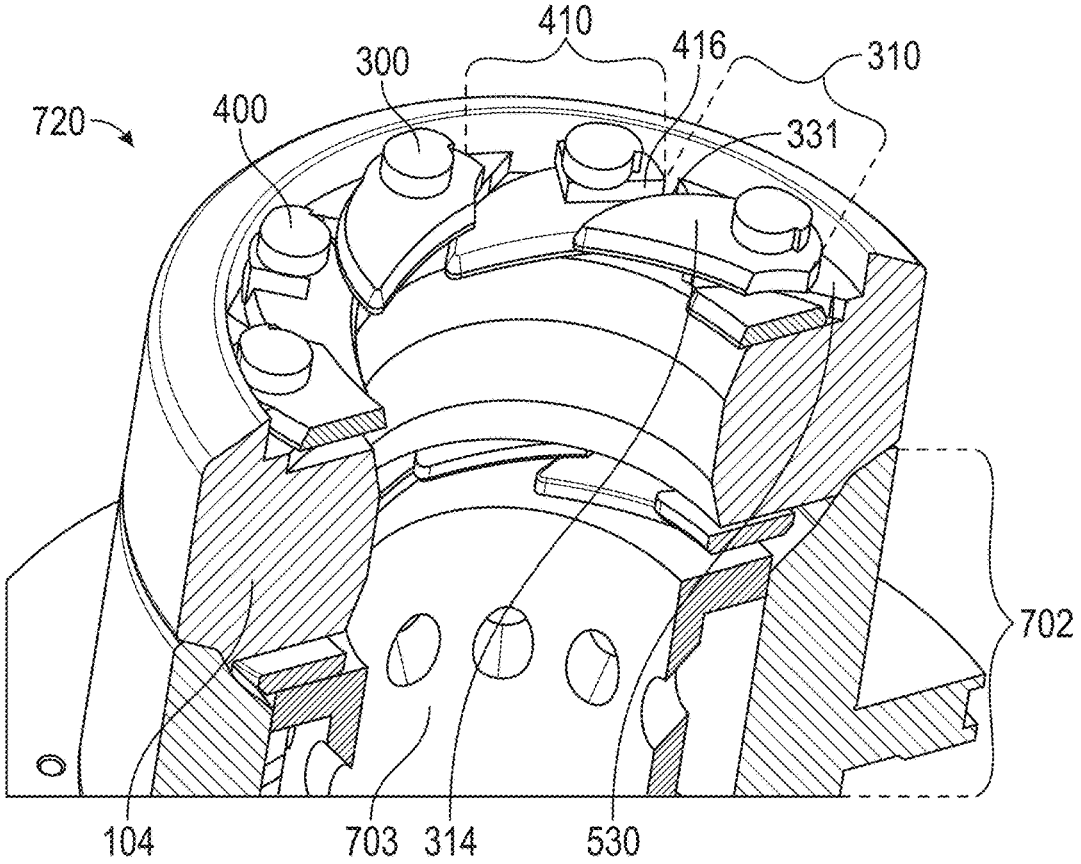
FIG. 7B shows a cutaway view of an apparatus for isolating wellbore fluids according to one or more embodiments.

FIG. 7B shows an apparatus cutaway view 720. In FIG. 7B, the apparatus 700 is shown without a wear plate 102. The first insert first prong 310 may be axially stacked on the packer remaining portion 530 such that the first insert first prong 310 is located at an uphole position compared to the second insert first prong 410. The second insert first prong first protrusion portion 416 on the second insert first prong 410 may consequently be at the same height within the apparatus 700 as the first insert first prong base portion 314 of the first insert first prong 310. Accordingly, the second insert first prong first protrusion portion 416 may advantageously abut and guide the first insert sixth curve 331 of the first insert first prong base portion 314 of the first insert first prong 310 during activation of the apparatus 700.

Figure 7C:
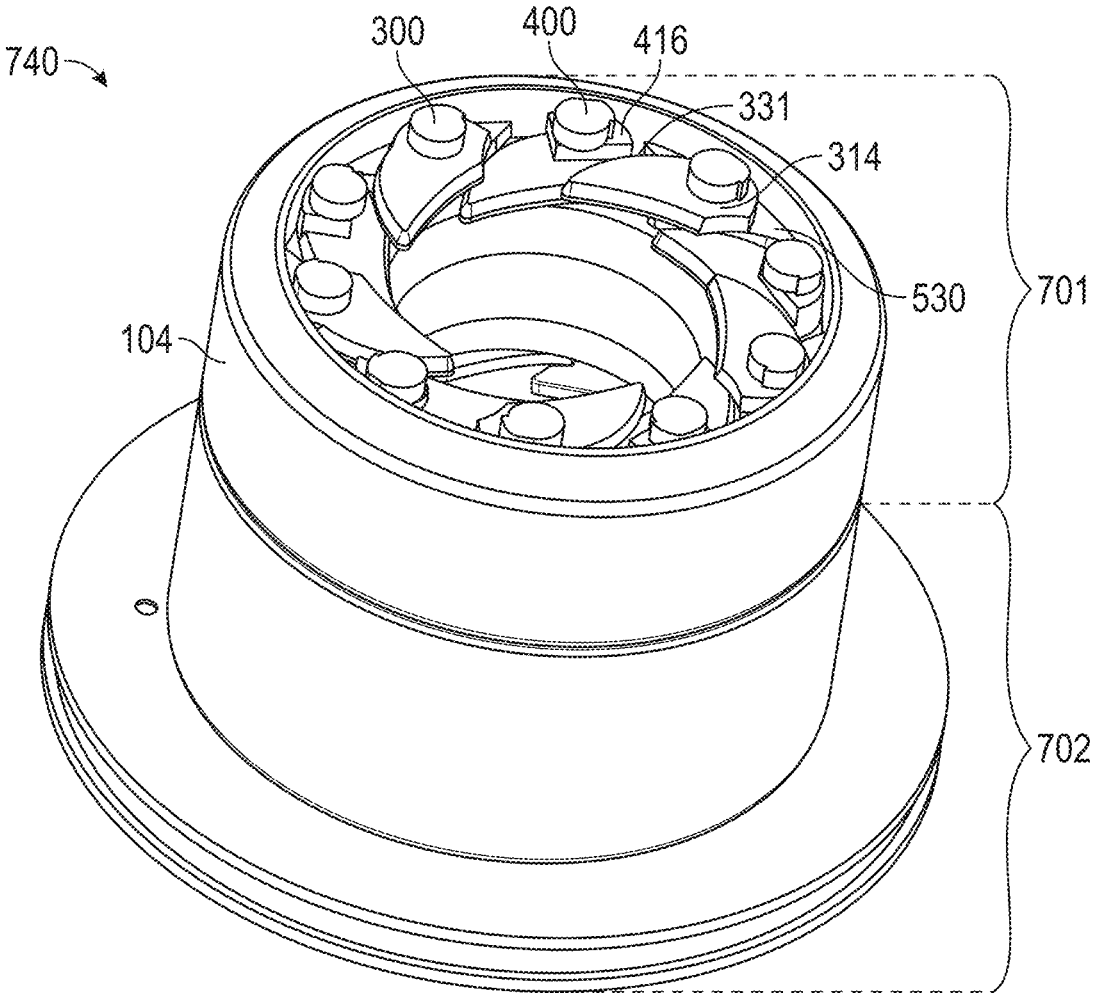
FIG. 7C shows a full apparatus perspective view of an apparatus for isolating wellbore fluids according to one or more embodiments.

FIG. 7C shows a full apparatus perspective view 740 according to one or more embodiments. FIG. 7C further illustrates the components discussed in FIGS. 7A-B.

In some embodiments, the apparatus 700 may reach an extrusion gap having a size of less than approximately 4 inches. For example, the apparatus may reach an extrusion gap having a size of approximately less than 4 inches, less than 3 inches, less than 2 inches, less than 1 inch, less than 0.1 inches, or approximately 0 inches. In some embodiments, the isolation apparatus 101 may advantageously reach an extrusion gap having a size of approximately 0 inches upon sealing. For example, the apparatus may reach an extrusion gap having a size of approximately 0.1 inches, approximately 0.01 inches, approximately 0.001 inches, or approximately 0 inches. The extrusion gap size may depend on a variety of factors specific to the BOP system 100, including but not limited to a mandrel size, and whether the apparatus seals around the mandrel or around itself.

Embodiments disclosed herein also relate to methods for operating a blowout prevention (BOP) system to isolate wellbore fluids. In one or more embodiments, methods include providing the BOP system 100 to a wellhead, applying a pressure to the isolation apparatus 101 in a series of stages, sealing a central circumference of the apparatus when a closing pressure is applied, and unsealing the central circumference of the apparatus when an opening pressure is applied.

In one or more embodiments, the method for operating a BOP system 100 to isolate wellbore fluids includes providing the BOP system 100 to a wellhead. The BOP system 100 used in methods disclosed herein may include any of the components described in the above sections. For example, the BOP system 100 may include an apparatus for isolating wellbore fluids, where the apparatus includes a packing unit, having a plurality of metal inserts, including one or more of a first metal insert and one or more of a second metal insert, disposed in an elastomeric packer, and a piston located downhole of and proximate to the packing unit. The BOP system 100 may also include a BOP housing radially surrounding the apparatus, where the piston and the packing unit are axially stacked within the BOP housing.

In one or more embodiments, the method for operating a BOP system 100 to isolate wellbore fluids further includes applying a pressure to the apparatus in a series of stages. The applied pressure may include an opening pressure and a closing pressure, where the opening pressure moves the piston in a downhole direction and the closing pressure moves the piston in an uphole direction. The phrase "series of stages" as used herein refers to arbitrary units of closing or opening pressure applied to the apparatus. The phrase "series of stages" does not specifically refer to a concrete number of stages; the phrase is used only to help illustrate movement of components within the apparatus when a closing or opening pressure is applied to the apparatus and is in no way intended to be limiting. The series of stages will be described in more detail in the sections below.

In one or more embodiments, the method for operating a BOP system 100 to isolate wellbore fluids further includes sealing a central circumference of the apparatus when the closing pressure is applied by compressing the packing unit with the piston when the piston is moved uphole, wherein upon compressing, the packing unit moves the plurality of metal inserts radially inward to form a seal. In one or more embodiments, the method for operating a BOP system 100 to isolate wellbore fluids further includes unsealing the central circumference of the apparatus when the opening pressure is applied by decompressing the packing unit when the piston is moved downhole, where upon decompressing, the packing unit moves the plurality of metal inserts radially outward to release the seal. In one or more embodiments, upon sealing the central circumference of the apparatus when the closing pressure is applied to form the seal around the apparatus itself, an extrusion gap within the apparatus has a size of less than approximately four inches. In one or more embodiments, the BOP system further includes a mandrel extending through a central circumference of the packing unit and the piston, and, upon sealing the central circumference of the apparatus when the closing pressure is applied to form the seal, the seal is formed around the mandrel and an extrusion gas within the apparatus has a size of approximately zero.

A description of a first method disclosed herein will now be made in reference to FIGS. 8A-F. FIGS. 8A-F show how the isolation apparatus 101 in a wellbore is operated to provide a seal around a mandrel after applying a closing pressure to the apparatus in a series of stages. While the apparatus shown in FIG. 7A is used to illustrate the method, other systems and components as disclosed herein may be substituted in the method without departing from the present disclosure.

Figure 8B:
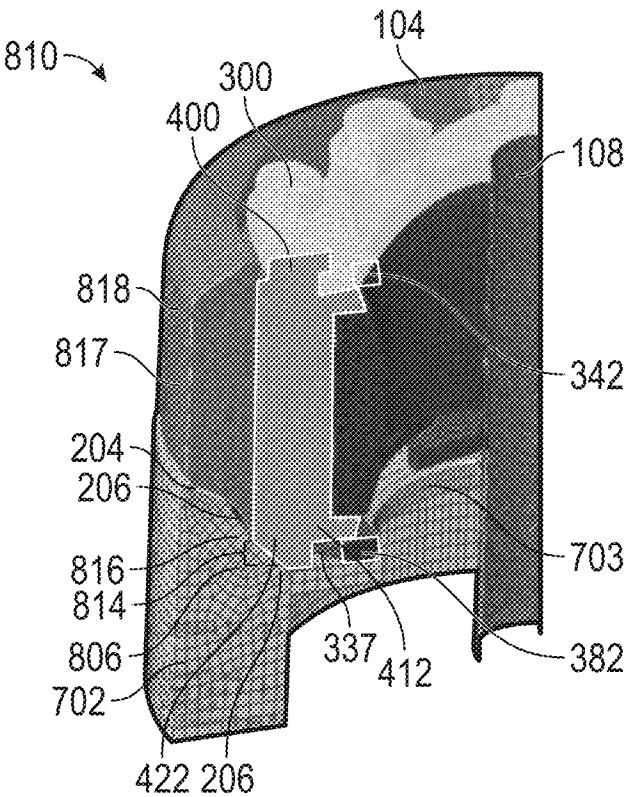
FIGS. 8B-E illustrate different stages of applying a closing pressure to an apparatus for isolating wellbore fluids according a first method of one or more embodiments.
Figure 8A:
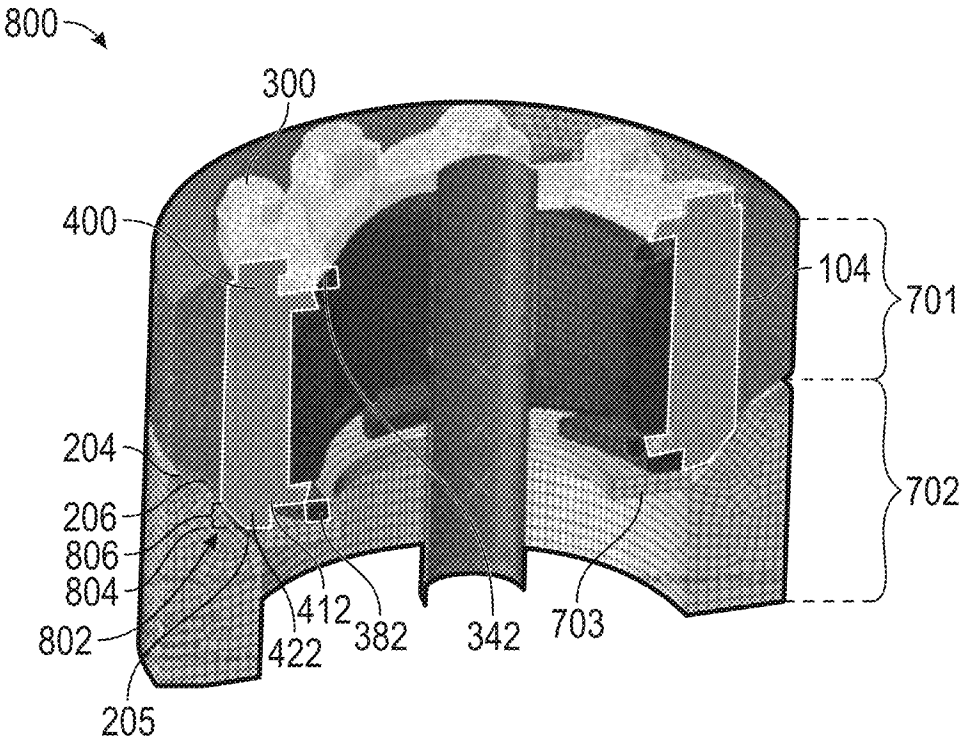
FIG. 8A is a first method initial position of an apparatus for isolating wellbore fluids prior to implementing a method for compressing a packing unit around a mandrel according to one or more embodiments.

FIG. 8A shows a first method initial position 800 of the isolation apparatus 101 in a wellbore. The elements in FIG. 8A correspond to those shown and described in FIGS. 7A-C. For example, a packing unit 701 is shown axially stacked at an uphole position from an upper piston portion 702. The packing unit 701 and the upper piston portion 702 each include a generally central hole such that, when stacked, an inner flow path is formed axially throughout. A mandrel 108 is shown inserted into said inner flow path.

In FIG. 8A, a second metal insert 400 is inserted into a packer second insert portion 508 (shown in FIG. 5) of an elastomeric packer 104 as part of the packing unit 701. Similarly, a first metal insert 300 is inserted into a packer first insert portion 506 (shown in FIG. 5). A plurality of first metal inserts 300 and a plurality of second metal inserts 400 may be placed around a circumference of the elastomeric packer 104 as part of the packing unit 701. A sleeve portion 703 is shown axially stacked at a downhole location from the plurality of first metal inserts 300 and the plurality of second metal inserts 400. A wear plate 102 (not shown in FIGS. 8A-F) may be axially stacked uphole of the packing unit 701. The wear plate 102 is not shown in FIGS. 8A-F for the sake of simplicity, however wear plate cutout portions 604 located on the wear plate first side 601 may help guide the plurality of first metal inserts 300 and the plurality of second metal inserts 400 and prevent tipping during operation of the isolation apparatus 101 in a wellbore.

As shown in FIG. 8A, the first metal insert 300 includes a first insert first prong tip side 342 on the first insert first prong 310 and a first insert second prong tip side 382 on the first insert second prong 312. As pressure is applied to the upper piston portion 702, the first insert first prong tip side 342 on the first insert first prong 310 and the first insert second prong tip side 382 on the first insert second prong 312 may rotate radially inward toward the mandrel 108, as will be demonstrated in the following figures. Although not shown in the method of FIGS. 8A-F, the second insert first prong tip side 442 on the second insert first prong 410 and a second insert second prong tip side 482 on the second insert second prong 412 may also rotate radially inward toward the mandrel 108 when pressure is applied to the upper piston portion 702.

The second metal insert 400 includes a second insert second prong 412 having a second insert second prong protrusion portion 422. The upper piston portion 702 includes a piston first sloped portion 204, a piston second sloped portion 206, and a piston third sloped portion 205. As shown in FIG. 8A, the upper piston portion 702 is located at a first method initial position 802 and will move axially uphole a first method first distance 804 to a first method first position 806. Although not shown in FIG. 8A, note that, when the piston is in the first method initial position 802, no pressure is applied to the piston and a piston second tubular body (156 in FIG. 2A) having a second body notched portion (158 in FIG. 2B) abuts a BOP housing shoulder (160 in FIG. 1B).

When a first applied pressure is applied to the system in the first method initial position 800 shown in FIG. 8A, a first stroke causes the upper piston portion 702 to move the first method first distance 804 to a first method first position 806, and the system moves to the first method first position 810, shown in FIG. 8B. In moving from FIG. 8A to FIG. 8B, a first stroke as a part of the series of stages of applied closing pressure has occurred. During the first stroke, upper piston portion 702 moves the first method first distance 804 and the piston third sloped portion 205 of the piston sloped profile 152 contacts the second insert second prong protrusion portion 422 on the second insert second prong 412.

Movement of the upper piston portion 702 responsive to the first stroke also causes the piston first sloped portion 204 and the piston second sloped portion 206 to contact a first method first packer portion 817 and compresses the elastomeric packer 104 in a first method first packer compression 818, as shown in FIG. 8B.

Figure 8D:
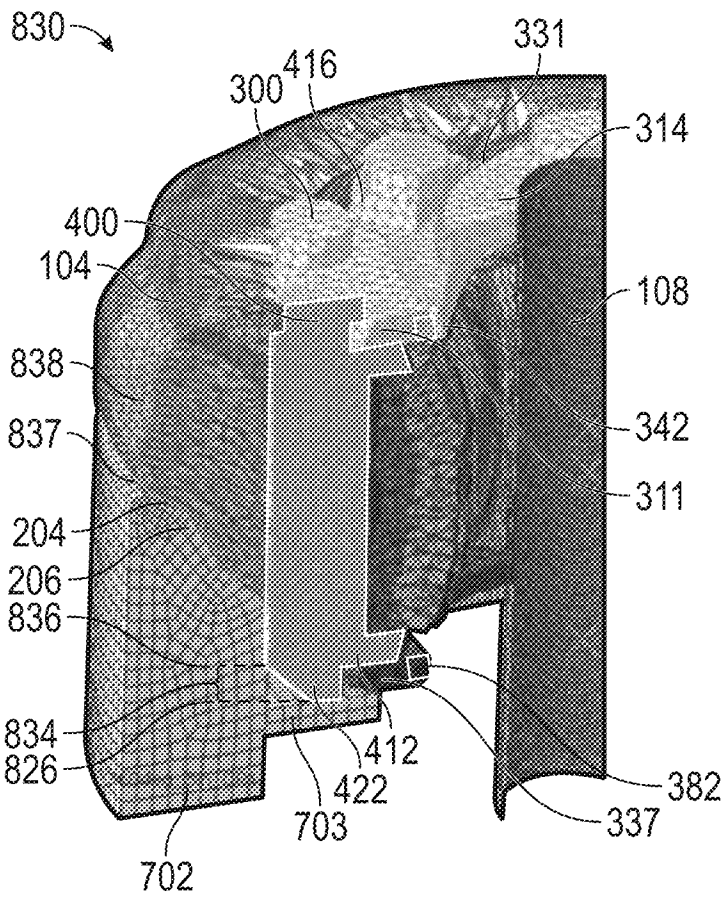
Figure 8C:
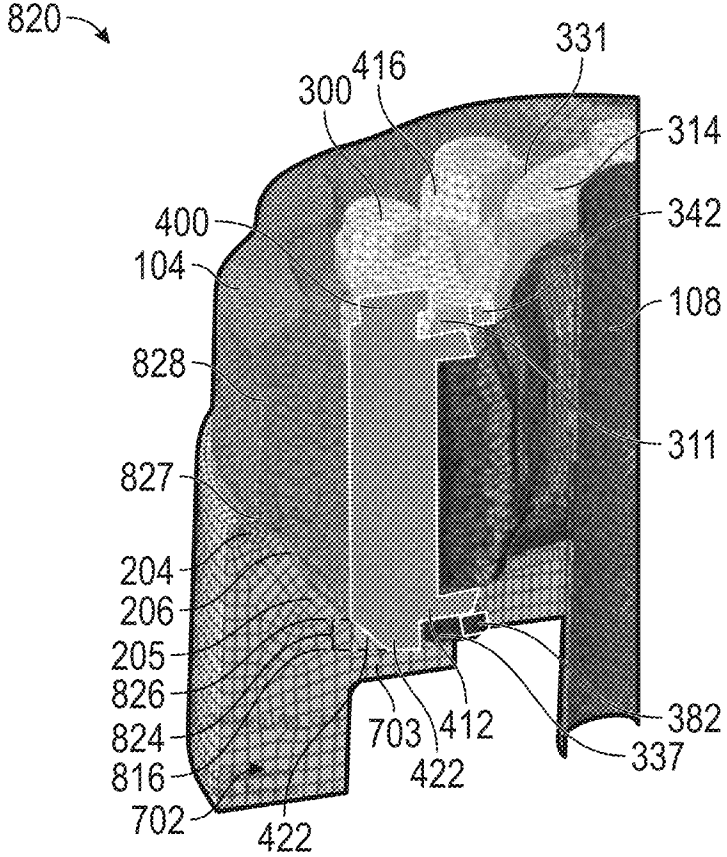

When a second applied pressure is applied to the system in the first method first position 810 shown in FIG. 8B, a second stroke causes the upper piston portion 702 to move a first method second distance 814 to a second position 816 and the system moves to the first method second position 820, shown in FIG. 8C. In moving from FIG. 8B to FIG. 8C, a second stroke as a part of the series of stages of applied closing pressure has occurred. During the second stroke, upper piston portion 702 moves the first method second distance 814 and the piston third sloped portion 205 of the piston sloped profile 152 further contacts the second insert second prong protrusion portion 422 on the second insert second prong 412.

The first insert first prong tip side 342 on the first insert first prong 310 and the first insert second prong tip side 382 on the first insert second prong 312 begin to rotate radially inward toward the mandrel 108 in a first method first insert first rotation. Further, the second metal insert 400 rotates radially inward in a first method second insert first rotation.

Radial rotation of the first metal insert 300 and the second metal insert 400 is guided by the features of the wear plate 102 (as shown in FIGS. 6A-6E). An amount of clearance is provided between the first insert second curve 311 of the first insert first prong 310 and the second insert first prong first protrusion portion 416 on the second insert first prong 410, such that the first insert first prong 310 mandrel advantageously does not contact the second insert first prong.

Movement of the upper piston portion 702 responsive to the second stroke also causes the piston first sloped portion 204 and the piston second sloped portion 206 to contact a first method second packer portion 827 and compresses the elastomeric packer 104 in a first method second packer compression 828, as shown in FIG. 8C.

When a third applied pressure is applied to the system in the first method second position 820 shown in FIG. 8C, a third stroke causes the upper piston portion 702 to move a first method third distance 824 to a first method third position 826 and the system moves to the first method third position 830, shown in FIG. 8D. In moving from FIG. 8C to FIG. 8D, a third stroke as a part of the series of stages of applied closing pressure has occurred. During the third stroke, upper piston portion 702 moves the first method third distance 824 and the piston first sloped portion 204, the piston second sloped portion 206, and the piston third sloped portion 205 contact a third packer portion 837, compressing the elastomeric packer 104 in a first method third packer compression 838, as shown in FIG. 8D.

During the third stroke, the first insert first prong tip side 342 on the first insert first prong 310 and the first insert second prong tip side 382 on the first insert second prong 312 further rotate radially inward toward the mandrel 108 . . . mandrel Further, the second metal insert 400 rotates radially inward in a first method second insert second rotation.

Figure 8F:
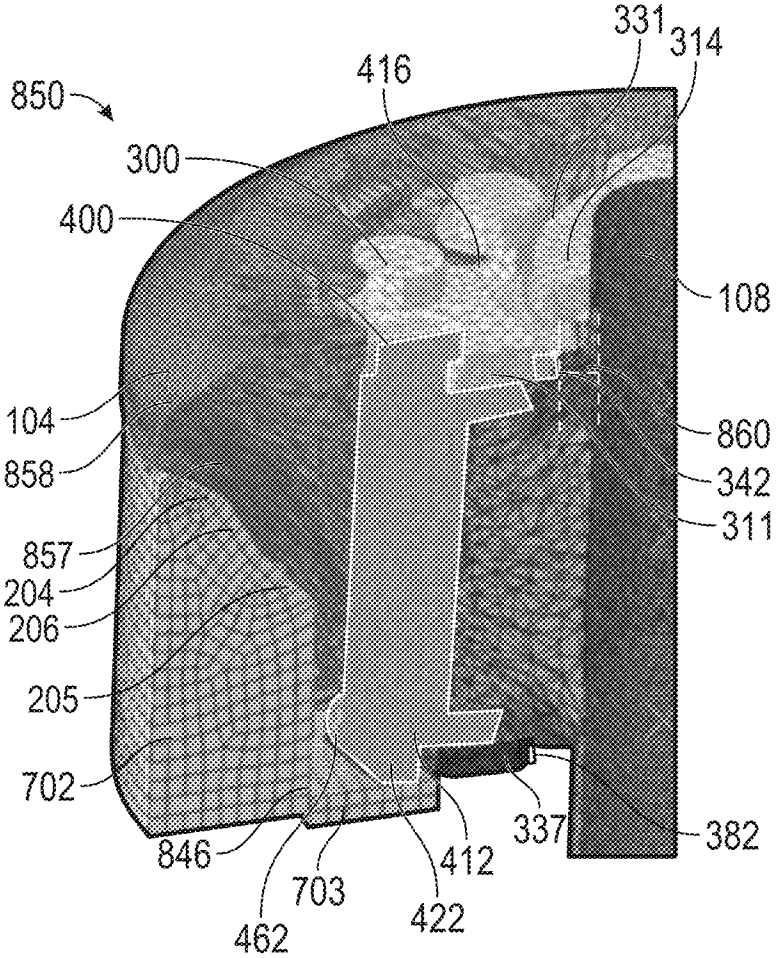
FIG. 8F is a first method final position of an apparatus for isolating wellbore fluids prior to implementing a first method for compressing a packing unit around a mandrel according to one or more embodiments.
Figure 8E:
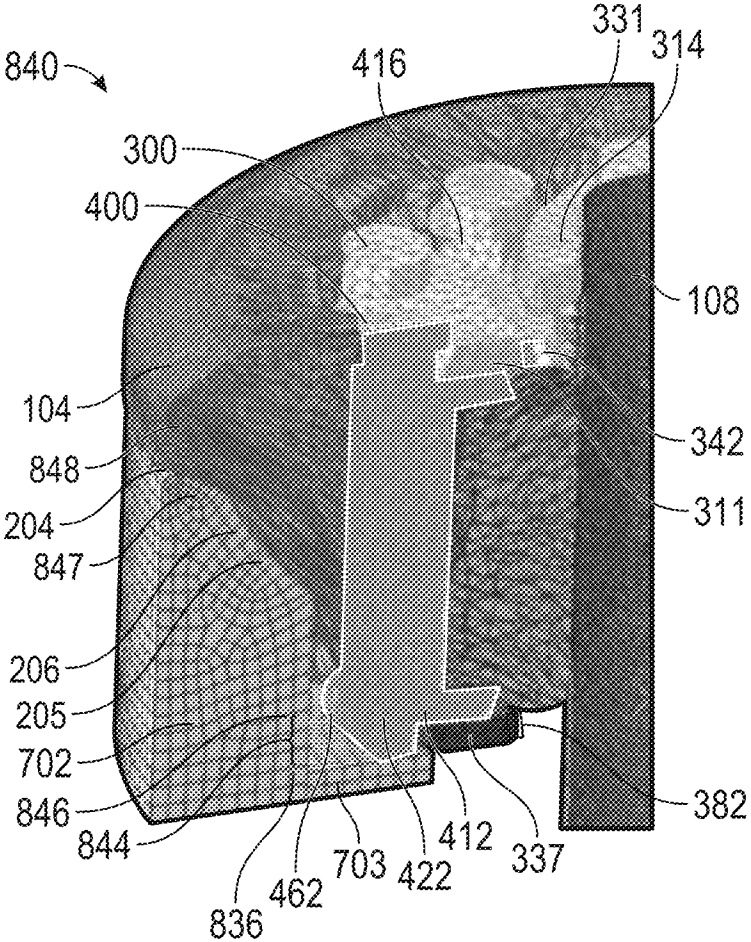

When a fourth applied pressure is applied to the system in the first method third position 830 shown in FIG. 8D, a fourth stroke causes the upper piston portion 702 to move a first method fourth distance 834 to an apparatus fourth position 836 and the system moves to the first method fourth position 840, shown in FIG. 8E. In moving from FIG. 8D to FIG. 8E, a fourth stroke as a part of the series of stages of applied closing pressure has occurred. During the fourth stroke, upper piston portion 702 moves the first method fourth distance 834 and the piston first sloped portion 204, the piston second sloped portion 206, and the piston third sloped portion 205 contact a fourth packer portion 847, compressing the elastomeric packer 104 in a first method fourth packer compression 848, as shown in FIG. 8E.

During the fourth stroke, the first insert first prong tip side 342 on the first insert first prong 310 and the first insert second prong tip side 382 on the first insert second prong 312 further rotate radially inward toward the mandrel 108 in a first method first insert third rotation. Furthermore, the second metal insert 400 further rotates radially inward toward the mandrel 108 in a first method second insert third rotation.

Finally, when a fifth applied pressure is applied to the system in the first method fourth position 840 shown in FIG. 8E, a fifth stroke causes the upper piston portion 702 to move a first method fifth distance 844 to a first method fifth position 846 and the system moves to the first method final position 850, shown in FIG. 8F. In moving from FIG. 8E to FIG. 8F, a fifth stroke as a part of the series of stages of applied closing pressure has occurred. During the fifth stroke, upper piston portion 702 moves the first method fifth distance 844 and the piston first sloped portion 204, the piston second sloped portion 206, and the piston third sloped portion 205 contact a fifth packer portion 857, compressing the elastomeric packer 104 in a first method fifth packer compression 858, as shown in FIG. 8F.

During the fifth stroke, the first insert first prong tip side 342 on the first insert first prong 310 and the first insert second prong tip side 382 on the first insert second prong 312 further rotate radially inward toward the mandrel 108 causing a first method first insert fourth rotation. Furthermore, the second metal insert 400 further rotates radially inward toward the mandrel 108 in a first method second insert fourth rotation.

FIG. 8F shows the system in a first method final position 850. In FIG. 8F, upper piston portion 702 has moved from first method initial position 802 shown in FIG. 8A to the first method fifth position (or final position) 846. When in the first method fifth position 846, the first metal insert 300, the second metal insert 400, and the first method compressed elastomeric packer 852 provide a seal around mandrel 108 by moving radially inward to close a central circumference of the isolation apparatus 101 when the closing pressure is applied. Upon sealing the central circumference of the apparatus when the closing pressure is applied to form the seal, an extrusion gap 860 within the apparatus has a size of less than approximately four inches, as described above. In one or more embodiments, upon sealing around a mandrel 108 using the first method depicted in FIGS. 8A-8F, an extrusion gap 860 within the apparatus has a size of approximately zero. For example, the extrusion gap may have a size of approximately 0.1 inches, 0.01 inches, 0.001 inches, 0.0001 inches, or 0 inches.

As would be understood by one of ordinary skill in the art, though not explicitly shown, the methods and procedures described in the above sections may be reversed. For example, moving from FIG. 8F to FIG. 8A illustrates a first method for decompressing a packing unit according to one or more embodiments. Decompressing the packing unit may occur when an opening pressure is applied to the apparatus for isolating wellbore fluids, whereby the central circumference of the apparatus is unsealed when the piston is moved downhole. Upon decompressing, the packing unit moves the plurality of metal inserts radially outward to release the seal.

FIGS. 9A-G further illustrate movement of the first metal insert 300 and the second metal insert 400 when a closing pressure is applied to the isolation apparatus 101 in a wellbore (700 as shown in FIG. 7A) is operated to provide a seal around a mandrel after applying a closing pressure to the apparatus in a series of stages. While the images presented in FIGS. 9A-G also show movement of the first metal insert 300 and the second metal insert 400 in a series of stages during closing of the apparatus, it is noted herein that the views shown in FIGS. 9A-G do not directly correspond with the images presented in FIGS. 8A-F. In other words, as will be described below, movement of the apparatus from a first method first top-down view 900 shown in FIG. 9A to a first method second top-down view 910 does not directly correspond to the first method initial position 800 shown in FIG. 8A to the first method first position 810 shown in FIG. 8B.

Figure 9B:
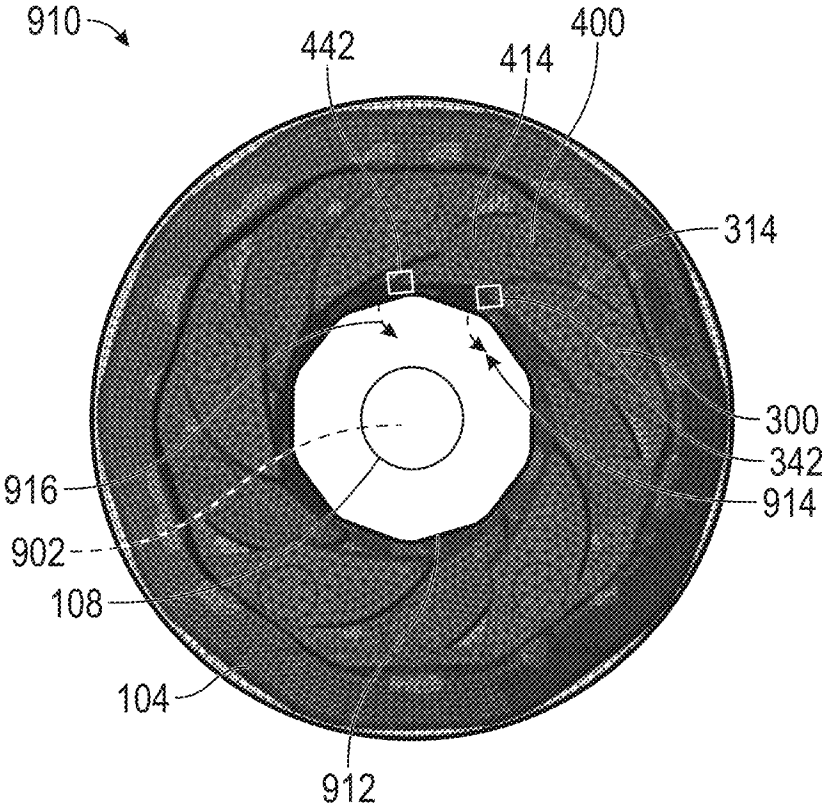
FIGS. 9B-F illustrate different top down views during applying a closing pressure to an apparatus for isolating wellbore fluids according a first method of one or more embodiments.
Figure 9A:
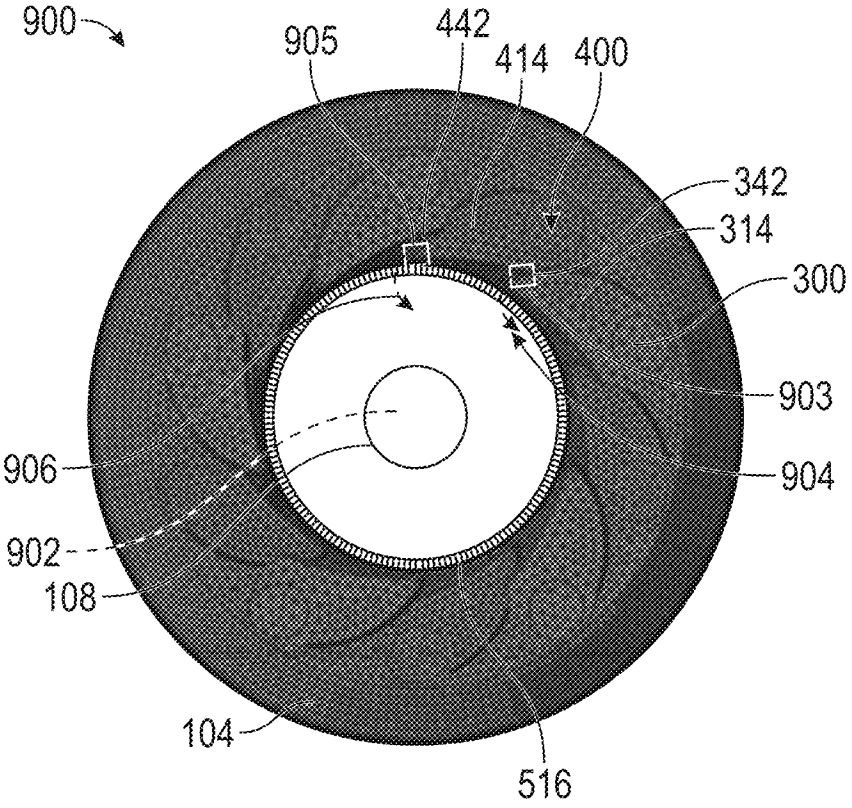
FIG. 9A is a first method top down view of an initial position of an apparatus for isolating wellbore fluids prior to implementing a first method for compressing a packing unit around a mandrel according to one or more embodiments.

In FIG. 9A, a first method first top-down view 900 of the isolation apparatus 101 in a wellbore is shown. As described above, the apparatus includes an elastomeric packer 104 having a first metal insert 300 and a second metal insert 400 distributed circumferentially therethrough. A mandrel 108 may be inserted in a generally central hole located within the apparatus (as described in FIGS. 1A-B, above). A generally central hole within the elastomeric packer 104 is referred to herein as a packer central circumference 516, which, as will be described in the following sections, may be compressed radially inward 902 toward the mandrel 108 when a closing pressure is applied to the apparatus.

As shown in FIG. 9A, the first metal insert 300 includes a first insert first prong tip side 342 on the first insert first prong 310. Similarly, the second metal insert 400 includes a second insert first prong tip side 442 on the second insert first prong 410. As pressure is applied to the upper piston portion 702 (as described in FIGS. 8A-F, above), the first insert first prong tip side 342 on the first insert first prong 310 and the second insert first prong tip side 442 on the second insert first prong 410 rotate radially inward toward the mandrel 108. Although not shown in the method of FIGS. 9A-G, the first insert second prong tip side 382 on the first insert second prong 312 and the second insert second prong tip side 482 on the second insert second prong 412 may also rotate radially inward toward the mandrel 108 when pressure is applied to the upper piston portion 702.

Curved arrows in FIGS. 9A-9G represent an arbitrary radial rotation angle of the first insert first prong tip side 342 on the first insert first prong 310 and the second insert first prong tip side 442 on the second insert first prong 410 as pressure is applied to the apparatus. Specifically, in FIG. 9A, the first insert first prong tip side 342 on the first insert first prong 310 is in a first method first insert tip initial position 903 and will move a first method first insert first rotation 904 to arrive at the first method second top-down view 910 of the isolation apparatus 101 as shown in FIG. 9B. Similarly, the second insert first prong tip side 442 on the second insert first prong 410 is in a first method second insert tip initial position 905 in FIG. 9A and will move a first method second insert first rotation 906 to arrive at the first method second top-down view 910 of the isolation apparatus 101 as shown in FIG. 9B.

In moving from FIG. 9A to FIG. 9B, the first method first insert first rotation 904 and the first method second insert first rotation 906 has occurred, moving the first insert first prong tip side 342 on the first insert first prong 310 and the second insert first prong tip side 442 on the second insert first prong 410 radially inward 902 toward the mandrel 108. In addition, the elastomeric packer is compressed radially inward 902, decreasing the initial size of the packer central circumference 516 to a packer first method first central circumference 912.

Figure 9D:
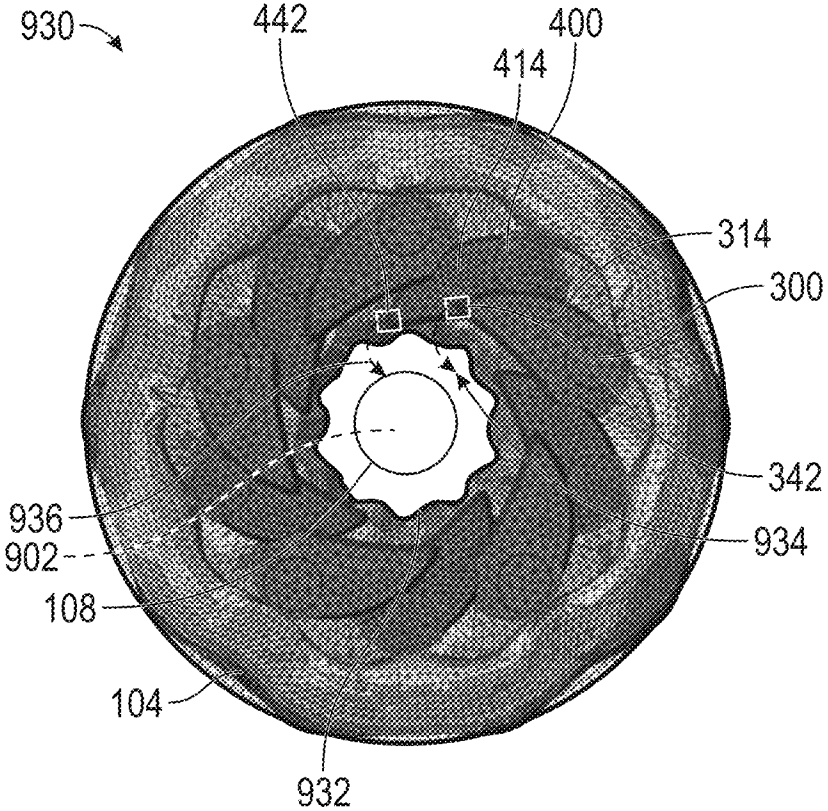
Figure 9C:
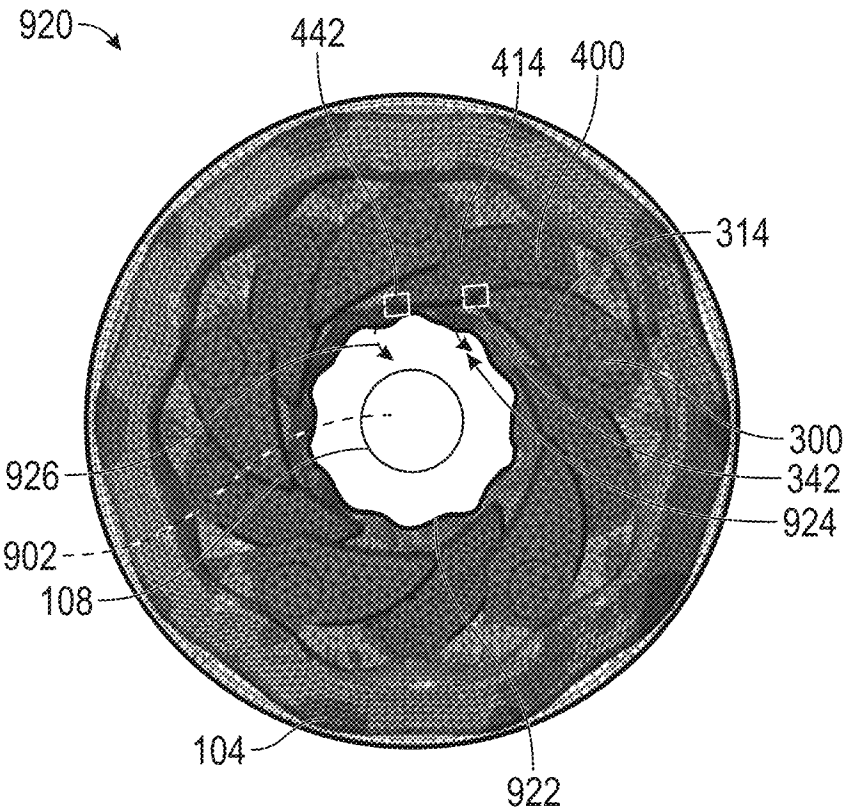

In FIG. 9B, the first insert first prong tip side 342 on the first insert first prong 310 will move a first method first insert second rotation 914 to arrive at the first method third top-down view 920 of the isolation apparatus 101 as shown in FIG. 9C. Similarly, the second insert first prong tip side 442 on the second insert first prong 410 will move a first method second insert second rotation 916 to arrive at the first method third top-down view 920 of the isolation apparatus 101 as shown in FIG. 9C.

In moving from FIG. 9B to FIG. 9C, the first method first insert second rotation 914 and the first method second insert second rotation 916 has occurred, moving the first insert first prong tip side 342 on the first insert first prong 310 and the second insert first prong tip side 442 on the second insert first prong 410 radially inward 902 toward the mandrel 108. In addition, the elastomeric packer is compressed radially inward 902, decreasing the size of the packer first method first central circumference 912 to a packer first method second central circumference 922.

In FIG. 9C, the first insert first prong tip side 342 on the first insert first prong 310 will move a first method first insert third rotation 924 to arrive at the first method fourth top-down view 930 of the isolation apparatus 101 as shown in FIG. 9D. Similarly, the second insert first prong tip side 442 on the second insert first prong 410 will move a first method second insert third rotation 926 to arrive at the first method fourth top-down view 930 of the isolation apparatus 101 as shown in FIG. 9D.

In moving from FIG. 9C to FIG. 9D, the first method first insert third rotation 924 and the first method second insert third rotation 926 has occurred, moving the first insert first prong tip side 342 on the first insert first prong 310 and the second insert first prong tip side 442 on the second insert first prong 410 radially inward 902 toward the mandrel 108. In addition, the elastomeric packer is compressed radially inward 902, decreasing the size of the packer first method second central circumference 922 to a packer first method third central circumference 932.

Figure 9F:
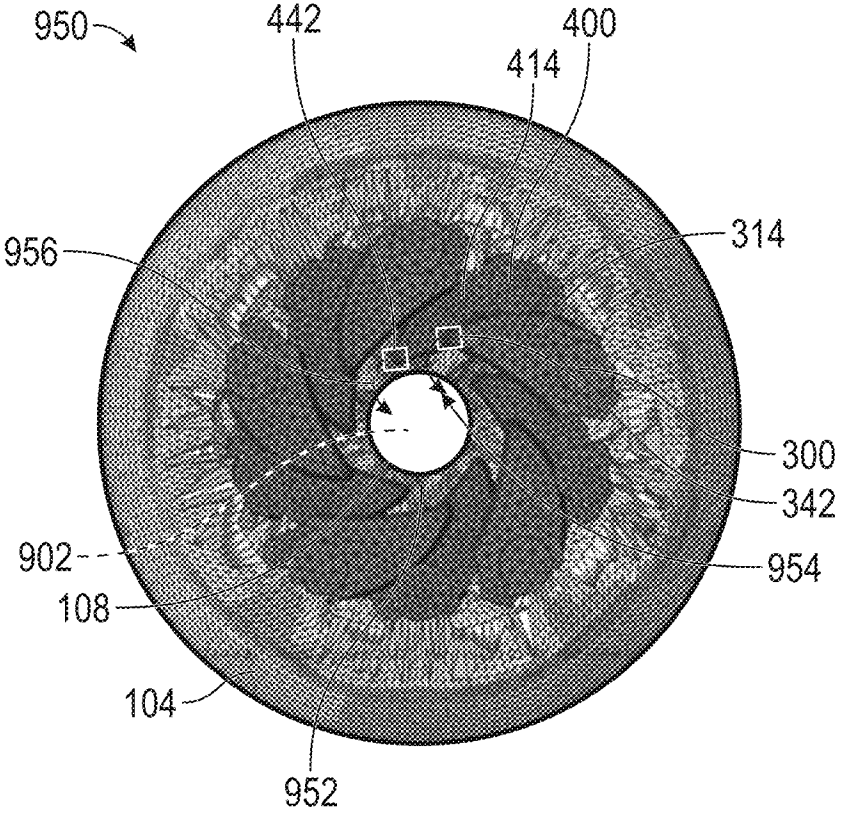
Figure 9E:
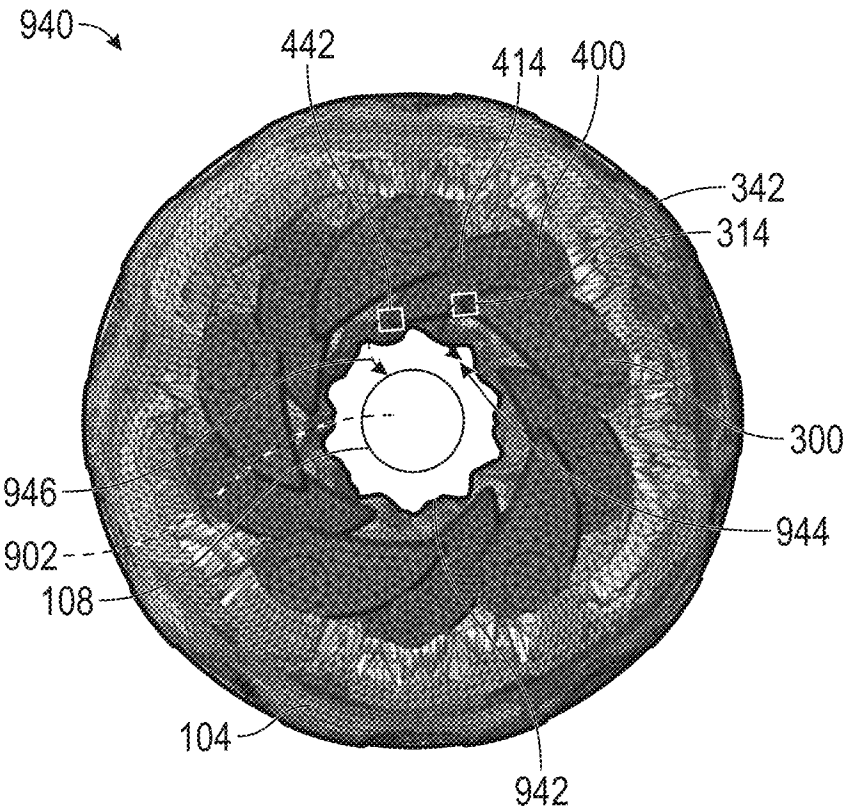

In FIG. 9D, the first insert first prong tip side 342 on the first insert first prong 310 will move a first method first insert fourth rotation 934 to arrive at the first method fifth top-down view 940 of the isolation apparatus 101 as shown in FIG. 9E. Similarly, the second insert first prong tip side 442 on the second insert first prong 410 will move a first method second insert fourth rotation 936 to arrive at the first method fifth top-down view 940 of the isolation apparatus 101 as shown in FIG. 9E.

In moving from FIG. 9D to FIG. 9E, the first method first insert fourth rotation 934 and the first method second insert fourth rotation 936 has occurred, moving the first insert first prong tip side 342 on the first insert first prong 310 and the second insert first prong tip side 442 on the second insert first prong 410 radially inward 902 toward the mandrel 108. In addition, the elastomeric packer is compressed radially inward 902, decreasing the size of the packer first method third central circumference 932 to a packer first method fourth central circumference 942.

In FIG. 9E, the first insert first prong tip side 342 on the first insert first prong 310 will move a first method first insert fifth rotation 944 to arrive at the first method sixth top-down view 950 of the isolation apparatus 101 as shown in FIG. 9F. Similarly, the second insert first prong tip side 442 on the second insert first prong 410 will move a first method second insert fifth rotation 946 to arrive at the first method sixth top-down view 950 of the isolation apparatus 101 as shown in FIG. 9F.

In moving from FIG. 9E to FIG. 9F, the first method first insert fifth rotation 944 and the first method second insert fifth rotation 946 has occurred, moving the first insert first prong tip side 342 on the first insert first prong 310 and the second insert first prong tip side 442 on the second insert first prong 410 radially inward 902 toward the mandrel 108. In addition, the elastomeric packer is compressed radially inward 902, decreasing the size of the packer first method fourth central circumference 942 to a packer first method sealed central circumference 952.

Figure 9G:
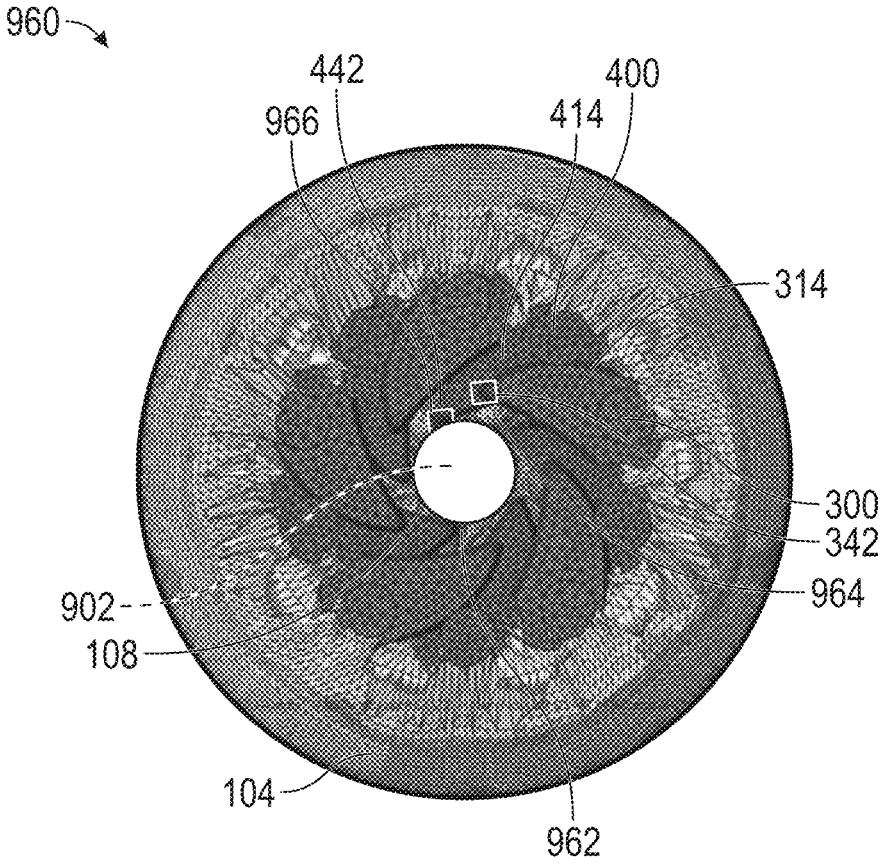
FIG. 9G is a first method top down view of a final position of an apparatus for isolating wellbore fluids prior to implementing a first method for compressing a packing unit around a mandrel according to one or more embodiments.

In FIG. 9F, the first insert first prong tip side 342 on the first insert first prong 310 will move a first method first insert sixth rotation 954 to arrive at the first method final top-down view 960 of the isolation apparatus 101 as shown in FIG. 9G. Similarly, the second insert first prong tip side 442 on the second insert first prong 410 will move a first method second insert sixth rotation 956 to arrive at the first method final top-down view 960 of the isolation apparatus 101 as shown in FIG. 9G.

In moving from FIG. 9F to FIG. 9G, the first method first insert sixth rotation 954 and the first method second insert sixth rotation 956 has occurred, moving the first insert first prong tip side 342 on the first insert first prong 310 and the second insert first prong tip side 442 on the second insert first prong 410 radially inward 902 toward the mandrel 108. In addition, the elastomeric packer is compressed radially inward 902, decreasing the size of the packer central circumference to a packer first method sealed central circumference 952, in which the packer has sealed around the mandrel 108. As shown in FIG. 9F, the sealed central circumference 952 is in contact with the mandrel 108 such that wellbore fluids may be substantially isolated by the apparatus.

Finally, in FIG. 9G, the first method first insert sixth rotation 954 has occurred. The sealed central circumference 952 remains the same size as in FIG. 9F (e.g., fully sealed), as the first metal insert 300 and the second metal insert 400 continue to rotate radially inward 902. Specifically, the first insert first prong tip side 342 on the first insert first prong 310 moves radially inward 902 toward the mandrel 108 to a first method first insert tip side final position 964. Similarly, the first method second insert sixth rotation 956 has occurred, moving the second insert first prong tip side 442 on the second insert first prong 410 radially inward 902 toward the mandrel 108 to a first method second insert tip side final position 966.

As would be understood by one of ordinary skill in the art, though not explicitly shown, the methods and procedures described in the above sections may be reversed. For example, moving from FIG. 9GF to FIG. 9A illustrates a first method for decompressing a packing unit according to one or more embodiments. Decompressing the packing unit may occur when an opening pressure is applied to the apparatus for isolating wellbore fluids, whereby the central circumference of the apparatus is unsealed when the piston is moved downhole. Upon decompressing, the packing unit moves the plurality of metal inserts radially outward to release the seal.

Figure 10B:
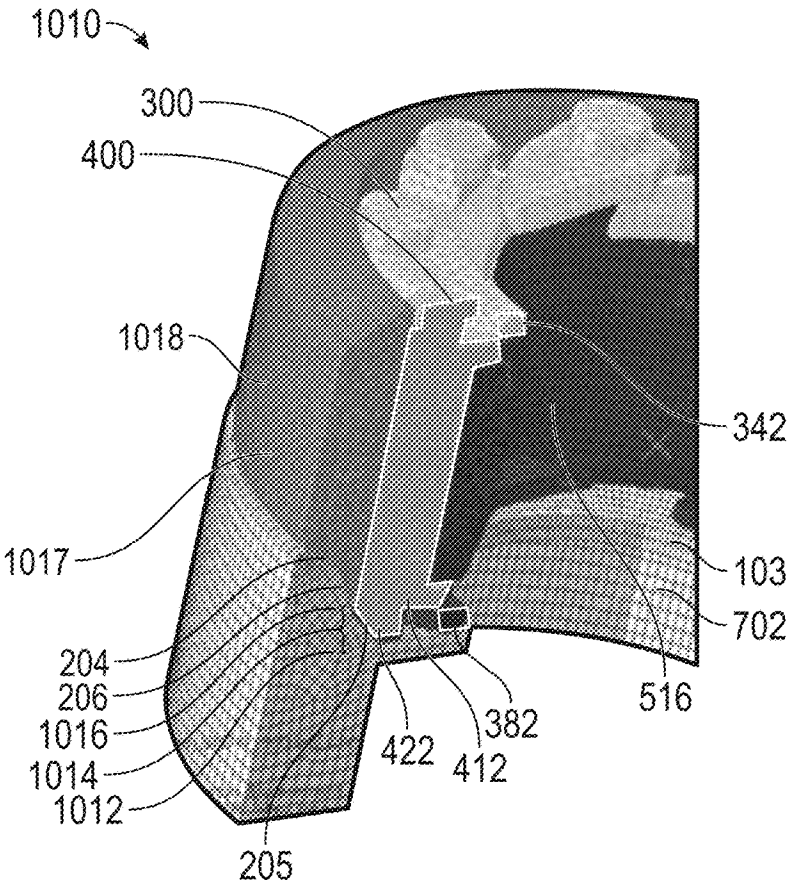
FIGS. 10B-E illustrate different stages of applying a closing pressure to an apparatus for isolating wellbore fluids according a second method of one or more embodiments.
Figure 10A:
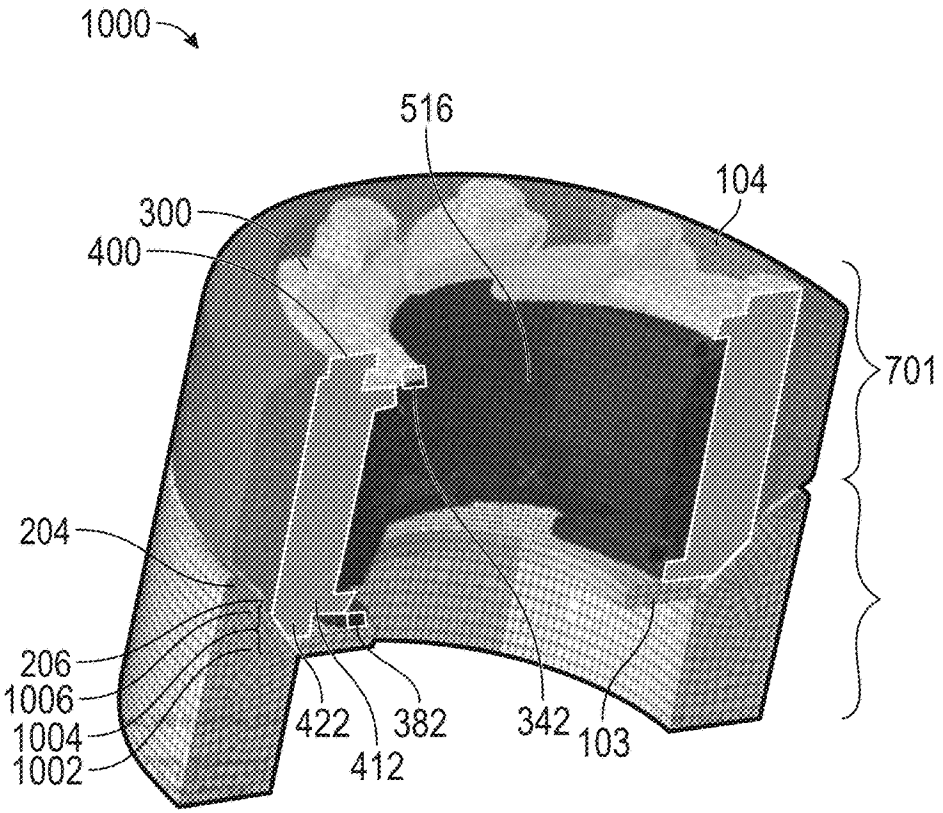
FIG. 10A is a second method initial position of an apparatus for isolating wellbore fluids prior to implementing a second method for compressing a packing unit around the apparatus according to one or more embodiments.

A description of a second method disclosed herein will now be made in reference to FIGS. 10A-F. FIGS. 10A-B show a second method initial position 1000 (in FIG. 10A) and a second method final position 1050 (in FIG. 10F) of the isolation apparatus 101 in a wellbore (700 as shown in FIG. 7A) is operated to provide a seal around itself after applying a closing pressure to the apparatus in a series of stages. While the apparatus shown in FIG. 7A is used to illustrate methods, other systems and components as disclosed herein may be substituted in the method without departing from the present disclosure.

As shown in FIG. 10A, the first metal insert 300 includes a first insert first prong tip side 342 on the first insert first prong 310 and a first insert second prong tip side 382 on the first insert second prong 312. As pressure is applied to the upper piston portion 702, the first insert first prong tip side 342 on the first insert first prong 310 and the first insert second prong tip side 382 on the first insert second prong 312 may rotate radially inward, as will be demonstrated in the following figures. Although not shown in the method of FIGS. 10A-F, the second insert first prong tip side 442 on the second insert first prong 410 and a second insert second prong tip side 482 on the second insert second prong 412 may also rotate radially inward when pressure is applied to the upper piston portion 702.

The second metal insert 400 includes a second insert second prong 412 having a second insert second prong protrusion portion 422. The upper piston portion 702 includes a piston first sloped portion 204, a piston second sloped portion 206, and a piston third sloped portion 205. As shown in FIG. 10A, the upper piston portion 702 is located at a second method initial position 1002 and will move axially uphole 366 a second method first distance 1004 to a second method first position 1006. Although not shown in FIG. 10A, note that, when the piston is in the second method initial position 1002, no pressure is applied to the piston and a piston second tubular body (156 in FIG. 2A) having a second body notched portion (158 in FIG. 2B) abuts a BOP housing shoulder (160 in FIG. 1B).

When a first applied pressure is applied to the system in the second method initial position 1000 shown in FIG. 10A, a first stroke causes the upper piston portion 702 to move the second method first distance 1004 to a second method first position 1006, and the system moves to the second method first position 1010, shown in FIG. 10B. In moving from FIG. 10A to FIG. 10B, a first stroke as a part of the series of stages of applied closing pressure has occurred. During the first stroke, upper piston portion 702 moves the second method first distance 1004 and the piston third sloped portion 205 of the piston sloped profile 152 contacts the second insert second prong protrusion portion 422 on the second insert second prong 412. Movement of the upper piston portion 702 responsive to the first stroke also causes the piston first sloped portion 204 and the piston second sloped portion 206 to contact a first packer portion 1017 compresses the elastomeric packer 104 in a second method first packer compression 1018, as shown in FIG. 10C.

Figure 10D:
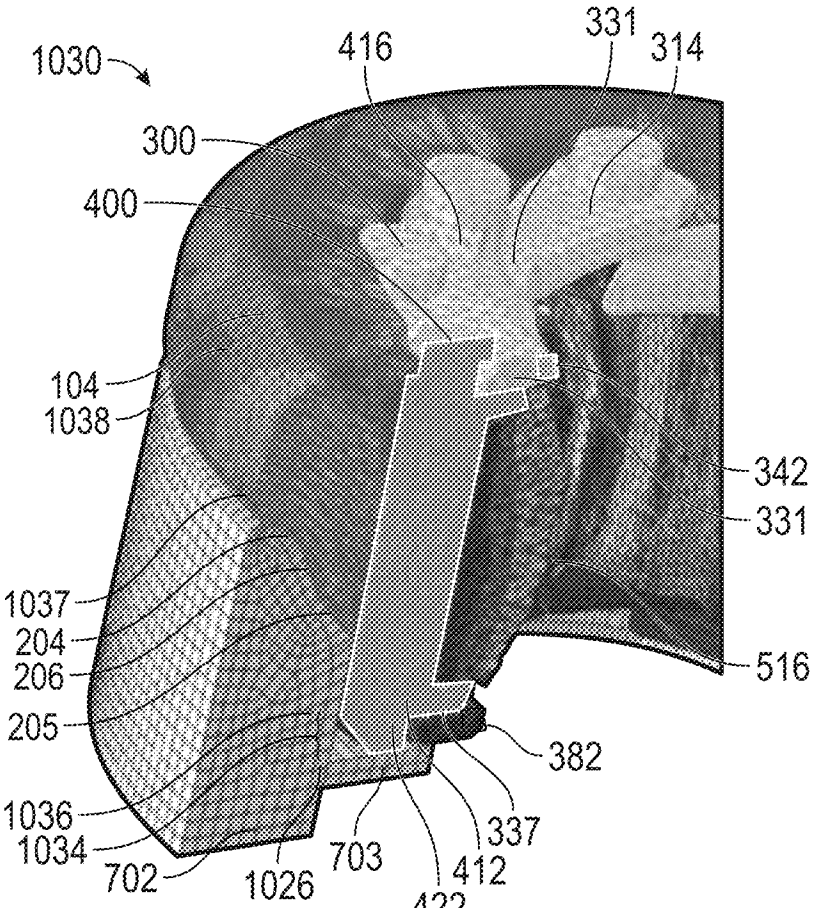
Figure 10C:
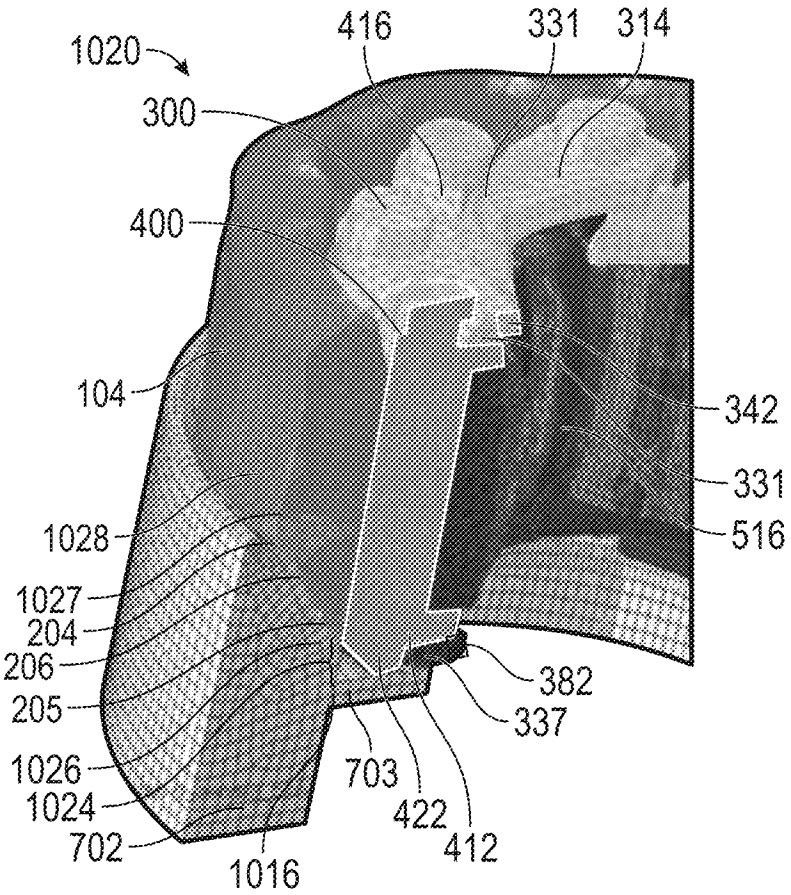

When a second applied pressure is applied to the system in the second method first position 1010 shown in FIG. 10B, a second stroke causes the upper piston portion 702 to move a second method second distance 1014 to a second position 1016 and the system moves to the second method second position 1020, shown in FIG. 10C. In moving from FIG. 10B to FIG. 10C, a second stroke as a part of the series of stages of applied closing pressure has occurred. During the second stroke, upper piston portion 702 moves the second method second distance 1014 and the piston third sloped portion 205 of the piston sloped profile 152 further contacts the second insert second prong protrusion portion 422 on the second insert second prong 412.

The first insert first prong tip side 342 on the first insert first prong 310 and the first insert second prong tip side 382 on the first insert second prong 312 begin to rotate radially inward causing a second method first insert first rotation. Radial rotation of the first metal insert 300 and the second metal insert 400 is guided by the features of the wear plate 102 (as shown in FIGS. 6A-6E). An amount of clearance is provided between the first insert second curve 311 of the first insert first prong 310 and the second insert first prong first protrusion portion 416 on the second insert first prong 410 such that the first insert first prong 310 advantageously does not contact the second insert first prong 410.

Movement of the upper piston portion 702 responsive to the second stroke also causes the piston first sloped portion 204 and the piston second sloped portion 206 to contact a second packer portion 1027 compresses the elastomeric packer 104 in a second method second packer compression 1028, as shown in FIG. 10C.

When a third applied pressure is applied to the system in the second method second position 1020 shown in FIG. 10C, a third stroke causes the upper piston portion 702 to move a second method third distance 1024 to a second method third position 1026 and the system moves to the second method third position 1030, shown in FIG. 10D. In moving from FIG. 10C to FIG. 10D, a third stroke as a part of the series of stages of applied closing pressure has occurred. During the third stroke, upper piston portion 702 moves the second method third distance 1024 and the piston first sloped portion 204, the piston second sloped portion 206, and the piston third sloped portion 205 contact a third packer portion 1037, compressing the elastomeric packer 104 in a second method third packer compression 1038, as shown in FIG. 10D.

During the third stroke, the first insert first prong tip side 342 on the first insert first prong 310 and the first insert second prong tip side 382 on the first insert second prong 312 further rotate radially inward causing a second method first insert second rotation. Further, the second metal insert 400 rotates radially inward in a second method second insert second rotation.

Figure 10F:
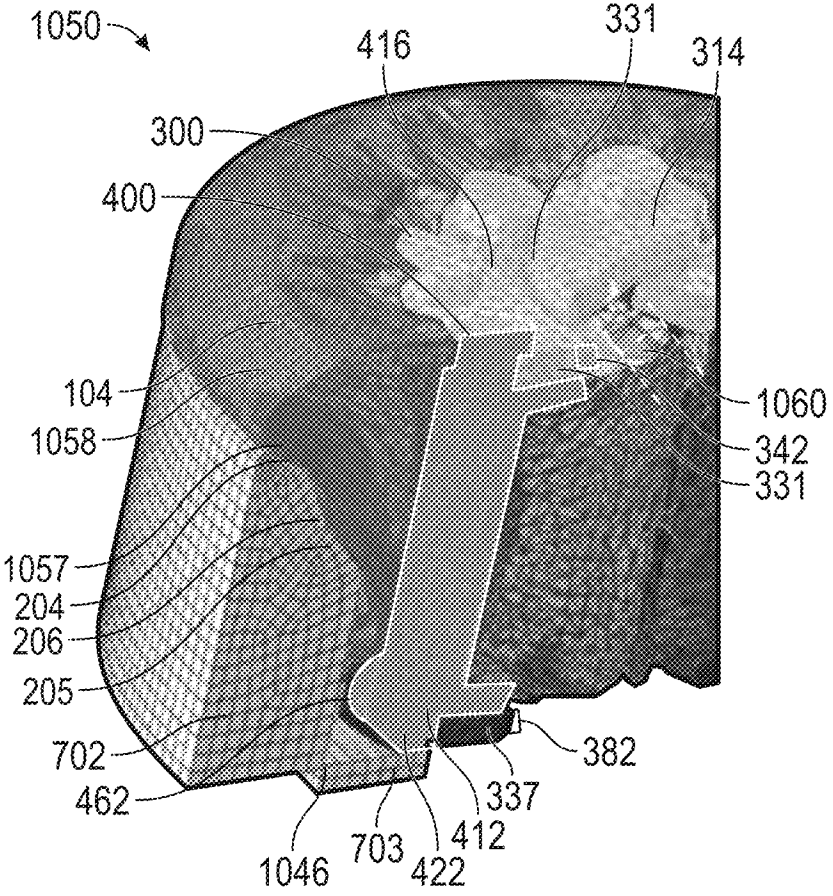
FIG. 10F is a second method final position of an apparatus for isolating wellbore fluids prior to implementing a second method for compressing a packing unit around the apparatus according to one or more embodiments.
Figure 10E:
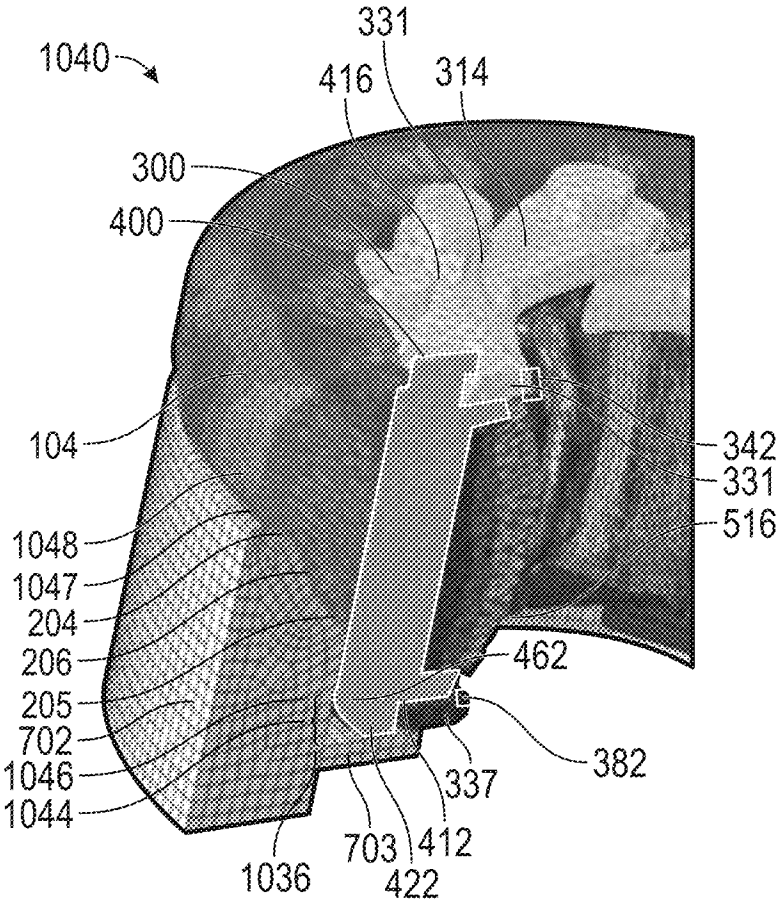

When a fourth applied pressure is applied to the system in the second method third position 1030 shown in FIG. 10D, a fourth stroke causes the upper piston portion 702 to move a second method fourth distance 1034 to an apparatus fourth position 1036 and the system moves to the second method fourth position 1040, shown in FIG. 10E. In moving from FIG. 10D to FIG. 10E, a fourth stroke as a part of the series of stages of applied closing pressure has occurred. During the fourth stroke, upper piston portion 702 moves the second method fourth distance 1034 and the piston first sloped portion 204, the piston second sloped portion 206, and the piston third sloped portion 205 contact a fourth packer portion 1047, compressing the elastomeric packer 104 in a second method fourth packer compression 1048, as shown in FIG. 10E.

During the fourth stroke, the first insert first prong tip side 342 on the first insert first prong 310 and the first insert second prong tip side 382 on the first insert second prong 312 further rotate radially inward in a second method first insert third rotation. Furthermore, the second metal insert further rotates radially inward in a second method first insert third rotation as evidenced by the second insert lip 462 of the second metal insert 400 now being visible in FIG. 10E.

Finally, when a fifth applied pressure is applied to the system in the second method fourth position 1040 shown in FIG. 10E, a fifth stroke causes the upper piston portion 702 to move a second method fifth distance 1044 to a second method fifth position 1046 and the system moves to the second method final position 1050, shown in FIG. 10F. In moving from FIG. 10E to FIG. 10F, a fifth stroke as a part of the series of stages of applied closing pressure has occurred. During the fifth stroke, upper piston portion 702 moves the second method fifth distance 1044 and the piston first sloped portion 204, the piston second sloped portion 206, and the piston third sloped portion 205 contact a fifth packer portion 1057, compressing the elastomeric packer 104 in a second method fifth packer compression 1058, as shown in FIG. 10F.

During the fifth stroke, the first insert first prong tip side 342 on the first insert first prong 310 and the first insert second prong tip side 382 on the first insert second prong 312 further rotate radially inward in a second method first insert fourth rotation. Furthermore, the second metal insert further rotates radially inward in a second method first insert fourth rotation.

FIG. 10F shows the system in a second method final position 1050. In FIG. 10F, upper piston portion 702 has moved from second method initial position 1002 shown in FIG. 10A to the second method fifth position (or final position) 1046. When in the second method fifth position 1046, the first metal insert 300, the second metal insert 400, and the compressed elastomeric packer 1052 provide a seal around itself by moving radially inward to provide a seal in the isolation apparatus 101 when the closing pressure is applied. Upon sealing the central circumference of the apparatus when the closing pressure is applied to form the seal, an extrusion gap 1060 within the apparatus has a size of less than approximately four inches, as described above.

As would be understood by one of ordinary skill in the art, though not explicitly shown, the methods and procedures described in the above sections may be reversed. For example, moving from FIG. 10E to FIG. 10A illustrates a second method for decompressing a packing unit according to one or more embodiments. Decompressing the packing unit may occur when an opening pressure is applied to the isolation apparatus 101, whereby the central circumference of the apparatus is unsealed when the piston is moved downhole. Upon decompressing, the packing unit moves the plurality of metal inserts radially outward to release the seal.

FIGS. 11A-G further illustrate movement of the first metal insert 300 and the second metal insert 400 when a closing pressure is applied to the isolation apparatus 101 in a wellbore (700 as shown in FIG. 7A) is operated to provide a seal around itself after applying a closing pressure to the apparatus in a series of stages. While the images presented in FIGS. 11A-G also show movement of the first metal insert 300 and the second metal insert 400 in a series of stages during closing of the apparatus, it is noted herein that the views shown in FIGS. 11A-G do not directly correspond with the images presented in FIGS. 10A-F. In other words, as will be described below, movement of the apparatus from a second method first top-down view 1100 shown in FIG. 11A to a second method second top-down view 1110 does not directly correspond to the second method initial position 1000 shown in FIG. 10A to the second method first position 1010 shown in FIG. 10B.

Figure 11B:
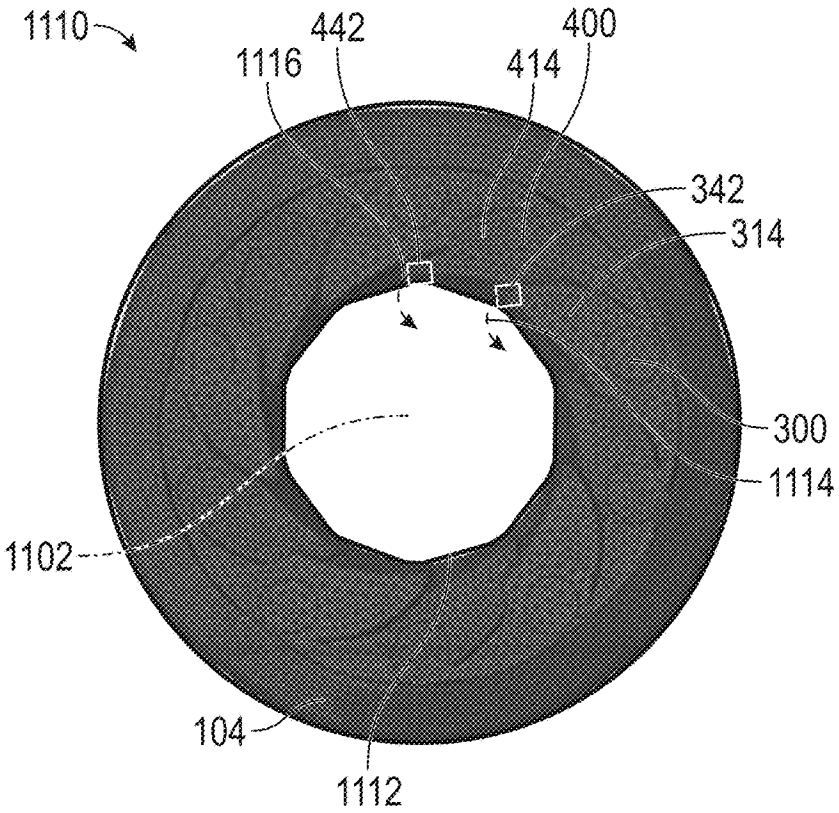
FIGS. 11B-F illustrate different top down views during applying a closing pressure to an apparatus for isolating wellbore fluids according a second method of one or more embodiments.
Figure 11A:
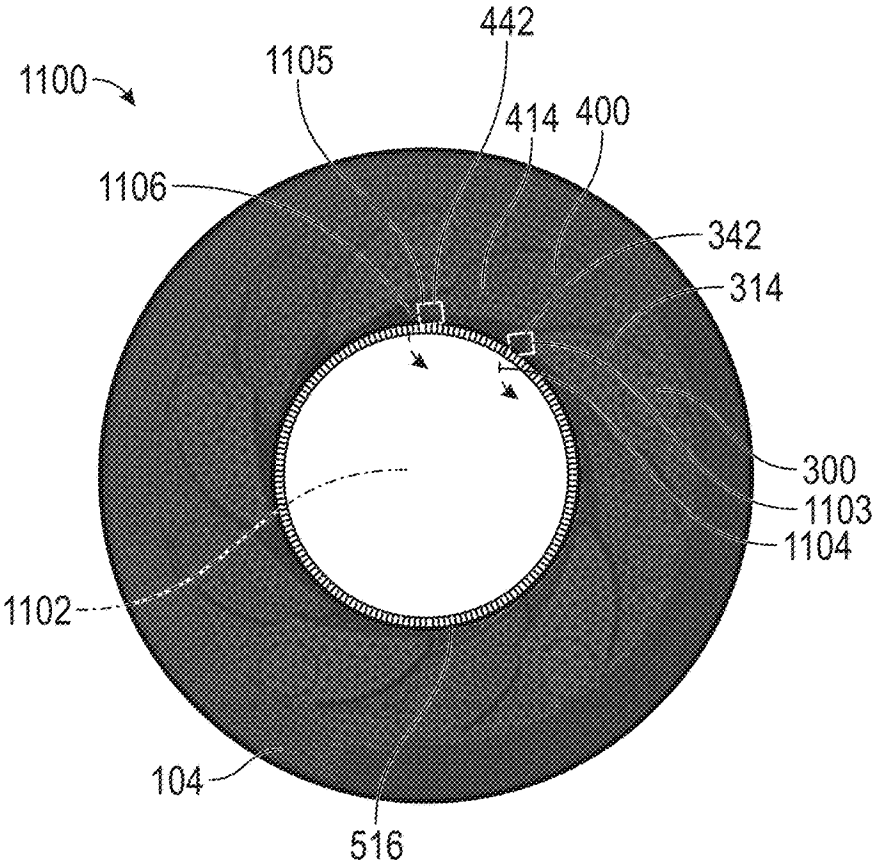
FIG. 11A is a second method top down view of an initial position of an apparatus for isolating wellbore fluids prior to implementing a second method for compressing a packing unit around the apparatus according to one or more embodiments.

In FIG. 11A, a second method first top-down view 1100 of the isolation apparatus 101 in a wellbore is shown. As described above, the apparatus includes an elastomeric packer 104 having a first metal insert 300 and a second metal insert 400 distributed circumferentially therethrough. A generally central hole within the elastomeric packer 104 is referred to herein as a packer central circumference 516, which, as will be described in the following sections, may be compressed radially inward 1102 when a closing pressure is applied to the apparatus.

As shown in FIG. 11A, the first metal insert 300 includes a first insert first prong tip side 342 on the first insert first prong 310. Similarly, the second metal insert 400 includes a second insert first prong tip side 442 on the second insert first prong 410. As pressure is applied to the upper piston portion 702 (as described in FIGS. 10A-F, above), the first insert first prong tip side 342 on the first insert first prong 310 and the second insert first prong tip side 442 on the second insert first prong 410 rotate radially inward 1102. Although not shown in the method of FIGS. 11A-G, the first insert second prong tip side 382 on the first insert second prong 312 and the second insert second prong tip side 482 on the second insert second prong 412 may also rotate radially inward 1102 when pressure is applied to the upper piston portion 702.

Curved arrows in FIGS. 11A-G represent a radial rotation angle of the first insert first prong tip side 342 on the first insert first prong 310 and the second insert first prong tip side 442 on the second insert first prong 410 as pressure is applied to the apparatus. Specifically, in FIG. 11A, the first insert first prong tip side 342 on the first insert first prong 310 is in a second method second insert tip initial position 1105 and will move a second method first insert first rotation 1104 to arrive at the second method second top-down view 1110 of the isolation apparatus 101 as shown in FIG. 11B. Similarly, the second insert first prong tip side 442 on the second insert first prong 410 is in a second method second insert tip initial position 1105 in FIG. 11A and will move a second method second insert first rotation 1106 to arrive at the second method second top-down view 1110 of the isolation apparatus 101 as shown in FIG. 11B.

In moving from FIG. 11A to FIG. 11B, the second method first insert first rotation 1104 and the second method second insert first rotation 1106 has occurred, moving the first insert first prong tip side 342 on the first insert first prong 310 and the second insert first prong tip side 442 on the second insert first prong 410 radially inward 1102. In addition, the elastomeric packer is compressed radially inward 1102, decreasing the initial size of the packer central circumference 516 to a packer second method first central circumference 1112.

Figure 11D:
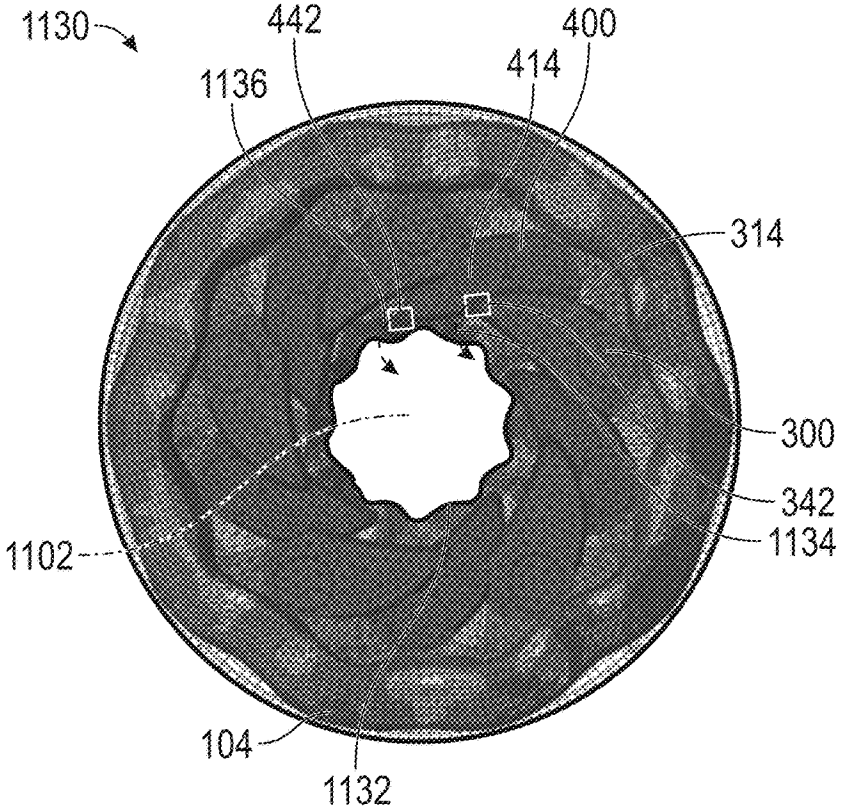
Figure 11C:
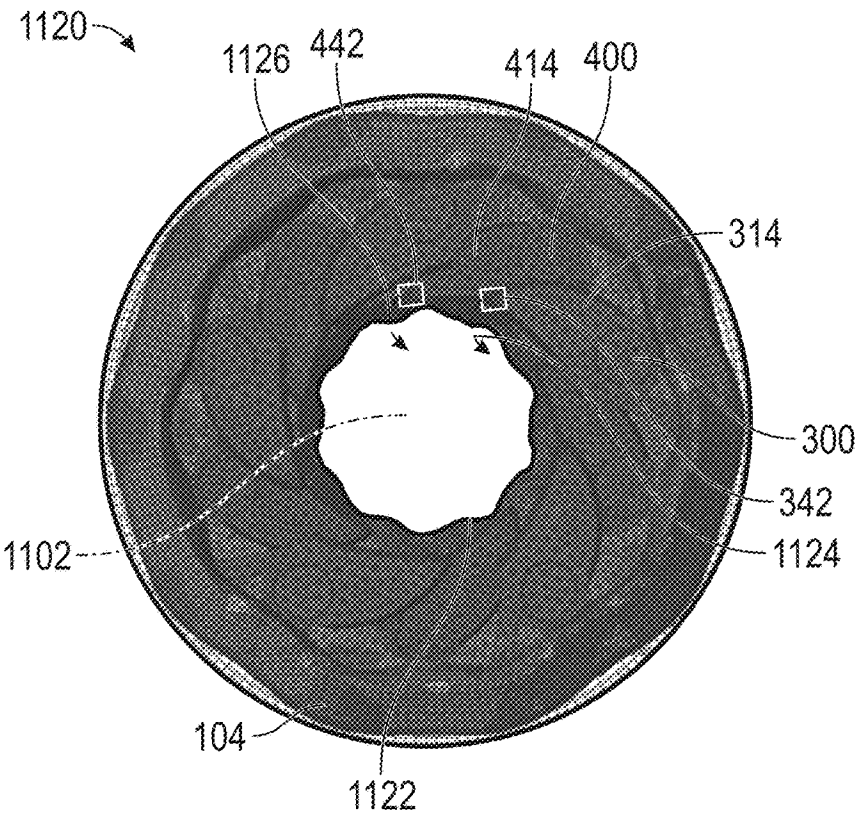

In FIG. 11B, the first insert first prong tip side 342 on the first insert first prong 310 will move a second method first insert second rotation 1114 to arrive at the second method third top-down view 1120 of the isolation apparatus 101 as shown in FIG. 11C. Similarly, the second insert first prong tip side 442 on the second insert first prong 410 will move a second method second insert second rotation 1116 to arrive at the second method third top-down view 1120 of the isolation apparatus 101 as shown in FIG. 11C.

In moving from FIG. 11B to FIG. 11C, the second method first insert second rotation 1114 and the second method second insert second rotation 1116 has occurred, moving the first insert first prong tip side 342 on the first insert first prong 310 and the second insert first prong tip side 442 on the second insert first prong 410 radially inward 1102. In addition, the elastomeric packer is compressed radially inward 1102, decreasing the size of the packer second method first central circumference 1112 to a packer second method second central circumference 1122.

In FIG. 11C, the first insert first prong tip side 342 on the first insert first prong 310 will move a second method first insert third rotation 1124 to arrive at the fourth top-down view 1130 of the isolation apparatus 101 as shown in FIG. 11D. Similarly, the second insert first prong tip side 442 on the second insert first prong 410 will move a second method second insert third rotation 1126 to arrive at the second method fourth top-down view 1130 of the isolation apparatus 101 as shown in FIG. 11D.

In moving from FIG. 11C to FIG. 11D, the second method first insert third rotation 1124 and the second method second insert third rotation 1126 has occurred, moving the first insert first prong tip side 342 on the first insert first prong 310 and the second insert first prong tip side 442 on the second insert first prong 410 radially inward 1102. In addition, the elastomeric packer is compressed radially inward 1102, decreasing the size of the packer second method second central circumference 1122 to a packer second method third central circumference 1132.

Figure 11F:
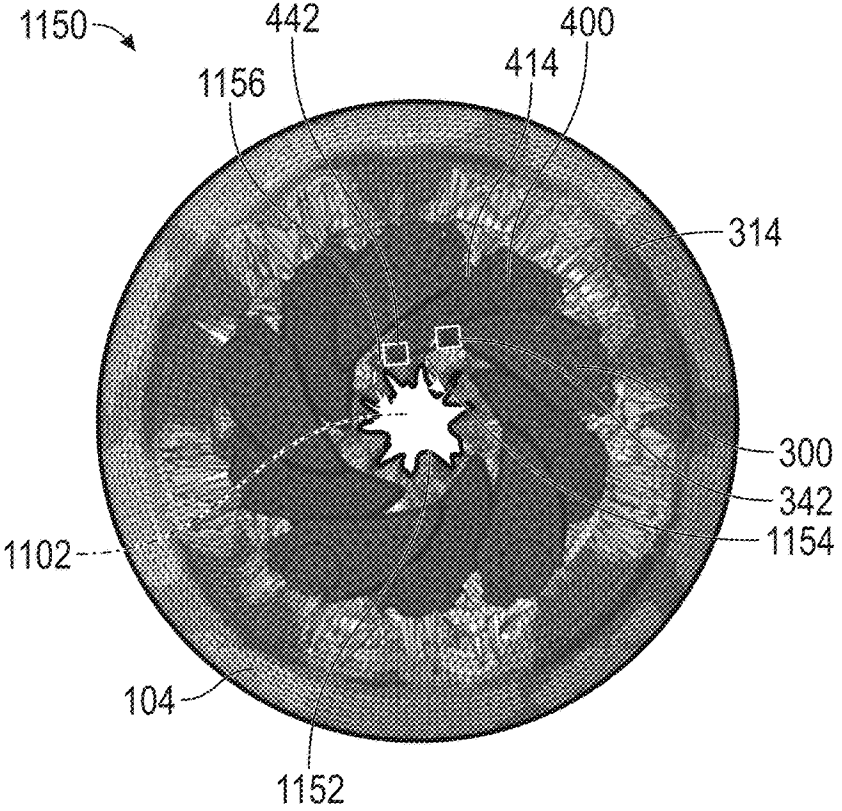
Figure 11E:
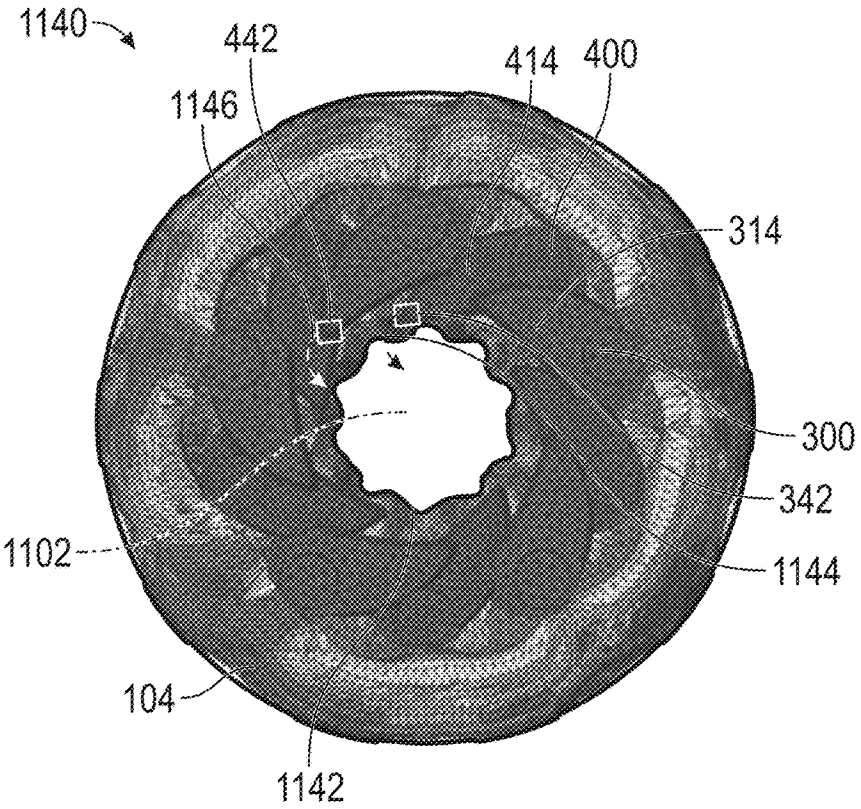

In FIG. 11D, the first insert first prong tip side 342 on the first insert first prong 310 will move a second method first insert fourth rotation 1134 to arrive at the fifth top-down view 1140 of the isolation apparatus 101 as shown in FIG. 11E. Similarly, the second insert first prong tip side 442 on the second insert first prong 410 will move a second method second insert fourth rotation 1136 to arrive at the fifth top-down view 1140 of the isolation apparatus 101 as shown in FIG. 11E.

In moving from FIG. 11D to FIG. 11E, the second method first insert fourth rotation 1134 and the second method second insert fourth rotation 1136 has occurred, moving the first insert first prong tip side 342 on the first insert first prong 310 and the second insert first prong tip side 442 on the second insert first prong 410 radially inward 1102. In addition, the elastomeric packer is compressed radially inward 1102, decreasing the size of the packer second method third central circumference 1132 to a packer second method fourth central circumference 1142.

In FIG. 11E, the first insert first prong tip side 342 on the first insert first prong 310 will move a second method first insert fifth rotation 1144 to arrive at the second method sixth top-down view 1150 of the isolation apparatus 101 as shown in FIG. 11F. Similarly, the second insert first prong tip side 442 on the second insert first prong 410 will move a second method second insert fifth rotation 1146 to arrive at the second method sixth top-down view 1150 of the isolation apparatus 101 as shown in FIG. 11F.

In moving from FIG. 11E to FIG. 11F, the second method first insert fifth rotation 1144 and the second method second insert fifth rotation 1146 has occurred, moving the first insert first prong tip side 342 on the first insert first prong 310 and the second insert first prong tip side 442 on the second insert first prong 410 radially inward 1102. In addition, the elastomeric packer is compressed radially inward 1102, decreasing the size of the packer second method fourth central circumference 1142 to a packer second method fifth central circumference 1152.

Figure 11G:
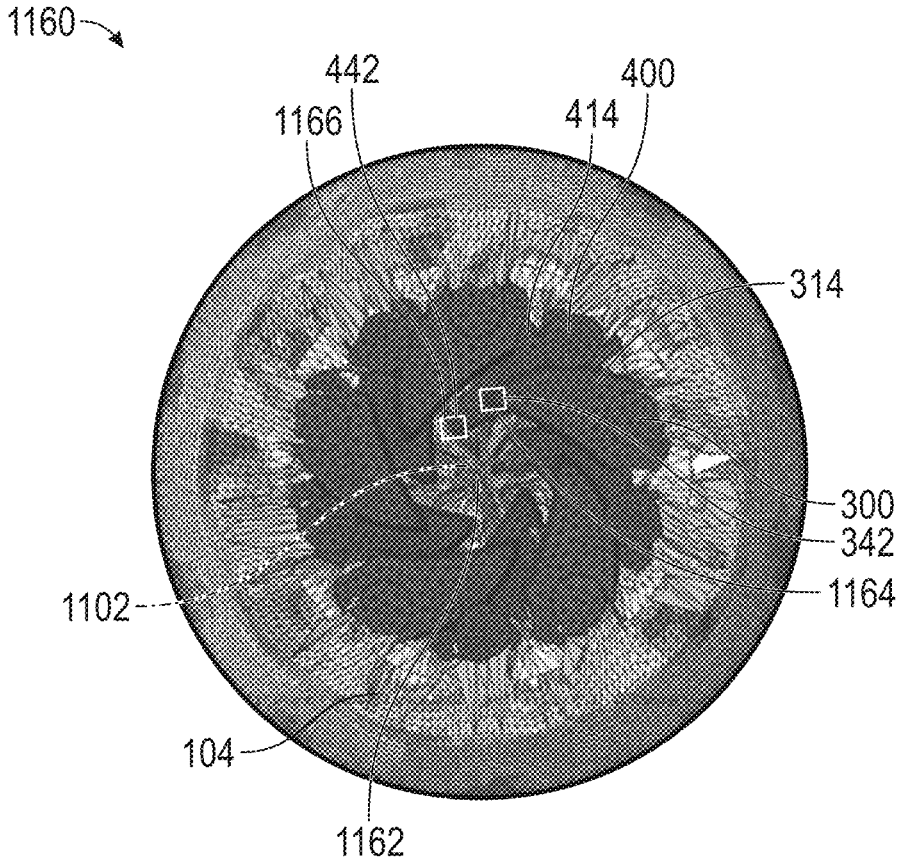
FIG. 11G is a second method top down view of a final position of an apparatus for isolating wellbore fluids prior to implementing a second method for compressing a packing unit around the apparatus according to one or more embodiments.

In FIG. 11F, the first insert first prong tip side 342 on the first insert first prong 310 will move a second method first insert sixth rotation 1154 to arrive at the second method seventh top-down view 1160 of the isolation apparatus 101 as shown in FIG. 11G. Similarly, the second insert first prong tip side 442 on the second insert first prong 410 will move a second method second insert sixth rotation 1156 to arrive at the second method seventh top-down view 1160 of the isolation apparatus 101 as shown in FIG. 11G.

In moving from FIG. 11F to FIG. 11G, the second method first insert sixth rotation 1154 and the second method second insert sixth rotation 1156 has occurred, moving the first insert first prong tip side 342 on the first insert first prong 310 and the second insert first prong tip side 442 on the second insert first prong 410 radially inward 1102. In addition, the elastomeric packer is compressed radially inward 1102, decreasing the size of the packer second method fifth central circumference 1152 to provide a seal 1162.

Finally, in FIG. 11G, the second method first insert sixth rotation 1154 has occurred, moving the first insert first prong tip side 342 on the first insert first prong 310 radially inward 1102 to a second method first insert tip final position 1164. Similarly, the second method second insert sixth rotation 1156 has occurred, moving the second insert first prong tip side 442 on the second insert first prong 410 radially inward 1102 to a second method second insert tip final position 1166. In addition, the elastomeric packer is compressed radially inward 1102, decreasing the size of the packer second method sealed central circumference to provide a seal 1162. As shown in FIG. 11G, the packer second method sealed central circumference 1172 is in contact with itself (e.g., the elastomeric packer 104) such that wellbore fluids may be substantially isolated by the apparatus.

As would be understood by one of ordinary skill in the art, though not explicitly shown, the methods and procedures described in the above sections may be reversed. For example, moving from FIG. 11G to FIG. 11A illustrates a second method for decompressing a packing unit according to one or more embodiments. Decompressing the packing unit may occur when an opening pressure is applied to the apparatus for isolating wellbore fluids, whereby the central circumference of the apparatus is unsealed when the piston is moved downhole. Upon decompressing, the packing unit moves the plurality of metal inserts radially outward to release the seal.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A blowout preventer (BOP) system comprising:

an apparatus configured to isolate wellbore fluids comprising a packing unit and a piston, wherein the piston is located downhole of and proximate to the packing unit, wherein the packing unit comprises an elastomeric packer having a plurality of first metal inserts disposed axially through a plurality of first insert portions in the elastomeric packer and a plurality of second metal inserts disposed axially through a plurality of second insert portions in the elastomeric packer, wherein the plurality of first metal inserts each comprise a first insert elongated portion coupled to a first insert first end having a first insert first prong and a first insert second end having a first insert second prong, and wherein the plurality of second metal inserts each comprise a second insert elongated portion coupled to a second insert first end having a second insert first prong and a second insert second end having a second insert second prong; and a BOP housing radially surrounding the apparatus, wherein the piston and the packing unit are axially stacked within the BOP housing, and a wear plate located on an uphole side of the packing unit, the uphole side of the packing unit being opposite the piston, wherein a wear plate first side comprises a plurality of wear plate cutout portions configured to radially align with and guide the first insert first prong and the second insert first prong.

2. The BOP system of claim 1, further comprising a mandrel extending through a central circumference of the packing unit and the piston, wherein the BOP system is configured to dynamically adjust such that a seal is formed around the mandrel.

3. The BOP system of claim 1, wherein the BOP system is configured to dynamically adjust such that a seal is formed by the apparatus.

4. The BOP system of claim 1, wherein the plurality of first metal inserts and the plurality of second metal inserts are arranged in an alternating pattern in the elastomeric packer.

5. The BOP system of claim 1, further comprising a sleeve located radially within the piston on a downhole side of the packing unit.

6. The BOP system of claim 1, wherein the piston comprises:

a piston first tubular body having a first body first end and a first body second end, wherein the first body first end is located uphole and proximate the packing unit, wherein an inner diameter of the first body first end comprises a piston sloped profile configured to abut against a portion of the packing unit, and wherein the piston sloped profile comprises a piston first sloped portion, a piston second sloped portion, and a piston third sloped portion, and the piston third sloped portion is configured to apply a pressure to a portion of the plurality of first metal inserts and the plurality of second metal inserts upon activation of the piston; and a piston second tubular body located circumferentially around an outer surface of the piston first tubular body, wherein the piston second tubular body protrudes a radial distance from the piston first tubular body such that the piston second tubular body has a larger outer diameter than the piston first tubular body, wherein the piston second tubular body comprises a second body first end and a second body second end, wherein the second body first end is located uphole of the second body second end, and wherein the second body second end comprises a notched portion extending circumferentially around a portion of the piston second tubular body from a piston second tubular body inner diameter towards a piston second tubular body second diameter, the notched portion configured to abut a BOP housing shoulder.

7. The BOP system of claim 1, wherein:

the first insert first prong comprises a first insert first prong base portion having a three dimensional body comprising a wing shaped profile, the wing shaped profile having a first insert first prong tip side and a first insert first prong base side, the first insert first prong tip side opposite the first insert first prong base side, wherein the first insert first prong base portion comprises a first insert first step defining a first insert first curve on a first step first side and a first insert second curve on a first step second side, and a first insert third step defining a first insert fifth curve on a third step first side and a first insert sixth curve on a third step second side, and wherein the first insert first prong further comprises a first insert first prong protrusion portion, coupled to the first insert first prong base portion, the first insert first prong protrusion portion having a circular shaped profile comprising a first insert tooth radially protruding from the first insert first prong protrusion portion, wherein the first insert tooth is proximate the first insert fifth curve on the first insert first prong base side; and the first insert second prong comprises a first insert second prong base portion having a three dimensional body comprising a wing shaped profile, the wing shaped profile having a first insert second prong tip side and a first insert second prong base side, the first insert second prong tip side opposite the first insert second prong base side, wherein the first insert second prong base portion comprises a first insert second step defining a first insert third curve on a second step first side and a first insert fourth curve on a second step second side, a first insert seventh curve, and a first insert lip.

8. The BOP system of claim 1, wherein:

the second insert first prong comprises a second insert first prong base portion having a three dimensional body comprising a wing shaped profile, the wing shaped profile having a second insert first prong tip side and a second insert first prong base side, the second insert first prong tip side opposite the second insert first prong base side, wherein the second insert first prong base portion comprises a second insert first step defining a second insert first curve on a first step first side and a second insert second curve on a first step second side, wherein the second insert first prong further comprises a second insert first prong first protrusion portion, coupled to the second insert first prong base portion, the second insert first prong first protrusion portion having a rectangular shaped profile comprising a second insert seventh curve, the second insert seventh curve proximate the second insert first prong base side, and a second insert first prong second protrusion portion, the second insert first prong second protrusion portion having a circular shaped profile comprising a second insert tooth radially protruding from the second insert first prong second protrusion portion, wherein the second insert tooth is proximate the second insert seventh curve on the second insert first prong base portion; and the second insert second prong comprises a second insert second prong base portion having a three dimensional body comprising a wing shaped profile, the wing shaped profile having a second insert second prong tip side and a second insert second prong base side, the second insert second prong tip side opposite the second insert second prong base side, wherein the second insert second prong base portion comprises a second insert second step defining a second insert third curve on a second step first side and a second insert fourth curve on a second step second side, a second insert sixth curve, and a second insert lip, and wherein the second insert second prong further comprises a second insert second prong protrusion portion, coupled to the second insert second prong base portion.

9. A method for operating a blowout prevention (BOP) system, the method comprising:

providing the BOP system to a wellhead, the BOP system comprising;

an apparatus configured to isolate wellbore fluids comprising a packing unit and a piston, wherein the piston is located downhole of and proximate to the packing unit, wherein the packing unit comprises an elastomeric packer having a plurality of first metal inserts disposed axially through a plurality of first insert portions in the elastomeric packer and a plurality of second metal inserts disposed axially through a plurality of second insert portions in the elastomeric packer, wherein the plurality of first metal inserts each comprise a first insert elongated portion coupled to a first insert first end having a first insert first prong and a first insert second end having a first insert second prong, and wherein the plurality of second metal inserts each comprise a second insert elongated portion coupled to a second insert first end having a second insert first prong and a second insert second end having a second insert second prong; and a BOP housing radially surrounding the apparatus, wherein the piston and the packing unit are axially stacked within the BOP housing; and a wear plate located on an uphole side of the packing unit, wherein the uphole side of the packing unit is opposite the piston, a wear plate first side comprises a plurality of wear plate cutout portions configured to radially align with and guide the first insert first prong and the second insert first prong;

applying a pressure to the apparatus in a series of stages, wherein the applied pressure comprises an opening pressure and a closing pressure, wherein the opening pressure moves the piston in a downhole direction and the closing pressure moves the piston in an uphole direction;

sealing a central circumference of the apparatus when the closing pressure is applied by compressing the packing unit with the piston when the piston is moved uphole, wherein, upon compressing, the packing unit moves the plurality of first metal inserts and the plurality of second metal inserts radially inward to form a seal; and unsealing the central circumference of the apparatus when the opening pressure is applied by decompressing the packing unit when the piston is moved downhole, wherein, upon decompressing, the packing unit moves the plurality of first metal inserts and the plurality of second metal inserts radially outward to release the seal.

10. The method of claim 9, further comprising a sleeve located radially within the piston.

11. The method of claim 10, wherein the piston comprises:

a piston first tubular body having a first body first end and a first body second end, wherein the first body first end is located uphole and proximate the packing unit, wherein an inner diameter of the first body first end comprises a piston sloped profile configured to abut against a portion of the packing unit, and wherein the piston sloped profile comprises a piston first sloped portion, a piston second sloped portion, and a piston third sloped portion, the piston third sloped portion configured to apply a pressure to a portion of the plurality of first metal inserts and the plurality of second metal inserts upon activation of the piston; and a piston second tubular body located circumferentially around an outer surface of the piston first tubular body, wherein the piston second tubular body protrudes a radial distance from the piston first tubular body such that the piston second tubular body has a larger outer diameter than the piston first tubular body, wherein the piston second tubular body comprises a second body first end and a second body second end, wherein the second body first end is located uphole of the second body second end, and wherein the second body second end comprises a notched portion extending circumferentially around a portion of the piston second tubular body from a piston second tubular body inner diameter towards a piston second tubular body second diameter, the notched portion configured to abut a BOP housing shoulder.

12. The method of claim 9, wherein:

the first insert first prong comprises a first insert first prong base portion having a three dimensional body comprising a wing shaped profile, the wing shaped profile having a first insert first prong tip side and a first insert first prong base side, the first insert first prong tip side opposite the first insert first prong base side, wherein the first insert first prong base portion comprises a first insert first step defining a first insert first curve on a first step first side and a first insert second curve on a first step second side, and a first insert third step defining a first insert fifth curve on a third step first side and a first insert sixth curve on a third step second side, and wherein the first insert first prong further comprises a first insert first prong protrusion portion, coupled to the first insert first prong base portion, the first insert first prong protrusion portion having a circular shaped profile comprising a first insert tooth radially protruding from the first insert first prong protrusion portion, wherein the first insert tooth is proximate the first insert fifth curve on the first insert first prong base side; and the first insert second prong comprises a first insert second prong base portion having a three dimensional body comprising a wing shaped profile, the wing shaped profile having a first insert second prong tip side and a first insert second prong base side, the first insert second prong tip side opposite the first insert second prong base side, wherein the first insert second prong base portion comprises a first insert second step defining a first insert third curve on a second step first side and a first insert fourth curve on a second step second side, a first insert seventh curve, and a first insert lip.

13. The method of claim 9, wherein:

the second insert first prong comprises a second insert first prong base portion having a three dimensional body comprising a wing shaped profile, the wing shaped profile having a second insert first prong tip side and a second insert first prong base side, the second insert first prong tip side opposite the second insert first prong base side, wherein the second insert first prong base portion comprises a second insert first step defining a second insert first curve on a first step first side and a second insert second curve on a first step second side, wherein the second insert first prong further comprises a second insert first prong first protrusion portion, coupled to the second insert first prong base portion, the second insert first prong first protrusion portion having a rectangular shaped profile comprising a second insert seventh curve, the second insert seventh curve proximate the second insert first prong base side, and a second insert first prong second protrusion portion, the second insert first prong second protrusion portion having a circular shaped profile comprising a second insert tooth radially protruding from the second insert first prong second protrusion portion, wherein the second insert tooth is proximate the second insert seventh curve on the second insert first prong base portion; and the second insert second prong comprises a second insert second prong base portion having a three dimensional body comprising a wing shaped profile, the wing shaped profile having a second insert second prong tip side and a second insert second prong base side, the second insert second prong tip side opposite the second insert second prong base side, wherein the second insert second prong base portion comprises a second insert second step defining a second insert third curve on a second step first side and a second insert fourth curve on a second step second side, a second insert sixth curve, and a second insert lip, and wherein the second insert second prong further comprises a second insert second prong protrusion portion, coupled to the second insert second prong base portion.

14. The method of claim 13, wherein when the applied pressure is the closing pressure, the series of stages comprises:

a first stroke, wherein the first stroke is responsive to a first applied pressure and the first stroke moves the piston a first distance such that the piston contacts the first insert second prong, the second insert second prong, and a first packer portion;

a second stroke, wherein the second stroke is responsive to a second applied pressure and the second stroke moves the piston a second distance such that the piston contacts the first insert second prong, the second insert second prong and a second packer portion, causing a first insert first rotation and a second insert first rotation;

a third stroke, wherein the third stroke is responsive to a third applied pressure and the third stroke moves the piston a third distance such that the piston contacts a third packer portion, causing a first insert second rotation and a second insert second rotation;

a fourth stroke, wherein the fourth stroke is responsive to a fourth applied pressure and the fourth stroke moves the piston a fourth distance such that the piston contacts a fourth packer portion, causing a first insert third rotation and a second insert third rotation; and a fifth stroke, wherein the fifth stroke is responsive to a fifth applied pressure and the fifth stroke moves the piston a fifth distance such that the piston contacts a fifth packer portion, causing a first insert fourth rotation and a second insert fifth rotation.

15. The method of claim 14, wherein, upon sealing the central circumference of the apparatus when the closing pressure is applied to form the seal, an extrusion gap within the apparatus has a size of less than four inches.

16. The method of claim 14, wherein the BOP system further comprises further a mandrel extending through a central circumference of the packing unit and the piston, wherein, upon sealing the central circumference of the apparatus when the closing pressure is applied to form the seal, the seal is formed around the mandrel and an extrusion gap within the apparatus has a size of approximately zero.

* * * * *